US011559751B2

(12) United States Patent
Trickett

(10) Patent No.: US 11,559,751 B2
(45) Date of Patent: Jan. 24, 2023

(54) TOY SYSTEMS AND POSITION SYSTEMS

(76) Inventor: Alastair Trickett, Drayton St. Leonard (GB)

( * ) Notice: Subject to any disclaimer, the term of this patent is extended or adjusted under 35 U.S.C. 154(b) by 406 days.

(21) Appl. No.: 13/395,955

(22) PCT Filed: Nov. 3, 2010

(86) PCT No.: PCT/GB2010/051837

§ 371 (c)(1),
(2), (4) Date: Mar. 14, 2012

(87) PCT Pub. No.: WO2011/058341

PCT Pub. Date: May 19, 2011

(65) Prior Publication Data

US 2013/0065482 A1 Mar. 14, 2013

(30) Foreign Application Priority Data

Nov. 12, 2009 (GB) ..... 0919776

(51) Int. Cl.
*A63H 11/00* (2006.01)
*A63H 18/16* (2006.01)

(52) U.S. Cl.
CPC ..... *A63H 11/00* (2013.01); *A63H 18/16* (2013.01); *A63H 2200/00* (2013.01)

(58) Field of Classification Search
CPC ..... A63H 5/00; A63H 3/28; A63H 2200/00; A63H 11/00; A63H 18/16; G09B 19/06; G09B 19/04; G06K 7/1443
USPC ..... 446/175, 397, 485
See application file for complete search history.

(56) References Cited

U.S. PATENT DOCUMENTS 4,925,424 A * 5/1990 Takahashi ..... 446/175
5,697,829 A 12/1997 Chainani
6,171,168 B1 * 1/2001 Jessop ..... 446/297
6,354,842 B1 * 3/2002 Frei ..... 434/365
7,079,112 B1 7/2006 Liebenow
7,145,556 B2 * 12/2006 Pettersson ..... G06F 3/03545 382/313
7,358,697 B2 * 4/2008 Yourlo ..... G05D 1/0274 901/1
7,445,160 B2 * 11/2008 Ruckenstein ..... G06F 3/0321 235/494
7,553,537 B2 6/2009 Burns
7,704,119 B2 * 4/2010 Evans ..... A63H 17/14 446/454
2002/0102910 A1 8/2002 Donahue
2002/0139854 A1 * 10/2002 Kobayashi ..... A63F 9/143 235/462.01
2003/0014710 A1 * 1/2003 Dorney ..... H03M 13/3738 714/780
2004/0035935 A1 * 2/2004 Takahashi ..... G06K 19/06037 235/462.09

(Continued)

*Primary Examiner* — Eugene L Kim
*Assistant Examiner* — Alyssa M Hylinski
(74) *Attorney, Agent, or Firm* — Michael Pettit

(57) ABSTRACT

A toy system comprises a surface (1) provided with position encoding information; and a toy (2, 20) arranged to be movable across the surface (1), said toy (2, 20) comprising at least one sensor (4) for reading said position encoding information, and processing means (3) arranged to process the position encoding information read by the sensor (4) and to determine the position of the toy (2, 20) on said surface (1) on the basis of said position encoding information.

10 Claims, 38 Drawing Sheets

(56) References Cited

U.S. PATENT DOCUMENTS

2004/0085287 A1* 5/2004 Wang ..... G06F 3/0321
345/156
2004/0190085 A1* 9/2004 Silverbrook ..... H04N 1/32778
358/539
2006/0073761 A1* 4/2006 Weiss et al. ..... 446/456
2006/0219788 A1* 10/2006 Thielman ..... A63F 3/02
235/454
2007/0234164 A1* 10/2007 Marelli ..... G06F 11/141
714/E11.038
2009/0315258 A1* 12/2009 Wallace ..... A63F 3/00643
273/238
2010/0001998 A1* 1/2010 Mandella ..... G01B 11/03
345/173
2010/0013860 A1* 1/2010 Mandella ..... G06T 19/006
345/157
2010/0014784 A1* 1/2010 Silverbrook ..... G06V 30/142
382/313
2010/0304640 A1* 12/2010 Sofman ..... A63H 17/40
446/456
2010/0331083 A1* 12/2010 Maharbiz ..... A63F 3/00003
273/237
2012/0150441 A1* 6/2012 Ma ..... G01S 5/0252
701/510

* cited by examiner

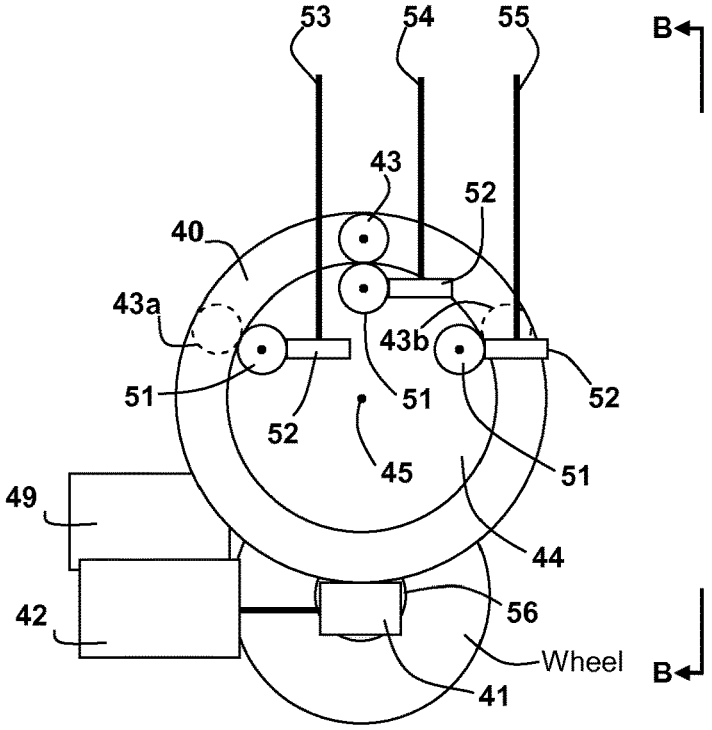
Figure 3(a) Side View A-A
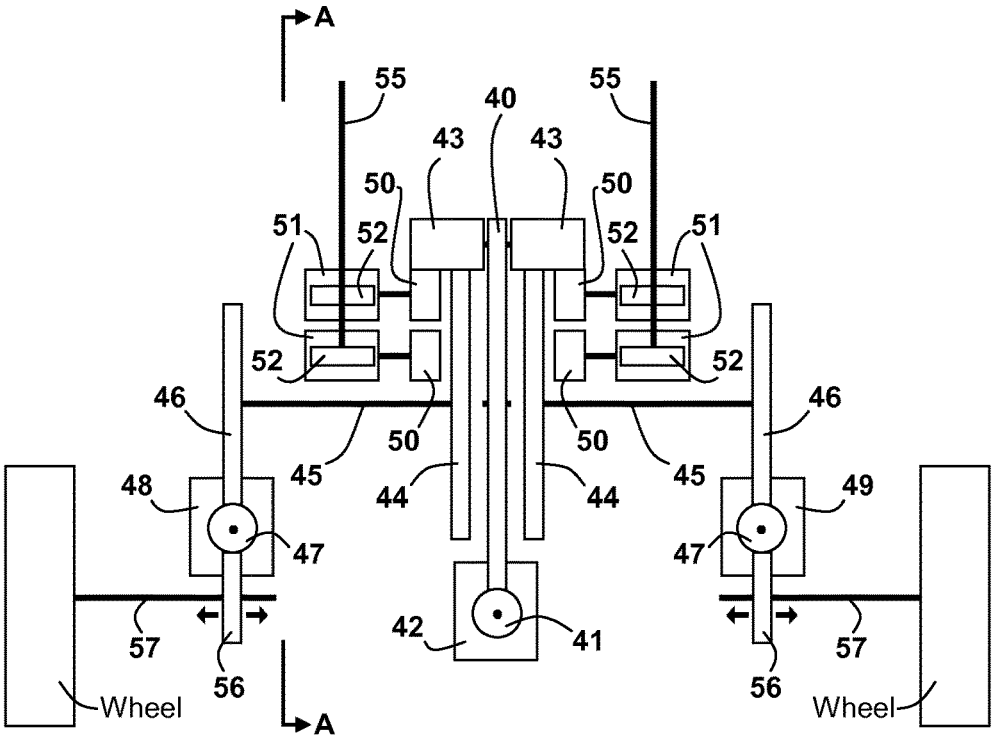
Figure 3(b) Front View B-B

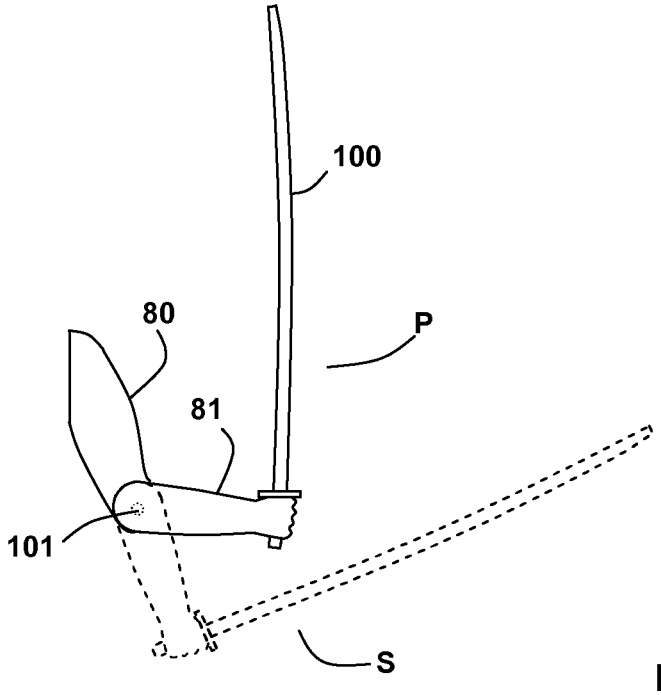
Figure 6(a)
Figure 6(b)
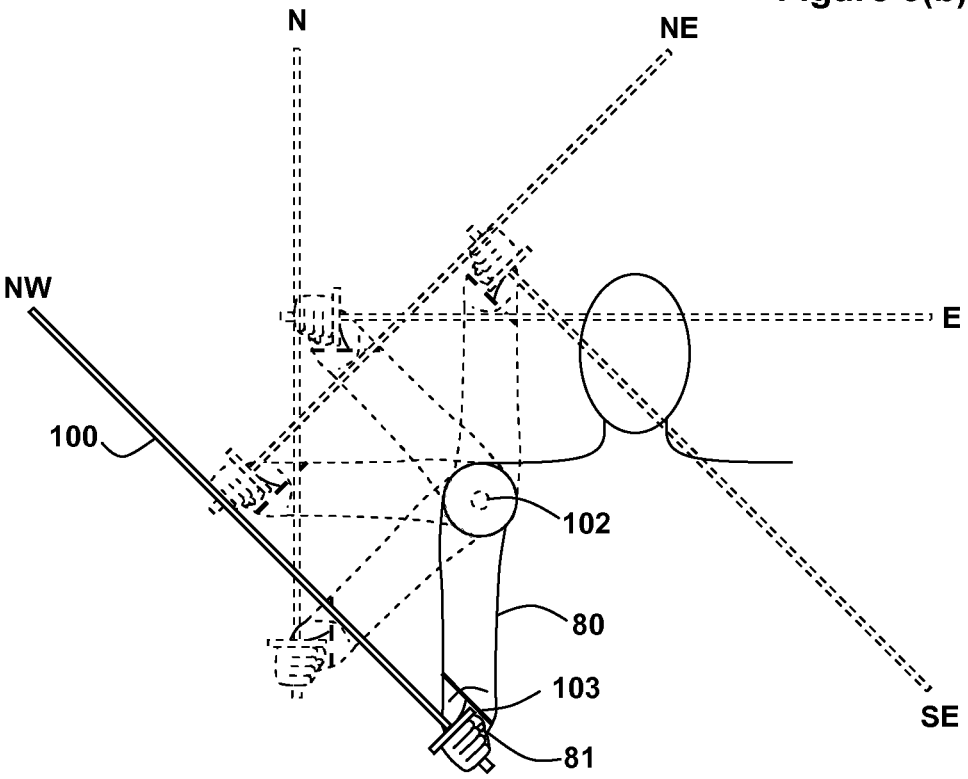

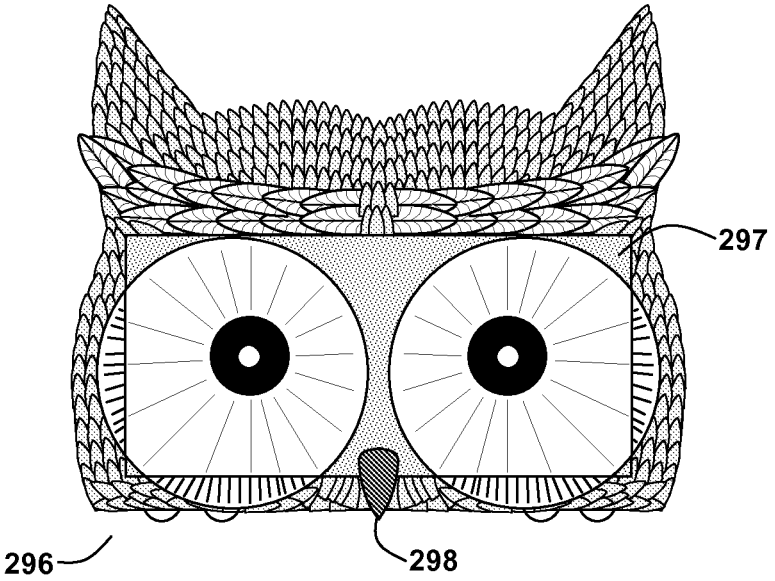
FRONT VIEW
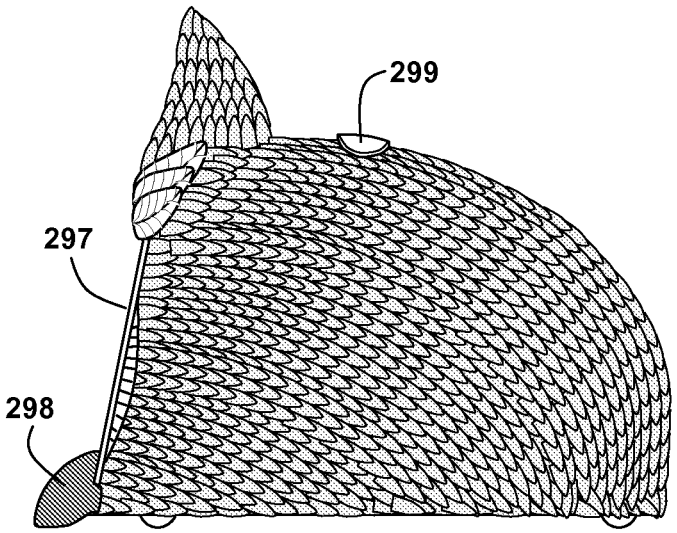
SIDE VIEW
Figure 16

| Move Type | Symbol Relationship | Illustration | Move Score |
|---|---|---|---|
| No reversal, symbols match | Sensed = Actual | | 7 |
| Reversal on a space | Sensed = Actual | | 6 |
| Reversal on a symbol | Sensed <= Actual | | 6 |
| Double reversal | Sensed <= Actual | | 3 |
| Bit Error / Jump, no reversal | Sensed < Actual | | 2 |
| Bit Error / Jump, with reversal | Sensed < Actual | | 1 |
| Bit Error, no reversal | Sensed > Actual | | 0 |
| Bit Error, with reversal | Sensed > Actual | | 0 |

Figure 29(a)

RecTBL()

| Symbol Relationship RelL | RelR | Move: NxDir | 425 -1 (Backward) Illustr. | MScr | NDir | 426 0 Illustr. | MScr | NDir | 427 +1 (Forward) Illustr. | MScr | NDir |
|---|---|---|---|---|---|---|---|---|---|---|---|
| S<L | S<R | → | | 1 | ← | | 6 | ← | | 2 | → |
| S<L | S=R | → | | 1 | ← | | 6 | ← | | 7 | → |
| S<L | S>R | → | | 1 | ← | | 3 | → | | 0 | → |
| S=L | S<R | → | | 6 | ← | | 6 | ← | | 2 | → |
| S=L | S=R | → | | 6 | ← | | 6 | ← | | 7 | → |
| S=L | S>R | → | | 6 | ← | | 3 | → | | 0 | → |
| S>L | S<R | → | | 0 | ← | | 6 | ← | | 2 | → |
| S>L | S=R | → | | 0 | ← | | 6 | ← | | 7 | → |
| S>L | S>R | → | | 0 | ← | | 0 | ← | | 0 | → |
| S<L | S<R | ← | | 2 | ← | | 6 | → | | 1 | → |
| S<L | S=R | ← | | 2 | ← | | 6 | → | | 6 | → |
| S<L | S>R | ← | | 2 | ← | | 6 | → | | 0 | → |
| S=L | S<R | ← | | 7 | ← | | 6 | → | | 1 | → |
| S=L | S=R | ← | | 7 | ← | | 6 | → | | 6 | → |
| S=L | S>R | ← | | 7 | ← | | 6 | → | | 0 | → |
| S>L | S<R | ← | | 0 | ← | | 3 | ← | | 1 | → |
| S>L | S=R | ← | | 0 | ← | | 3 | ← | | 6 | → |
| S>L | S>R | ← | | 0 | ← | | 0 | → | | 0 | → |

428 429 430

Figure 29(b)

RecTBL()

| Symbol Relationship | | Entry Dir | Exit Dir | Move: -1 (Backward) | | 0 | | +1 (Forward) | |
|---|---|---|---|---|---|---|---|---|---|
| RelL | RelR | | | Illustr. | MScr | Illustr. | Score | Illustr. | MScr |
| S<L | S<R | F | F | | 1 | | 1 | | 1 |
| S<L | S=R | F | F | | 1 | | 1 | | 7 |
| S<L | S>R | F | F | | 1 | | 1 | | 0 |
| S=L | S<R | F | F | | 1 | | 1 | | 1 |
| S=L | S=R | F | F | | 1 | | 1 | | 7 |
| S=L | S>R | F | F | | 1 | | 1 | | 0 |
| S>L | S<R | F | F | | 0 | | 1 | | 1 |
| S>L | S=R | F | F | | 0 | | 1 | | 7 |
| S>L | S>R | F | F | | 0 | | 0 | | 0 |
| S<L | S<R | B | B | | 1 | | 1 | | 1 |
| S<L | S=R | B | B | | 1 | | 1 | | 1 |
| S<L | S>R | B | B | | 1 | | 1 | | 0 |
| S=L | S<R | B | B | | 7 | | 1 | | 1 |
| S=L | S=R | B | B | | 7 | | 1 | | 1 |
| S=L | S>R | B | B | | 7 | | 1 | | 0 |
| S>L | S<R | B | B | | 0 | | 1 | | 1 |
| S>L | S=R | B | B | | 0 | | 1 | | 1 |
| S>L | S>R | B | B | | 0 | | 0 | | 0 |
| S<L | S<R | F | B | | 1 | | 7 | | 1 |
| S<L | S=R | F | B | | 1 | | 7 | | 1 |
| S<L | S>R | F | B | | 1 | | 1 | | 0 |
| S=L | S<R | F | B | | 1 | | 7 | | 1 |
| S=L | S=R | F | B | | 1 | | 7 | | 1 |
| S=L | S>R | F | B | | 1 | | 1 | | 0 |
| S>L | S<R | F | B | | 0 | | 7 | | 1 |
| S>L | S=R | F | B | | 0 | | 7 | | 1 |
| S>L | S>R | F | B | | 0 | | 0 | | 0 |
| S<L | S<R | B | F | | 1 | | 7 | | 1 |
| S<L | S=R | B | F | | 1 | | 7 | | 1 |
| S<L | S>R | B | F | | 1 | | 7 | | 0 |
| S=L | S<R | B | F | | 1 | | 7 | | 1 |
| S=L | S=R | B | F | | 1 | | 7 | | 1 |
| S=L | S>R | B | F | | 1 | | 7 | | 0 |
| S>L | S<R | B | F | | 0 | | 1 | | 1 |
| S>L | S=R | B | F | | 0 | | 1 | | 1 |
| S>L | S>R | B | F | | 0 | | 0 | | 0 |
| S<L | S<R | P | P | | 1 | | 6 | | 1 |
| S<L | S=R | P | P | | 1 | | 6 | | 7 |
| S<L | S>R | P | P | | 1 | | 7 | | 0 |
| S=L | S<R | P | P | | 7 | | 6 | | 1 |
| S=L | S=R | P | P | | 7 | | 6 | | 7 |
| S=L | S>R | P | P | | 7 | | 7 | | 0 |
| S>L | S<R | P | P | | 0 | | 7 | | 1 |
| S>L | S=R | P | P | | 0 | | 7 | | 7 |
| S>L | S>R | P | P | | 0 | | 0 | | 0 |

Figure 34(a)

| Move Type | Symbol Relationship | Illustration | Move Score |
|---|---|---|---|
| No error | Sensed = Actual | | 7 |
| Expected reversal on a symbol | Sensed <= Actual | | 7 |
| Parallel move | Sensed <= Actual | | 6 |
| Reversal on a space | Sensed = Actual | | 1 |
| Reversal on a symbol | Sensed <= Actual | | 1 |
| Double reversal | Sensed <= Actual | | 1 |
| Bit Error / Jump, no reversal | Sensed < Actual | | 2 |
| Bit Error / Jump, with reversal | Sensed < Actual | | 1 |
| Bit Error, no reversal | Sensed > Actual | | 0 |
| Bit Error, with reversal | Sensed > Actual | | 0 |
| Parallel Bit Error | Sensed > Actual | | 0 |

Figure 34(b)

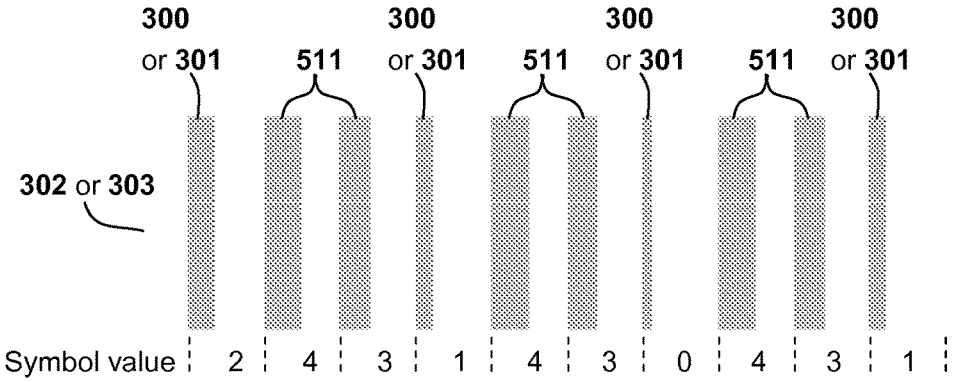

Figure 35(a)

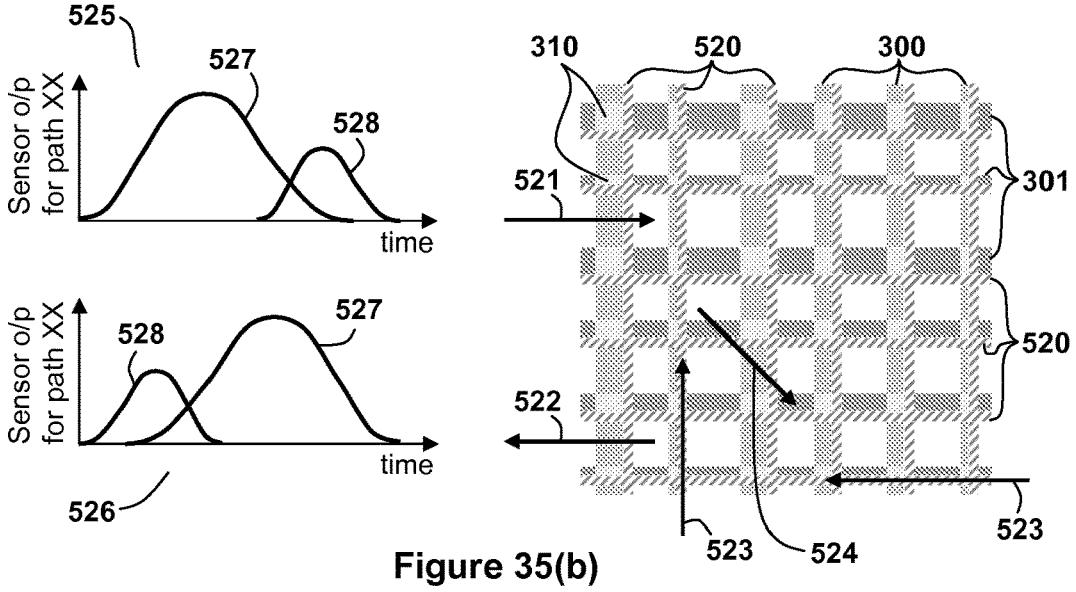

Figure 35(b)

TOY SYSTEMS AND POSITION SYSTEMS

FIELD OF THE INVENTION

The invention relates to toy systems, position systems, and related methods

BACKGROUND

Powered toys with or without actuator driven appendages, lights and/or speech capabilities are well known in the art. Usually they are powered by motors and constructed to resemble figures, animals, vehicles and other common play items.

Typically the operation of the toy is predetermined, with little option for a user to alter its behaviour, so children may quickly become bored with it. Recognising this, toys have been described (e.g. U.S. Pat. Nos. 5,697,829, 6,012,961, 6,645,037, and 6,902,461) that can be programmed by a child for autonomous operation. Unfortunately this is a complex process requiring abstract thought to relate the virtual-world program steps with the real-world movements of the toy. This makes them unsuitable for many children, particularly younger ones.

Therefore there is a need for a toy that can be taught new 'moves' and other actions (e.g. arm/head movements, speech, etc.) simply by the child manipulating the toy in the real world and physically showing the toy what the child wants it to do. Such a toy has the advantages of being accessible and operable by even very young children, while also sustaining the child's interest by making their play more varied and more fun.

Such a toy also has advantages in the education of children. One way children learn about the world is by acting out scenarios and implicitly observing the results of their actions through games and other play. Often 'dumb' toys serve as props or actors in these scenarios, which for entertainment the child will often repeat over and over again. Such repetition further facilitates the learning process, allowing more to be discovered with each iteration of the scenario. So a toy which functions as an interactive, animate actor, which can quickly be taught its role in the child's game, and replay its part over and over again, supports and encourages this learning process.

A simple example of such a toy is given by Mr P. A. Frei in U.S. Pat. No. 6,354,842, which describes a rolling toy with motion recording and playback capability. In recording mode the user pushes the device through a path over whatever surface (e.g. the floor) it is placed on, rolling it on two wheels mounted underneath it. Optical encoders monitor the rotation of each wheel and the recording is made by storing these sensed rotations, as a time-sequence, in internal memory.

When the toy is set in playback mode, the onboard processor generates drive signals for the motors coupled to the wheels, to cause the rotation of the wheels (as measured by the sensor) to match the time-sequenced recording of rotations stored in memory. In this way the movement of the toy is reproduced.

Though this approach makes it easy for a child to 'show' a toy what to do, it has three key disadvantages.

Firstly, the positioning method used to determine the path of the toy is not based on an external reference. Because only the rotation of the wheels is monitored, the toy has no way of determining its position relative to its environment or other toys. This prevents the creation of toys that can autonomously interact with their environment or each other.

Because of the above, the position and orientation of the toy, at the start of a recording, cannot be known by the toy. In playback mode the user must ensure that the toy is placed in exactly the same starting position and orientation, or the ending position will not be the same. This can be an onerous task, especially for younger children, and prevents the easy exchange of recordings between users. Even a small angular deviation from the recorded starting orientation can cause a toy moving over a long path to end up significantly off-course at the end of the path. This leads to user disenchantment, particularly if their intention was for two or more such toys to meet or act in concert.

Thirdly, the toy is vulnerable to slippage between the wheels and the surface during recording or playback. Slippage causes the toy to think it has moved a different amount (by reference to the rotation of the wheels) than it actually has (by reference to the surface). These errors accumulate, resulting in a potentially large compounded error by the end of the path, leading to further disenchantment of the user.

Despite the above significant shortcomings, Mr Frei does not suggest any alternative position-sensing method. He does suggest the use of large 10-watt motors, batteries or dead weight to counteract slippage, but this is clearly disadvantageous for: the toy's portability, the effort required by the child to move the toy around in training mode, and the costs associated with manufacturing, shipping and stocking the toy.

In U.S. Pat. No. 6,459,955 a home-cleaning robot is described that uses an external reference means for positioning. However, the means described are costly, involving as they do either imaging (e.g. to use a building's ceiling-lights or shadows as navigational markers), or triangulation using radiation emitting beacons. This makes them inherently unsuitable for a toy.

Finally, U.S. Pat. No. 6,491,566 describes how a team of self-propelled slave robots may be controlled by a central-controller using centrally-obtained position-sensing information gathered by a Field Sensor. The relative expense of the means described for this Field Sensor—using a video camera looking down on the toys, or triangulation of radiation emissions—again makes them inherently unsuitable for the toy-market. Furthermore, this invention is entirely about the control of multiple toys by a user, using a central controller. No method is described (or even envisioned) for training the toys how to behave or allowing the toys to act autonomously using that trained behaviour.

For the purposes of the present invention, prior-art in the field of position-sensing using an encoded surface has a number of short-comings, primarily with regard to the cost of implementation.

U.S. Pat. No. 4,009,377 describes how windowing-sequences can be used to acquire, track and recover positions on a single (one-dimensional) coordinate axis using a printed bar-code, sensed by the light reflected from it to a sensor, such as a photo-transistor. A windowing-sequence (a.k.a. deBruijn sequence, m-sequence, pseudo-random sequence) is a sequence in which every sub-sequence of W sequential symbols (W being the window-length), is unique in the overall sequence and thus has a unique location in that sequence. So if each symbol in the sequence represents a coordinate, then the position of a sensor in that coordinate-space can be determined simply by sensing W adjacent symbols.

Printing position-encodings onto a surface and sensing them with a single photo-transistor (or similar) offers a potentially affordable solution for position-sensing in toys, provided it can be extended to two-dimensions and provided the cost of the electronics to sample and digitise the sensor output are sufficiently low.

U.S. Pat. No. 5,442,147 describes how one-dimensional windowing sequences can be combined to form a two-dimensional array of values that can be encoded in a grid of coloured squares printed on a surface. The squares are sensed with three light sensors, each with a different colour filter, whose output is digitised by an analogue-to-digital converter (ADC). As the squares must be coloured in at least six colours (so that the sensor's movement can be tracked in any direction), the ADC must be reasonably high-resolution to discriminate and digitise the red-green-blue (RGB) colour components of light reflected from the multi-hued squares. These factors make the sensing device and associated electronics costly for a toy. Even more significantly, the method provided can only handle one-reversal (relative to a coordinate-axis) of the sensor, at least until that reversal is resolved, making it poorly suited for free-form play, in which a toys path may be reversed a number of times in rapid succession.

U.S. Pat. Nos. 7,553,537 and 7,079,112 both describe systems in which the colour or density of printed codes on a surface are used to directly encode coordinate positions. The key drawback here is that there must be the same number of densities or colours used as there are positions encoded. This complicates the printing of the codes and demands a high-resolution ADC capable of discriminating the fine deviations in sensor output caused by deviations in colour or density. Of course, the greater the coordinate space, the worse the problem becomes. Consequently errors in digitisation become more likely, particularly if, as the toy is moved over the surface, there is any deviation in the length of the light-path to the sensor, as this will affect the level of light sensed by the sensor. This may be caused, for example, by flexing in the toy's chassis, as the pressure on the toy of the user's hand varies as it is moved.

Other art, e.g. U.S. Pat. Nos. 4,686,329, 5,343,031 and 6,032,861, and the many patents awarded to Anoto AB and Silverbrook Research Pty Ltd., use information-rich two-dimensional codes printed on a surface to encode position. These all require a complex array of multiple sensors to decode the codes such as, for example, one or more line-sensor-arrays or a charge-coupled-device (CCD) for two-dimensional imaging. The cost of such sensors and the electronics required to process their signals, make them prohibitive for the current invention.

SUMMARY OF THE INVENTION

The invention provides a toy system, position system, and related methods as set out in the accompanying claims.

DESCRIPTION OF THE DRAWINGS

Embodiments of the invention will now be described, by way of example only, with reference to the accompanying drawings, in which:

FIG. 3(*a*) is a functional diagram of the selectable-transmission 9 viewed from the side looking from section A-A in FIG. 3(*b*).

FIG. 3(*b*) is a functional diagram of the selectable-transmission 9 viewed from the front looking from section B-B in FIG. 3(*a*).

FIG. 6(*a*) is a diagram showing the two states of the sword-forearm 81 and sword 100 (some features, including the forearm armour 83, have been omitted).

FIG. 6(*b*) is a diagram showing the five orientations of the sword-arm 80 and sword 100 (some features, including the forearm armour 83, have been omitted).

FIG. 16 provides a front and side view of the Wise Old Owl toy (surface not shown).

FIG. 21(*a*) show how the squares 310 should be coloured with a dark background 307 and FIG. 21(*b*) shows how they should be coloured with a light background 307.

FIG. 29(*a*) shows the scores and type of moves that are considered by the RecoverPosition 363 sub-routine when it is scoring potential moves in the RecTree( ) for passive-mode positioning.

FIG. 29(*b*) shows the data used to populate the RecTBL( ) constant array used by the RecoverPosition 363 sub-routine for passive-mode positioning.

FIG. 34(*a*) shows modified data that may be used to populate the RecTBL( ) constant array when used by the RecoverPosition 363 sub-routine for autonomous-mode positioning. FIG. 34(*b*) illustrates the moves considered in compiling the data for FIG. 34(*b*).

FIGS. 35(*a*) and (*b*) show how orientation may be encoded in the symbol-line sequences 302 or 303 by embedding orientation markers within those sequences 302 or 303. Note that the sequence encoding shown is illustrative only. The background 307 is not shown.

DESCRIPTION OF PREFERRED EMBODIMENTS

The Toy System

A variety of different toys and games may be derived using the methods in this description and these are described, in the general case, below. To further aid understanding, specific examples of such toys will be provided later.

Figure 1:
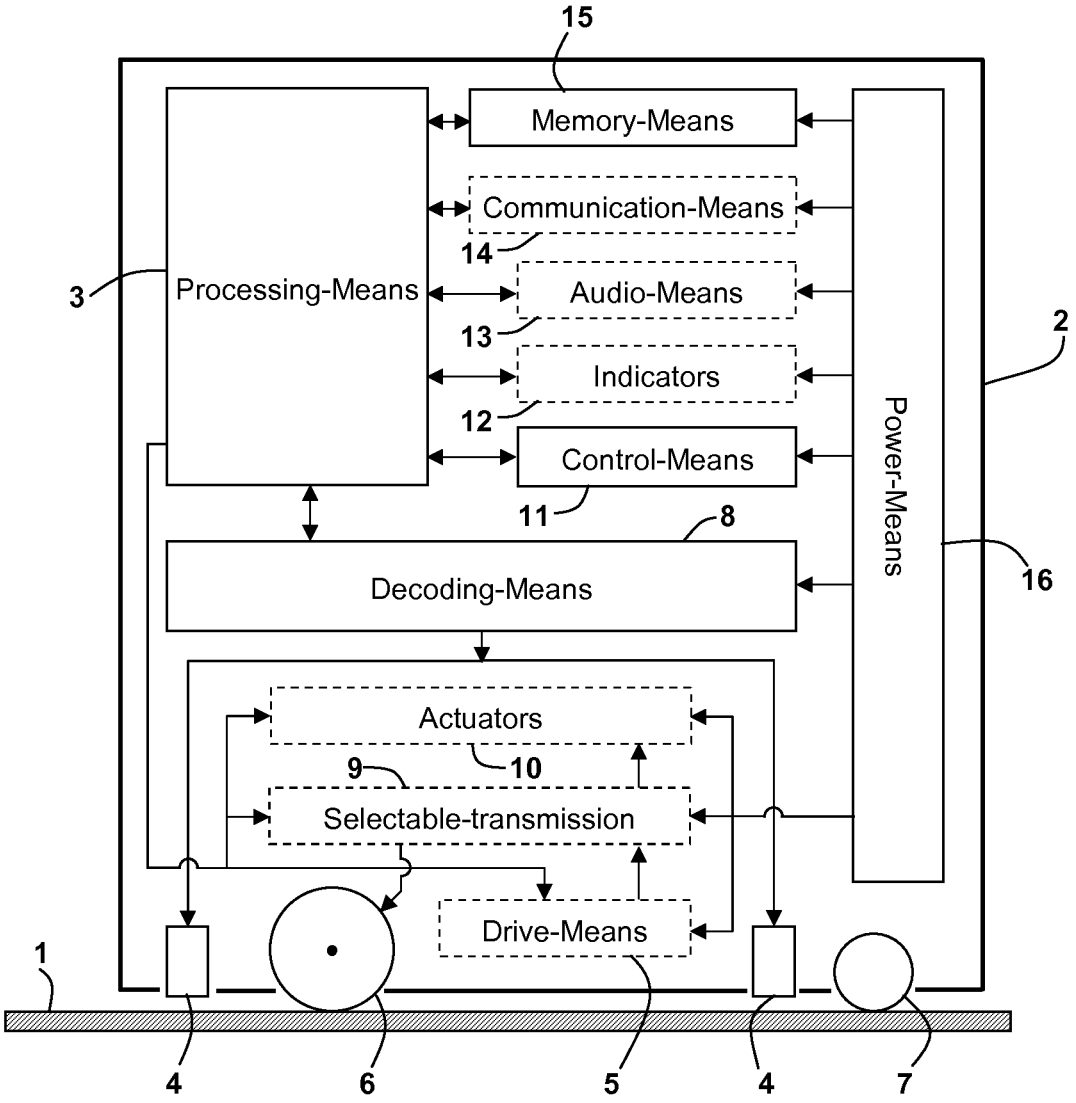
FIG. 1 is a block diagram of the common features (solid outlines) and optional features (dashed outlines) of the Toy System.

The toys described below share the following common features, illustrated in FIG. 1.

1) One or more, wholly or partially position-encoded surfaces 1 over which toys may roll. Where multiple surfaces 1 are used, means may be provided for the toy(s) to move from surface 1 to surface 1.

The surface 1 encodes at least one dimension such that the relative or absolute coordinate(s) of a sensing-point, generally designated 4, sensible to said codes, may be determined. Cartesian, Polar or any other coordinate arrangement may be used. Without limiting the generality of these statements this document will, for convenience, assume the surface 1 is coded with two-dimensional Cartesian coordinates. The surface 1 encoding and decoding may be in a way known in the art. It may also rely on any effect including, without limitation: optical, electrical, magnetic, electrostatic, thermal, or sonic, or any force or energy transfer effect, or any encoding using roughness or other topographical effect.

2) A base 2, which may or may not be separable from a body mounted on the base 2. The body may be any human, animal, alien, mythical, vehicular, structural or other form, suitable to the application for the toy system. The base 2 contains:

a) One or more sensing-points 4 able to sense the various codes at points on the surface 1, as the sensing-points 4 are moved across the surface 1.

b) Decoding-means 8 able (in conjunction with the sensing-points 4, processing-means 3 and memory-means 15) to extract the value of the codes by capturing, conditioning and digitising the output signals of the sensing-points 4, as they sense said codes. For example, the decoding-means 8 may comprise a sample-and-hold amplifier (SHA) followed by a simple digitiser (a crude ADC), as are well known in the art.

c) Support-means 6 able to support the toy over the surface 1 in a manner that allows the toy to be freely moved, or driven and steered under its own power (if drive-means 5 is provided, as described later) about the surface 1, while keeping the sensing-points 4 in an appropriate disposition relative to the codes in the surface 1, as required for their effective operation. For example, support-means 6 could be provided by rotating-members, such as wheels, treads, or sphere(s) protruding below the base 2 of the toy.

d) Power-means 16 to power the toy and power-switching means to couple and decouple the power-means 16 to the toy, as may be required.

3) The base 2 will also typically contain a processing-means 3 and control-means 11, as are now described. However, in some embodiments these means may be placed in a central device in communication with the toys such that these means can be shared between the toys, with the obvious cost-savings that implies.

a) Processing-means 3 (e.g. microcontroller, microprocessor, digital-signal-processor, system-on-chip device, etc.), coupled to memory-means 15 (e.g. ROM, RAM, PROM, EPROM, EEPROM, FLASH, etc.). Processing-means 3 is able to control the systems within the toy, to determine and track its position and motion using the codes output by the sensing-points 4 and decoding-means 8, and to execute a game or activity for that particular type of toy.

b) Control-means 11, as may be provided by mechanical switches, voice-command-recognition, gesture-recognition, remote-control, or any other means known in the art by which a user may control the operations and functions (described below) of the device. Control-means 11 may also exist implicitly as the result of some other function of the toy. For example, the positioning capability of the toy may be used to control the operation of the toy by its proximity to specific elements on the surface 1, or by noting when the toy has stopped moving, or when sound inputs to the toy's audio-means 13 (if any, see later) have fallen below a certain level for a certain period of time, etc.

The toys described below created with this Toy System, have a conceptual mode of operation called Passive-Mode. They may also have a second conceptual mode of operation called Active-Mode.

In Passive-Mode the toy is free to be pushed around the surface 1. Passive-Mode has a sub-mode able to sense and record data about the activities of the toy, as caused by the user, over a particular period of time. These activity-recordings are stored in a data-structure in the memory-means 15, which captures the activity along with the timing and/or sequence of the activity.

Activity-recordings may include data about the sensed orientation, position, speed, path or any other data pertaining to the movement (or lack of movement) of the toy, as it is pushed by the user over the encoded surface 1. It may also include data about the activation (or lack of activation), by the user, of functions in the toy. This may include, for example, the point in the toy's path at which the function was activated/deactivated; the identity of the function; the intensity and duration of the function's activation; the content of the function; and/or any other parameters related to the activation of that function.

To be clear these functions may include any of the actuators 10, indicators 12, voice-synthesis, voice-playback or other functions described herein or that may be known in the art.

By way of example this context-data may include or be derived from (without limitation): data about the disposition, location, movements or function activations of the toy (as may or may not be included in the activity-recording); and/or data about the location of the toy in relation to features of the surface 1 or its environment; and/or data about the disposition, location, movements, or function activations of other toys or passive-accessories 33 (described below). Typically such data will have some relation (such as relative timing) to the activity-recording that was made. This relationship will be defined and determined according to the game or activity in which the toy is engaged.

Between Passive-Mode and Active-Mode, the toy may enter a processing-stage (automatically or at the behest of the user) to analyse the activity-recordings and their associated context-data, captured during Passive-Mode. The output of this stage is a series of play-sequences with their own associated context-data (if any). In pursuance of whichever game or activity the toy is engaged in, these play-sequences will be used in Active-Mode to control the movements and activities of the toy (called herein "enacting" or "replaying" the play-sequence). In addition, play-sequences and any associated context-data may be created by the toy provider, or some other licensed-party, to be supplied with or available for download to, or insertion in, the toy.

By way of example: the processing-stage, at its simplest, may produce a one-to-one conversion between an activity-recording and a play-sequence. This would be usable to playback the activity-recording substantially as it was recorded. Alternatively, the conversion may involve a modification process that may, for example, allow replay to be speeded-up, or slowed-down, or altered in some other way, as will be clear to anyone skilled in the art.

At a more complex level, this processing-stage may process and/or analyse one or more activity-recordings and their context-data (from one or more toys), and the relationships between different parts of these recordings and data, to derive or generate play-sequences and associated context-data (if any), in accordance with algorithms governed by the game or activity in which the toy is engaged. In this instance, the relationship between activity-recording(s) and play-sequence(s) may or may not be discernible in the play-sequence(s), and the relationship may not be one-to-one, but may be one-to-many or many-to-one, or many-to-many.

This processing-stage may also occur at one or more times other than between Passive-Mode and Active-Mode. For example, additional context-data may be gathered during Active-Mode which may, for example, relate to the 'success' or otherwise (in relation to the game) of a particular play-sequence recently enacted in Active-Mode. Using this new context-data, the system may be able to reprocess the play-sequence and/or its ancestral activity-recording(s), or to use either or both as the basis for generating whole new play-sequence(s) and associated context-data (if any). Thus the toy may, for example, learn and evolve over time.

Moving on now to Active-Mode, in which the toy can move around the surface 1 under its own power (e.g. by coupling the rotating-members to their respective prime-movers) and/or activate its functions. This occurs autonomously under the control of the processing-means 3, as dictated by the particular play-sequence that the processing-means 3 may be enacting. In some toys this may simply involve replaying a play-sequence chosen by the user. In others, the toy may automatically decide which play-sequence to use at any given time and do this repeatedly in pursuit of the game or activity in which it is engaged. These decisions would be made using algorithms governed by the rules or parameters of the said game or activity. For example, in some embodiments the choice of play-sequence may be based on some defined relationship existing between the context-data of the chosen play-sequence, and the context of the toy in relation to the game or activity in which it is engaged. For example, this may be its context before or at the time it needs to choose its next play-sequence, in order to progress its participation in said game or activity.

Some toys created with this Toy System may also incorporate any or all of the following features (or any other features already known in the art). These are represented in the block diagram of FIG. 1 by blocks with dashed outlines.

Some embodiments may have actuators 10 to control the position and/or arrangement of movable-appendages such as, for example, the arms, hands, head, body, tail, wings, flippers, fins, legs or facial features (e.g. lips and eyebrows) of a toy styled as a figure, animal or robot. Of course, if the toy represents a vehicle, structure, or other object, then the actuators 10 may control mechanisms in that object (e.g. shovel, doors, drill, missiles, propellers, etc.). It will be clear there are many ways and many purposes for which such actuators 10 and appendages may be designed.

Some embodiments may contain indicators 12, arranged to display images, or emit light, heat, sound, vibration or some other effect.

Some embodiments may include audio-means 13 (including audio-output-means, e.g. speaker and, if required, audio-input-means, e.g. microphone). This may provide speech-synthesis; and/or speech-recording and either playback, or modification and regeneration, of that speech; and/or speech-recognition.

The actuators 10, indicators 12, and audio-means 13 may be autonomously controlled by the processing-means 3, and/or they may be controlled by the user via the control-means 11. Data about this usage may be included in activity-recordings, context-data and/or play-sequences, as previously described.

Some embodiments may include drive-means 5, under the control of the processing-means 3 and, potentially, the control-means 11. In these embodiments the support-means 6 would be provided by rotating-members, some or all of which may be coupled to the drive-means 5 so that the toy may autonomously drive itself about the surface 1. Said drive-means 5 may also separately operate actuators 10 on the toy. Drive-means 5 could, for example, be provided by electric-motors or solenoids or any other prime-mover, with appropriate drive-electronics to provide a control-interface between the processing-means 3 and the prime-mover.

Some embodiments may contain mechanical switching-means (e.g. a selectable-transmission 9) coupled to the drive-means 5 and able to selectively re-direct power from the drive means 5 to one or more of a selection of potential destinations including, for example, the rotating-members and/or actuators 10.

Some embodiments may have passive stabilisation-means 7 (e.g. roller-balls, idler-wheels, skids), which may be arranged on the toy base 2 to augment the support-means 6 by providing increased stability for the toy.

Some embodiments may also include communications-means 14 implemented, for example, using infra-red, wireless, wired or other transceivers. The same or different communications-means 14 may allow the toy to communicate and interact with other toys; and/or it may allow the toy to be connected to a computer (and thence to the internet) thereby allowing play-sequences to be up- and down-loaded. This allows users to share their play-sequences with other users via web-sites on the internet, thus adding to the enjoyment of the toy. It may also allow software to be provided with the toy that could, for example, allow play-sequences to be created, viewed, edited, managed, generated or otherwise manipulated, and then downloaded to the toy(s). Communications-means 14 may also be provided in the form of removable storage media that would allow data to be physically transferred to/from toys.

In some embodiments, the surface 1 may contain further graphics, artwork or other features that are related to the application or branding of the toy, provided it does not interfere with the position encoding elements of the surface 1. In such embodiments, data may be transferred to or in the memory-means 15, such that the toy is able to assign meaning (relevant to the graphics) to various areas on the surface 1. For example, if part of the surface 1 represents a play-area, then the data provided to the memory-means 15 would contain the surface 1 coordinates of that play-area, so that the toy would know when it had entered it by comparison with its own position.

The surface 1 may be separate, or may form part of a larger structure specific to the toy, such as an arena. It may be supplied separately from or with the toy. Overlays depicting some graphic or other may also be supplied for overlaying on the surface 1. Such overlays and the surface 1 may also be supplied by electronic means enabling the user to print the surface 1 or overlay at home.

Some embodiments may contain Move-Off means, able to determine when the toy or its sensing-points 4 has moved, or is about to move, outside the position-encoded part of the surface 1. Some embodiments may contain as part of their control-means 11, Lift-Off-means (able to determine when the toy is lifted from the surface 1) and Held-means (able to determine when the toy is held by a user and is thus not free to move autonomously).

Some embodiments may contain additional sensors, created in any way known in the art and usable by the toy to capture further information about its environment and/or its relationship to that environment.

Some embodiments may allow the toy to be reconfigured for different games or applications, either by wholly or partially replacing specific parts of the toy (for example, the processing-means 3, memory-means 15, body, appendages, accessories 33, surface 1, etc.) and/or by inserting new data and programming into the processing-means 3 and memory-means 15, in any of the many ways known in the art.

Passive-accessories 33, which are not self-propelled, may be provided in some embodiments for use with the toy-system. Some accessories may be truly inactive, others may have position-sensing and communications-means 14, such that they can determine and communicate their position and identity to the toys or other objects. Passive-objects may be normally static (e.g. buildings, furniture, etc.) or they may be driven by the toys in pursuit of some game or activity (e.g. vehicles, airplanes, pucks, balls, etc.)

This Toy System may be applied to a wide variety of games, activities and applications that could include, without limitation: racing, sports, puzzle, strategy, adventure, knowledge, board, or other competitive, points-based and/or location oriented games or educational games, activities or applications. In such games, activities or applications the toys may be acting individually or cooperatively in teams.

To illustrate the scope of this Toy System (without limiting the broad potential of its applications), exemplary embodiments are now provided for a few categories of the toy: Role-Play, Competitive, Social Simulation, and Informational. Role-Play and Competitive toys both have Active- and Passive-Modes of operation. Role-Play toys essentially record and play-back the path and activities of the toy. Competitive toys learn behaviours in a first phase, and then autonomously adapt those learnt behaviours in a competitive second phase against other toys. Social Simulation toys are mainly autonomous and thus typically operate in Active-Mode using play-sequences pre-programmed into them. Informational toys, unlike the others, are not self-propelled and so only have a Passive-Mode of operation. They act essentially as pointing devices, providing information on the surface 1 elements they are pointed at.

These are not the only potential categories of application for the toy. For example, the Toy System may not even form part of a game or specific application but may instead simply provide positioning capability for a vehicle or robotic construction set. Alternatively, it may just provide positioning (e.g. pointing) input for a game conducted in a computer.

Each of these embodiments may contain the common features described above and may incorporate any features as may be required and as are already known in the art. Thus the following descriptions focus on those details which are specific to the embodiment of the Toy System. Omitted aspects may also include (without limitation): any characteristics or features already known in the toy-makers art that may be incorporated in this toy; details of the way the electronics and mechanics are constructed and fitted together; and details of the ways in which the various "-means" may be implemented and organised, etc.

Role-Play: Celebrity

Figure 2:
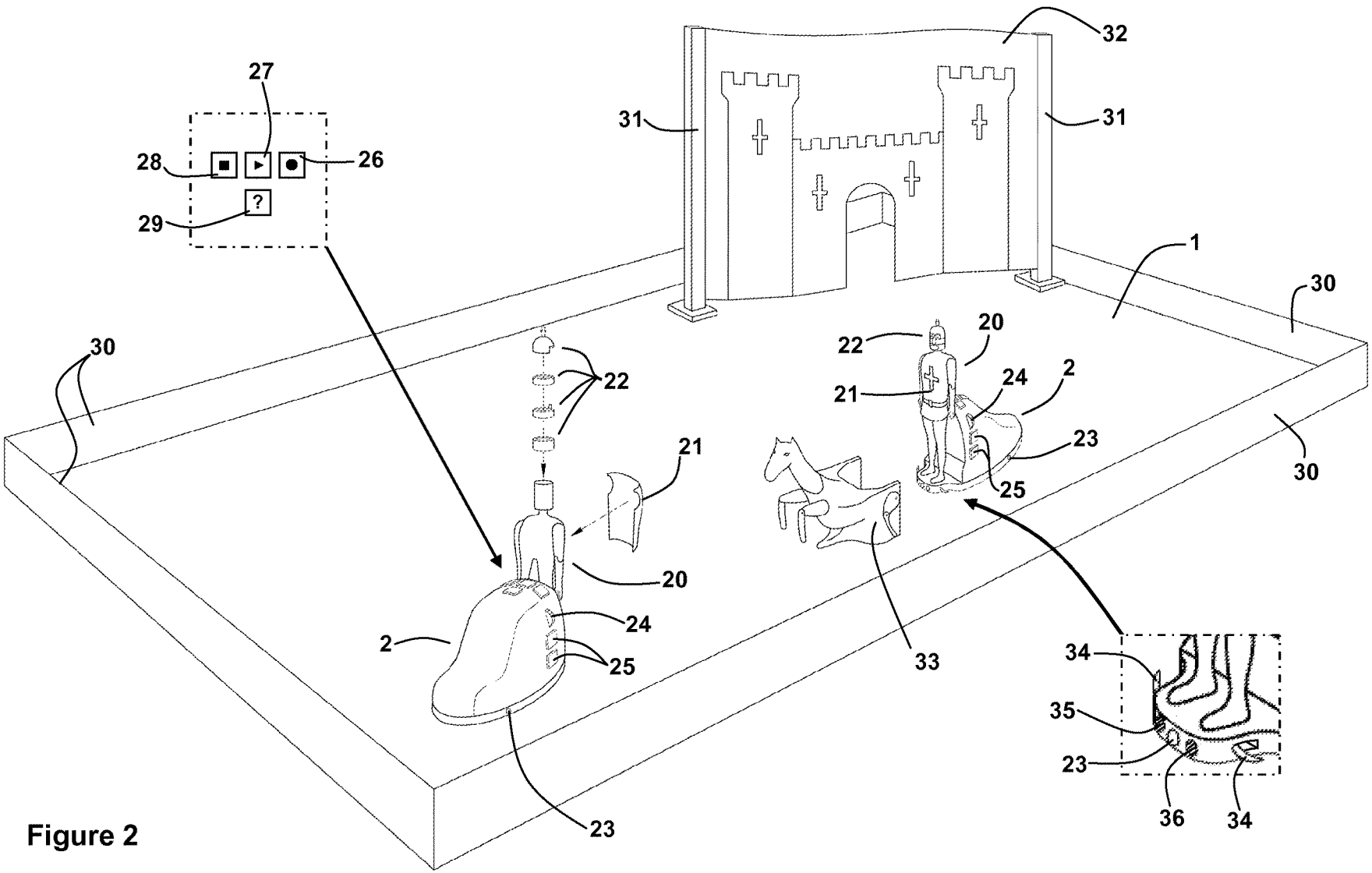
FIG. 2 is an illustration of the Celebrity application for the Toy System. Surface encoding and some mechanism detail are not shown.

Celebrity is a toy-set for budding impresarios. The Toy System's encoded-surface 1 serves as the stage, with the self-propelled, position-aware toys becoming the actors. Said set is comprised of one or more toy-bases 2 with removable toy-bodies 20, as illustrated in FIG. 2. Different toy-bodies 20 are provided (or sold separately) representing figures, animals, vehicles, objects, etc.

A 'wardrobe' section in the set provides interchangeable clip-on costumes and other fittings, generally designated 21, that may be attached to the toy. Similarly a 'makeup' section provides clip-on faces, or separate clip-on face features and hairstyles, all generally designated 22, or other embellishments appropriate to the different body-types. In an alternative embodiment of Celebrity, the faces of the figures may be made of a blank, easily wiped material so that the user could create their own faces, using crayons or dry-wipe markers provided in the 'makeup' section.

Passive-accessories 33, such as the horse shown in FIG. 2, may be provided in a 'props' section in, or supplied separately to, the theatre set. Passive-accessories, 33, may be any manner of item including, without limitation, vehicles, boats, airplanes, buildings, baskets, battleaxes, flora, fauna, etc.

A 'scenery' section may also provide a number of free-standing upright supports 31, with clips able to retain sheets 32 (e.g. paper, card or plastic) usable as scenery backdrops. Pre-printed scenery sheets 32 may be provided with the toy-set and/or the 'scenery' section may contain coloured pencils, paints or other markers, with blank sheets 32 for the user to create their own backdrops.

If it does not interfere with the position-encoding system used, the surface 1 may be printed to look like a stage, or it could be printed with ground scenery to add to the theatrical effect. Additional surfaces 1, with different art-work, may be sold separately to the toy-set.

Two co-axial, independent wheels, each of which can be coupled to an associated prime-mover, protrude below the toy-base 2 and provide the support-means 6. A roller-ball also protrudes below the toy-base 2 to provide the stabilisation-means 7. Together, these hold the toy in a stable fashion above the surface 1.

In the toy-base 2, two sensing-points 4 at the front and rear of the base 2 (i.e. fore and aft of the wheel's axles), allow the toy to determine its position at two points on the surface 1 and thereby also its orientation about its vertical axis. In other embodiments, only one sensing-point 4 may be provided and orientation may be determined by comparing the direction and rate at which x- and y-coordinates are crossed.

Communications-means 14 is also provided using infra-red transceivers 23 mounted around the periphery of the base 2, thereby allowing the toy to exchange play-sequences with a computer and to communicate with other Actors on the surface 1. As there is a possibility that a first toy (or the user's hand) may block transmissions from a second toy to a third toy, some embodiments may include small reflective barriers 30 arranged around the edge of the surface 1 to reflect transmissions back into the surface 1 area, thereby providing multiple alternative paths for transmissions from the second to the third toy.

Alternatively, instead of mounting the infra-red transceivers 23 around the base 2, a single infra-red transceiver 23 may be mounted facing upward from the toy, able to reflect infra-red transmissions off the ceiling down to other toys and to receive transmissions reflected off the ceiling by those other toys. Yet further embodiments may solve the problem by relying on a communications protocol in which a first toy that 'hears' the transmissions of a second and third toy, can repeat the transmissions of the second toy, if requested to do so by the third toy as a result of its missing those transmissions. Of course, any way known in the art for arranging, establishing and operating a communications network between mobile nodes may be used.

Also in the toy-base 2 is a selectable-transmission 9 operable to couple the said two prime-movers either to the said two wheels, or to one of a number of pairs of actuator output-shafts. One of these pairs is connected to a coupling 34 and to an actuator-drive-socket 35 mounted on the front rim of the toy-base 2. With these, the toy can be coupled/decoupled to another toy, or to a passive-accessory 33 such as a car or airplane, enabling the toy to 'enter' the accessory, 'drive' it, then leave it, for example. Similarly, the actuator-drive-socket 35 allows the toy to provide motive force to the accessories 33 to which it is coupled, for example to turn the propellers of an otherwise passive airplane accessory 33.

There is also a wheel-drive-socket 36 mounted on the front rim of the toy-base 2. This transmits the wheel rotations of the toy to the passive accessory 33 it is coupled to. For example, the horse shown in FIG. 2 engages with both drive-sockets 35 and 36. As the toy is moved and the wheels rotate, this motion is transmitted by the wheel-drive-socket 36 to the horse's legs to simulate a walking motion. If the actuator-drive-socket 35 is selected and driven, then the horse's head will move up and down in a rearing motion.

When a body is mounted on the toy-base 2, the remaining actuator output-shafts can engage with mechanisms in the body (as may be formed of cams, gears, levers, belts, linkages, etc.) able to move the appendages associated with that body-type. By way of example, on a humanoid body, the mechanisms may drive movable appendages such as the arms, head, or facial features (eyes and mouth). The mechanisms may also drive couplings or drive-sockets mounted on the body. For example, the body's hands may contain couplings designed to allow the toy to pick-up and put-down passive objects, such as a treasure-chest.

In some embodiments, mechanisms in the body may be linked to the rotation of the wheels when the body is mounted on the base 2. For example the legs may be driven so that they appear to 'walk' as the wheels turn.

In a similar way, indicators 12 incorporated in the body may be electrically coupled to, and controlled by, the processing-means 3 and control-means 11, when the body is attached to the toy-base 2.

The selectable-transmission 9 is powered by a transmission-prime-mover 42 (to distinguish it from the prime-movers 48, 49 used to drive the wheels) and may be constructed in any way known in the art. By way of example, one possible such implementation is now described with reference to FIGS. 3(*a*) and 3(*b*), which shows a schematic of the transmission from the left side (FIG. 3(*a*)—view A-A, as per section lines in FIG. 3(*b*)) and the front (FIG. 3(*b*) view B-B, as per section lines in FIG. 3(*a*)). Note this is a schematic intended only to show how the gears couple together and power is transferred. It is not to scale and key details such as the gear teeth, axle supports, bosses, etc. have been omitted.

A selector-wheel 40 is driven (in either direction) by a worm-gear 41 (selector-worm) on the output shaft of the transmission-prime-mover 42. An idler-gear 43 is free to rotate on an axle mounted on the selector-wheel 40. The idler-gear 43 is permanently engaged with a drive-gear 44 attached to a shaft 45 attached to another drive-gear 46, which is driven by a worm-gear 47 (the drive-worm) on the output shaft of one of the said two prime-movers 48 or 49. The idler-gear 43 can be moved by rotation of the selector-wheel 40 so the idler-gear 43 engages with (selects) one of a number of output-gears 50, which can then be driven by the said prime-mover 48 or 49. These different positions of the idler-gear 43 are shown by the solid outline 43 and the broken outlines 43*a* and 43*b*.

The output-gears 50 each drive a worm-gear 51 (actuator-worm), which engages the gear 52 on the base of an actuator output-shaft 53, 54 and 55, each of which forms one-half of an output-shaft pair 53, 54 and 55. The whole arrangement (excluding the selector-wheel 40, selector-worm 41, and transmission-prime-mover 42, which are common to both halves) is mirrored on the other side of the selector-wheel 40, as shown in FIG. 3(*b*), to selectively couple the other prime-mover 48 or 49 to the other wheel, or to the other half of each output-shaft pair 53, 54 and 55.

A small gear 56 can slide in and out of engagement with the drive-worm 47. This gear is arranged to slide axially on one of the wheel-shafts 57 and it is rotationally coupled to the wheel-shaft 57 such that as the gear 56 is driven, the wheel-shaft 57 and wheel are also driven. The sliding of the gear 56 is driven by the transmission-prime-mover 42 (linkage not shown) so that the wheels are disengaged whenever any of the actuator output-shaft pairs 53, 54 or 55 are selected. Alternatively one of the output-gears 50 from the selectable-transmission 9 may be coupled to the wheels (not shown in the diagram). In this arrangement the wheels are selected just like any other actuator 10.

Selection-indicator-holes in the periphery of the selector-wheel are positioned to allow light from a light-source (e.g. an LED) to strike a light-sensor (e.g. a photo-transistor), whenever the idler-gear 43 is engaged with one of the output-gears 50 (none of these selection indicator components are shown in FIG. 3(*a*) or (*b*)). By varying the size of the selection-indicator-hole for each such position, the processing-means 3 can determine when and which output-gear 50 is selected, by reference to the output level of the sensor. Alternatively, to avoid the cost of an ADC, additional smaller holes may be provided on both sides of the (now constant diameter) selection-indicator-holes, such that the number or pattern of the groups encodes the identity of the selection-indicator-hole that they surround.

The processing-means 3 may determine when an actuator 10 has been returned to its home position in a similar means or by any other manner known in the art. For example, an indent on the rim of an indicator wheel (not shown) may be mounted on the actuator output-shafts 53, 54 or 55. This can be used to engage a micro-switch (not shown) when the actuator output-shafts 53, 54 or 55 are in their home-position. To save costs, the same micro-switch may be used for all the actuator output-shafts' 53, 54 or 55 indicator wheels, so that the toy would reset each actuator 10 sequentially.

Also within the toy-base 2 an audio-means 13 is able, in conjunction with the processing-means 3: to generate synthesised-speech using data stored in the memory-means 15; to record and either playback, or modify and regenerate, speech captured during an activity-recording; and to recognise the spoken commands "Ok", "Yes", "No", "Play", "Home" and "Select" (for example) when captured by the microphone. These spoken commands form part of the toy's control-means 11.

When pushing the toy in Passive-Mode, the user's hand is intended to rest at the rear of the toy, which may be shaped for this purpose. Switches 24, 25, 26, 27, 28 and 29 are arranged to be in easy reach of this position and are coupled to the processing-means 3 to provide the rest of the control-means 11 for the user to operate the toy. For example, buttons 25 select which pair of actuators 10 (e.g. left/right leg actuators, or left/right arm actuators, or head pitch/yaw actuators, etc.) are coupled to the said two prime-movers 48 and 49, by the selectable-transmission 9. Two actuator-toggles 24 (e.g. thumb-wheels, rocker-switches, sliders, etc.) can then be used to switch each of the two prime-movers to one of three states: off, forwards, or backwards. The user is thus able to control the selection and movement of the appendages with these switches 24 and 25.

Other switches include Record 26, Play/Yes 27, Stop/No 28, and Menu/Help 29 buttons. These are used to initiate the toy's two principles modes of operation: Recording (i.e. Passive-Mode's recording sub-mode described earlier), and Playback (i.e. Active-Mode). When neither mode is selected the toy is in Idle mode (also Passive-Mode, but not recording). In Idle and Recording modes the wheels are decoupled from the prime-movers 48 and 49, allowing the toy to be freely pushed about the surface 1 and any actuator to be selected and activated. In PlayBack mode, the wheels and/or actuators are selected by the processing-means 3, according to the requirements of the play-sequence being replayed.

Operation of the toy is now described with reference to the flow-chart in FIG. 4, which provides a high-level overview of the toy's operation (with some details omitted, as will be made clear). On power-on, the toy is initialised in step 65 and then step 66 tests to see if this is the first time it has been operated. If it is, the toy's speech-synthesis capability is used to verbally invite the user to record a replacement for its default name of "Actor". The user can do this by holding down the Record button 26, saying the name, and releasing the button. The toy will then ask the user if they wish to set its internal clock/calendar, which they can do by using the actuator-toggles 24 to adjust the setting. The toy may then provide the user with verbal instruction on its features and invite the user to try out the same, in an interactive tutorial.

Once this has finished, or been aborted by the user pressing the Stop button 28, the toy detects in step 67 whether it is on the surface 1. If not, it will use its speech-synthesis means to ask the user to move it to the surface 1. If the toy is on the surface 1, step 68 calibrates its sensors (if required) and establishes its position on the surface 1, by rotating so as to move its sensing-points 4 over the surface 1 codes until enough have been read to determine the position. While doing this the toy will use its communications-means 14 to check if any other Actors are on the surface 1. If they are, it will establish a communications network with those toys. The toy is then ready for use and enters the Idle mode in step 69, which waits until one of the buttons 24-29 inclusive is pressed.

If the Record button 26 is pressed then step 70 communicates this fact to any other Actors on the surface 1 and agrees a unique sequence-identity code for the new recording with the other toys. It then checks if the toy already has a current play-sequence. If it has and the current play-sequence is unnamed, the toy asks the user if they wish to save the sequence by naming it, with a warning that if they don't the sequence will be discarded.

If they say "Ok", "Yes" or press the Yes button, they will be able to record a verbal name for the play-sequence by again holding down the Record button 26 while doing so. If there are other active toys on the surface 1 containing unnamed current play-sequences with the same sequence-identity code as this toy's sequence, then it will ask the user if the name given should also be used to save the other toys' play-sequences. If the user says "No" or presses No then the current play-sequence held by the other Actors is discarded, otherwise it is saved. In either event, the current play-sequence is then cleared in all the Actors. If other active toys have other unnamed play-sequences with a different sequence-identity code, they will separately signal these need to be saved or discarded by the user.

The actuators 10 of each toy are then returned to their home-position. The new sequence-identity code is then saved with the starting-orientation and starting-position of each toy, in a new activity-recording in its memory-means 15. All toys then enter the Passive-Mode recording sub-mode in step 73 (thereby providing a convenient way for all Actors to start recording at the same time). From then on, the path of the toy as it is pushed by the user is recorded in the new activity-recording until such time as any toy's Stop button 28 is pressed or the memory-means 15 of any toy is full.

Any data structure may be used to record the two paths (traced by each sensing-point 4) in the memory-means 15, which is suitable to record the various positions along each path and the time they were reached. For example, the data-structure for each path may be divided into sequential elements, each representing sequential time-segments (e.g. ¼ second) along the path. The change in the x- and y-coordinate position of the sensing-points 4, during a time-segment, is saved in its corresponding element. In this way the position, orientation and speed of the toy as it moves along its path is captured.

Clearly, if the toy moves one way and then back the same amount within a time-segment, then the change in the x- and y-coordinate positions in that time-segment will be zero. This loss of detail is considered a fair trade for the saving in memory space this approach offers. Other embodiments may require a different balance and use a different method of creating the data-structure, as are known in the art. For example, some embodiments may save only a single path containing coordinates referenced to some point on the toy (e.g. its rotational centre) and orientation data.

During recording, the user may select and actuate different appendages on the toy, as previously described. The type and length of each actuation (or a link to data containing the same) is then saved in step 74 in the path data-structures, at the point in the path the actuation started.

Similarly if the user presses the Record key 26 during a recording, the speech-recording means will record whatever the user says into the microphone in step 75, for as long as the Record key is held down or until memory is exhausted. This speech data (or a link to the data) is saved in the path data-structures at the point speech-recording started.

Thus the user can easily record where the toy should go, what it should do, and what it should say, simply by showing it. Once the activity-recording is complete, a processing-stage is entered in step 72 whereby each sensing-point's 4 path and activity recordings are combined into one play-sequence. This is achieved by concatenating (while preserving the time-sequence) those segments of each path where the sensing-point 4 for the path was the 'lead' sensing-point 4 for the duration of the segment ('lead' being the sensing-point 4 positioned in front in relation to the direction of movement of the toy at the time). A marker is inserted at the beginning of each said segment to indicate which sensing-point 4 the following segment references.

This approach prevents instability occurring in the play-back of the path, which could be caused if the path was referenced to a sensing-point 4 positioned behind the axle of the wheels from the direction in which it is moving (i.e. at the 'rear'). This instability may cause the toy to 'flip-around' 180 degrees about its vertical axis, as it tries to follow the path of its 'rear' sensing-point 4. This happens for much the same reasons that a pencil pushed by its point from the rear may flip-around as it is pushed across a surface 1. If instead the toy is 'pulled' by a path referenced to its 'lead' sensing-point 4 (for the particular direction it is moving in), then the path playback will always be stable without need for path-correction algorithms. This is not to say that such a toy cannot have just one sensing-point 4. It would operate perfectly well (with savings on sensor costs and processing) as long as it is moving forward, but may flip-around if moving backwards for any appreciable distance.

After the activity-recording is completed, the toy re-enters Idle mode in step 69 with the newly created play-sequence selected as the current-sequence. Pressing Record 26 again within a predetermined time will give the user the option of appending a new activity-recording (and thence play-sequence) to the current play-sequence, or of saving the sequence and recording a new one (not shown in FIG. 4).

Alternatively, the current play-sequence may be instantly replayed simply by the user pressing the Play button 27 or saying the "Play" command. Step 71 communicates this to any other Actors on the surface 1 who have a play-sequence with the same sequence-identity code. This will cause each such Actor to move directly to the starting position and orientation for the play-sequence (if not already there) and reset their actuators 10 to the home-position. Once all Actors are in place, each simultaneously starts executing their respective versions of the play-sequence.

Figure 4:
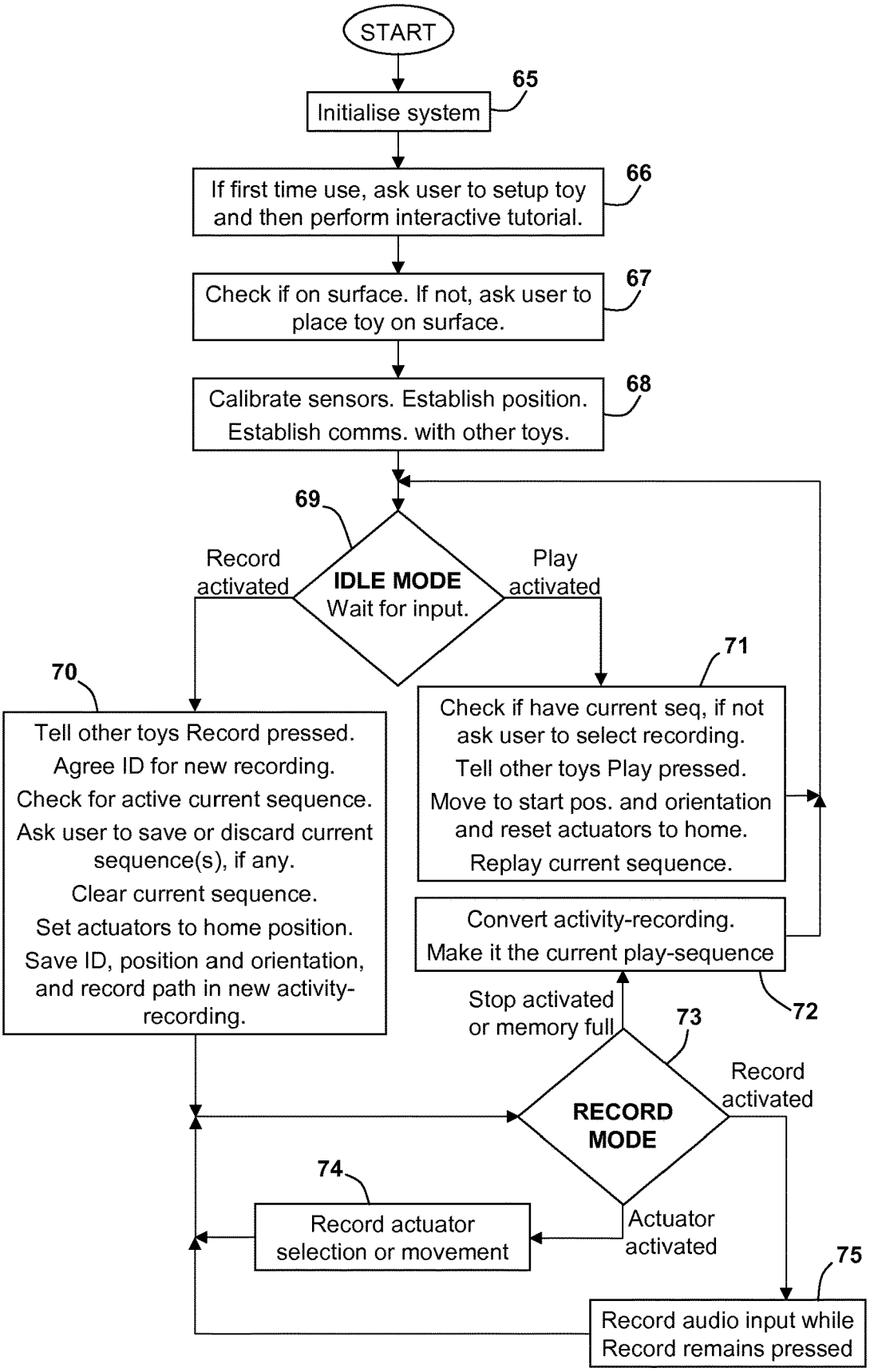
FIG. 4 is a flowchart providing an overview of the operation of some aspects of the Celebrity application (not all functionality is illustrated).

To save time on play-back, all Actors may be returned to their starting-positions and their actuators reset by saying the "Home" command (not shown in FIG. 4).

If the Play button 27 is held for more than a predetermined period (e.g. 2 seconds) then all Actors will replay their play-sequences at twice normal speed (including actuations, indications and speech. Not shown in FIG. 4).

Play-sequences other than the current sequence can be replayed simply by saying the Actor's name followed by the name given by the user to the play-sequence (not shown in FIG. 4). Thus if the play-sequence was named "Dance" and the Actor was named "Bob", then "Bob Dance" will cause just that toy to first move to the starting position and orientation for the play-sequence (if not already there) and then to execute the play-sequence. If the toy's name is omitted from the command, then all such toys that are on the surface 1 and have a play-sequence called "Dance" will go to their home-positions and, when all are there, simultaneously start execution of the play-sequence. In this way, initiating replay of a play-sequence is easily synchronised between toys.

While in Idle mode (step 69) it may be arranged for an Actor to take avoiding action, if another Actor is on a collision course with it (not shown in FIG. 4). Thus any Actors not involved in the current performance will ensure they do not block that performance. This also allows the user to push an Actor in pursuit of other Actors, in an impromptu game of catch!

In Idle mode the user may access the toy's audio-menu system by pressing its Menu button 29 (not shown in FIG.

4). The user can cycle through the spoken options on the menu and sub-menus, simply by pressing either of the actuator-toggles 24 up or down. Menu options are selected, or sub-menus accessed, by saying "Ok", "Yes", "Select" or by pressing the Play/Yes button 27. Sub-menus and the menu system itself can be exited by pressing the Stop/No button 28 or saying "No". Using this capability, the user is able to name the current play-sequence, or select or play a new current play-sequence by name, or delete play-sequences, or append a new activity-recording (and thus play-sequence) to a play-sequence, or edit a play-sequence, or rename their Actor, or set the clock, or set alarms that replay play-sequences at certain times or in response to conditions (e.g. heat, light, sound, proximity, etc.) that may be sensed with their sensors, or link to a computer, or to access any other appropriate functionality that may be known in the art.

During the creation of an activity-recording (Passive-Mode), the user may (in some embodiments) move the actuators 10 at the same time as they are pushing the toy across the surface 1 (other embodiments may prevent this by, for example, deselecting the actuators 10 while the toy is moving). In playback (Active-Mode) it is not directly possible to move the toy at the same time as actuators 10 are moved, because the prime-movers are coupled by the selectable-transmission 9 either to the wheels or to the actuators 10. Coupling to both would result, undesirably, in the actuators 10 moving for as long as the wheels are turning.

However, the appearance of concurrent operation may be given, during playback, by calculating the impulse required to be applied by the prime-movers 48 or 49 to the wheels, just prior to their being disengaged from the wheels. This thrust is calculated to cause the toy to free-wheel to the approximate target, while the prime-movers 48 or 49 are then being used to drive the actuators 10. This approach may be further enhanced by using energy-storage devices, such as fly-wheels or coiled-springs to store the energy required to drive the wheels. These would then be coupled to power the wheels while the prime-movers 48 or 49 are driving the actuators 10.

In other embodiments the actuators 10 may have their own dedicated prime-movers, separate from the wheel's prime-movers 48 or 49. Thus they would be directly operable, without selection, allowing simultaneous operation of the wheels and actuators 10.

In other embodiments said software may provide voice and data communications over the Internet using, for example, adapted Voice-Over-IP (VoIP) protocols, as are well known in the art. This can allow geographically dispersed users to control each other's toys. Thus one user, by moving, or speaking into, or moving the actuators 10 of, their (master) toy, would cause the remote (slave) toy of the remote user to move, speak, or actuate, in a manner that copies the master toy. This approach is commonly known as tele-robotics or tele-presence. Obviously, if each user has only one toy then only one-way communication is possible and some means of swapping the master/slave relationship between toys would be required. If each user has at least two toys, then one toy can be master to the other user's slave and the second toy can act as slave to the other user's master—thereby enabling simultaneous, two-way communications and interactions.

Software may be provided with the toy that could allow the user to create or upload play-sequences, edit play-sequences, graphically simulate play-sequence playback on the computer, manage the play-sequences stored on their toy, and/or remotely control the toy from the computer, amongst other functions already known in the art (not shown in FIG. 4).

Additionally, the users may be able to up- and down-load play-sequences to/from a specialist web-site created for the toy or application. Said web-site may allow additional information to be up-/down-loaded such as images of the scenery sheets 32 that may be printed out by other users; or notes on the play-sequence, setting up the scenery 32 and 31, etc. In addition it may support discussion-forums for the users, or personal web-pages where users can offer their play-sequences and other information about themselves. It may include messaging functionality, so that play-sequences can be sent to particular remote users, or groups of users, as a message. While connected to the web-site, any messages directed at the user will be offered for download to their toy, where the message play-sequence can be replayed. It should be understood that the web-site may offer any messaging, social-networking, transactional, or other functionality as may be known in the art.

Users will be able to download any generally available play-sequences and then use the web-site to rate those play-sequences. The number of times a play-sequence is download and the value of the ratings it receives over a time-period, is used to determine the best play-sequences for that period. The user-names of the users, the user-given names of the Actors in their winning play-sequences, and the play-sequences themselves are then promoted on the web-site, as the "Best Directors", "Best Actors" and "Best Plays", respectively, for that week, month, or year. In this way users can pursue "Celebrity" status for their Actors, themselves and their work!

Competitive: Champions

Champions are a set of at least two toys, styled as swordsmen that act as warrior champions for their respective users. In an initial Training phase, the toys are trained how to attack and how to defend themselves by their users. In a subsequent Combat phase, they duel each other in a battle whose outcome depends on the speed and cunning of the moves they've learned.

Figure 5:
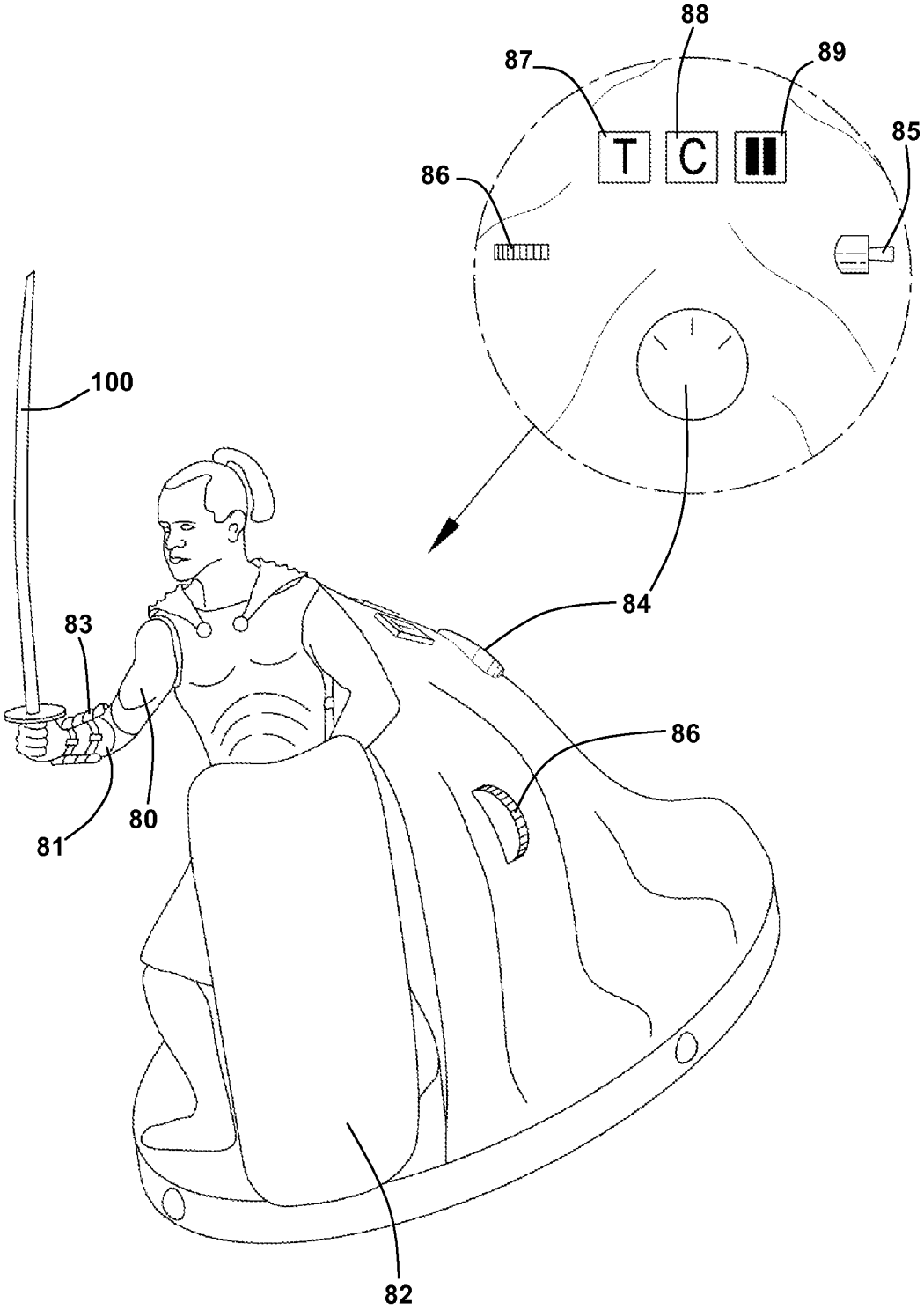
FIG. 5 is an illustration of one of the Champions toys (surface and other toy not shown).

As illustrated in FIG. 5, each toy-base 2 is arranged similarly to those already described in Celebrity: two-wheels with associated prime-movers provide drive and support augmented by a passive roller-ball; two sensing-points 4 are mounted fore and aft of the wheels; and infra-red transceivers provide communications. No selectable-transmission 9 is required other than a clutch to decouple the wheels from the prime-movers during the Training phase, if required for the free-movement of the toy. There are no couplings 34 or drive-sockets 35, 36, and the toy-body is permanently attached to the toy-base 2 (of course, other embodiments may allow any or all of these features, as will be clear).

A rotary-dial 84 (the "fury-dial") on the rear of the toy is coupled to a potentiometer, the output of which is digitised and provided to the processing-means 3. The fury-dial 84 lets the user set how aggressive or defensive the toy is, in a manner that will be described. Three buttons 87, 88 and 89 allow the user to initiate Training mode, Combat mode, or Pause/Stop either mode, respectively. A thumbwheel 86 allows the user to control the orientation of the sword-arm 80 and a toggle-switch allows the sword-arm forearm 81 to be toggled between two positions, as is now described. The arm 80 and forearm 81 are the only two movable appendages on the toy.

The diagram in FIG. 6(*b*) shows how the sword-arm 80 may be rotated about a pivot 102 in the shoulder, to one of the five orientations NW, N, NE, E, and SE shown. The shoulder is coupled to a prime-mover in the body or base 2 under the control of the processing-means 3 and the thumb-wheel 86. The sword-arm's forearm 81 is divided from the sword-arm 80 along the line 103. A pivot 101 in the elbow that is perpendicular to the line 103, allows the forearm 81 (and thus the sword 100) to swing in the plane of the sword 100 between one of two positions: an up, or parry, position P and a down, or strike position, S, as shown in FIG. 6(*a*). The movement of the forearm 81 is achieved via a crank that couples the forearm 81, through a coupling that passes through the pivot 102 in the shoulder (thereby allowing it to move independently of the shoulder), to another prime-mover in the body or base 2, which is under the control of the processing-means 3 and the toggle-switch 85.

The sword 100 may be fixed to the hand by a sprung pivot (not shown) to allow it to be deflected from its nominal position, if for instance it is impeded during a strike. The combined orientation (NW, N, NE, E, or SE) and position of the sword 100 (P or S) will be referred to as the sword-state and will be expressed in the form orientation/position e.g. NE/P to denote a sword in the north-east (NE) orientation and parry position (P). In addition, armour 83 is provided on the sword-forearm 81 (not shown in FIG. 6(*a*) or (*b*) for clarity) and in the form of a shield 82 on the left of the swordsman (on the opposite side to the sword-arm 80).

A toy may attack another toy by striking it (i.e. swinging its sword 100 from P to S) or, if its sword 100 is already in the strike position S, either by charging the other toy (a lunge), or by rotating to bring its sword 100 around in an arc (a slice). For convenience all these are referred to collectively as strikes.

It can be seen that a sword 100 in the parry position P will be more effective in blocking strikes from another toy that are perpendicular to it, than strikes that are parallel to it. For example, parries in the N/P (north orientation, parry position) sword-state are an effective counter to strikes from the E sword-orientation and, to a lesser degree, the NE sword-orientation (and vice-versa). However, they are a poor counter to strikes from the N and NW sword-orientations. Similarly, strikes or lunges against either the shield 82 or the forearm armour 83 are less effective than those on unprotected parts of the opponent.

Training Phase

Training is initiated by pressing the Training button 87 on one toy (the trainee 110), which communicates that fact to the other toy (the trainer 111). The trainer 111 then runs an Active-Mode, autonomous Sparring program (described later). The trainee 110, operating in Passive-Mode, is pushed around and its sword-arm 80 and forearm 81 are controlled, by the user, in response to the actions of the trainer 111.

The Sparring program first enters an attack-mode, causing the trainer 111 to attack the trainee 110 in a number of different ways and from a number of different quarters. It then enters a defence-mode and invites the user, using the trainee 110, to attack it in a number of different ways. The initial position and status, and the subsequent moves and actions, of both toys are captured as activity-recordings during this process.

During or after the Training phase, the activity-recordings are analysed to determine how the trainee 110 moved and acted in response to the moves and actions (the context) of the trainer 111. The responses captured in the trainee's 110 activity-recording are stored as play-sequences in map-entries in attack-maps and defence-maps for the trainee 110, which are stored as lookup-tables in the memory-means 15. The index into the lookup table for a particular map-entry is a composite index formed of data from the trainer's 111 activity-recording, which describes the context of the trainer 111 that caused the particular response.

In the current embodiment, up to three play-sequences (differentiated by a sequence ID) can be stored per map-entry/context-data index (other embodiments may allow more or less), thereby providing a choice of responses to the same opponent context. The context-data used to form the composite map indices are: the zone-position and orientation of the trainer 111 relative to the trainee 110; the orientation of the trainer's 111 sword: NW, N, NE, E, or SE; and the sword's position: strike S or parry P.

Figure 7:
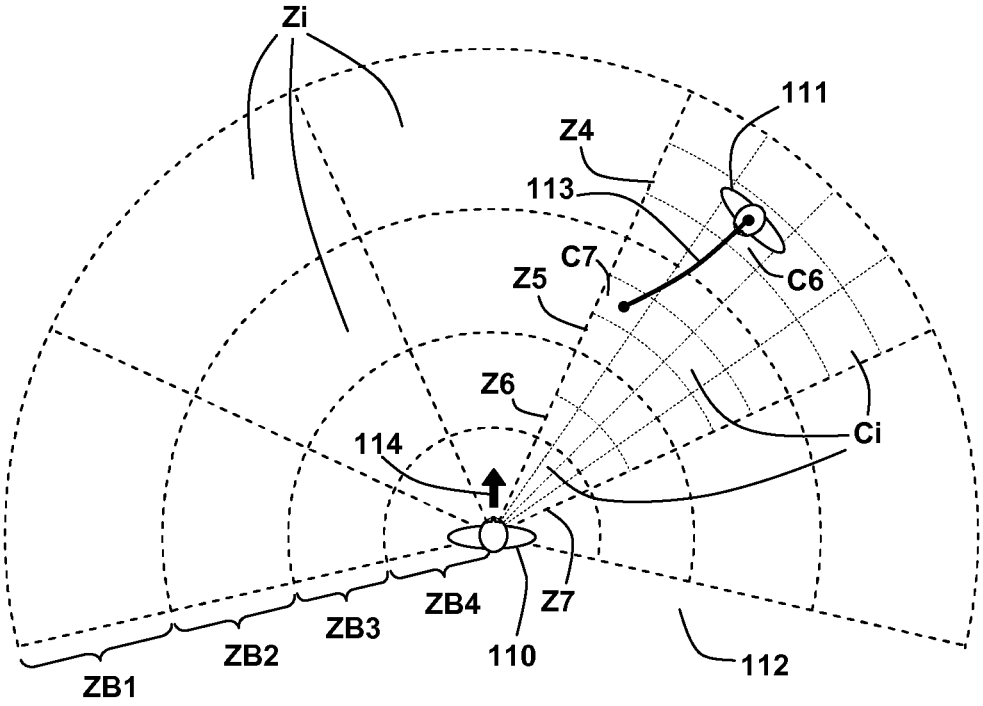
FIG. 7 is a diagram showing the zone-grid 112 of a trainee 110 Champion.

The zone-position of the trainer 111 relative to the trainee 110 is defined using a virtual zone-grid 112, as shown in FIG. 7. This zone-grid 112 is always centred and oriented on the trainee 110 and so moves as the trainee 110 moves. The zone-grid 112 is not expected to extend across the whole surface 1. Instead, it divides the area to the trainee's 110 immediate front (indicated by the arrow 114) and sides into numbered zones Zi.

These zones Zi are further divided into cells Ci, as shown (by way of example), for zones Z4, Z5, Z6, and Z7. Movement of the trainer 111 relative to the trainee 110 can thus be expressed as movements from a cell Ci in a zone Zi (referred to as its zone/cell position), to a cell Ci in another or the same zone Zi. By way of example, the thick line 113 in the diagram illustrates the path of the trainer 111 from zone/cell position Z4/C6 to zone/cell position Z5/C7.

Figure 8:
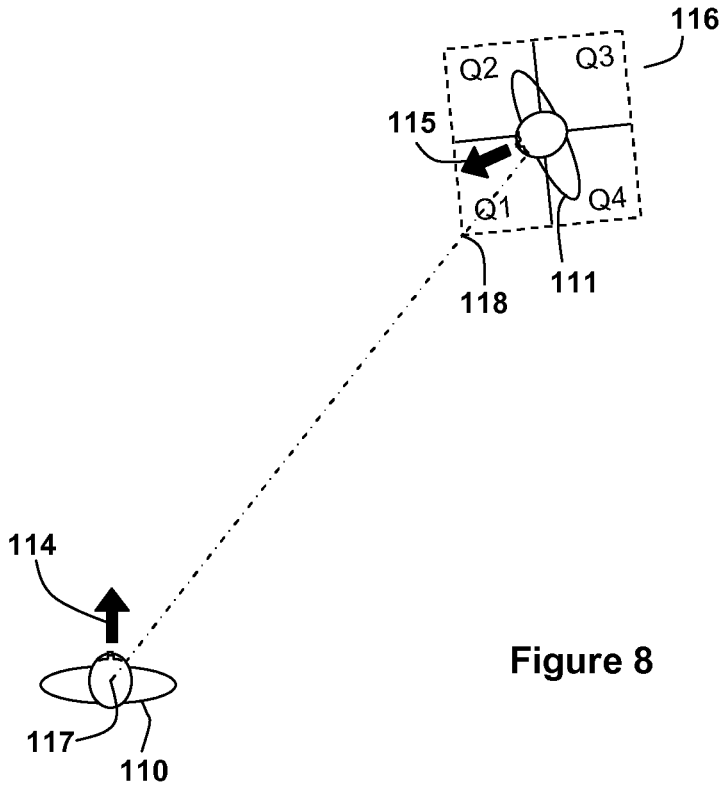
FIG. 8 is a diagram showing the orientation-grid 116 of the trainer 111.

FIG. 8 shows how the relative orientation of the trainer 111 is provided by an imaginary orientation-grid 116, divided into quadrants Q1, Q2, Q3, and Q4, which is centred on the trainer 111 and aligned so the outer corner 118 of the Q1 quadrant points towards the rotational-centre 117 of the trainee 110. The number of the quadrant Qi that the trainer 111 is facing towards (indicated by the arrow 115), provides the orientation of the trainer 111 relative to the trainee 110. In this example the orientation is Q1.

The play-sequences, stored under each context-data index, consist of a list of elements that always begins with a unique ID (the SeqID) followed by a code indicating the initial sword-state of the trainee 110 for that sequence. These will then be followed by movement-actions and/or sword-actions. A movement-action consists of the zone/cell position that the trainer 111 moved to from its current position, plus the transit-time it took for the trainer 111 to move to that position. Sword-actions consist of a code indicating the new sword-state.

Note that because the zone/cell position is relative to the trainee 110, when this document talks about the trainer 111 moving to a particular zone/cell, it should be understood that this may be a result of both the trainer's 111 and the trainee's 110 movements.

Purely for the purposes of explanation, it is helpful to think of the attack- and defence-map lookup tables as 'looking-like' the trainee's 110 zone-grid 112. Imagine that in each zone Zi there are stored responses for each permutation of the orientation and sword-state (the disposition) of the opponent (the trainer 111) when it is in that particular zone Zi. In the Training phase, these stored responses are captured by breaking the responses of the trainee 110 into segments and storing the segments according to their starting zone and disposition. In the Combat phase, play-sequences are selected from the zone the opponent is in, according to the opponent's disposition in that zone.

Figure 9A:
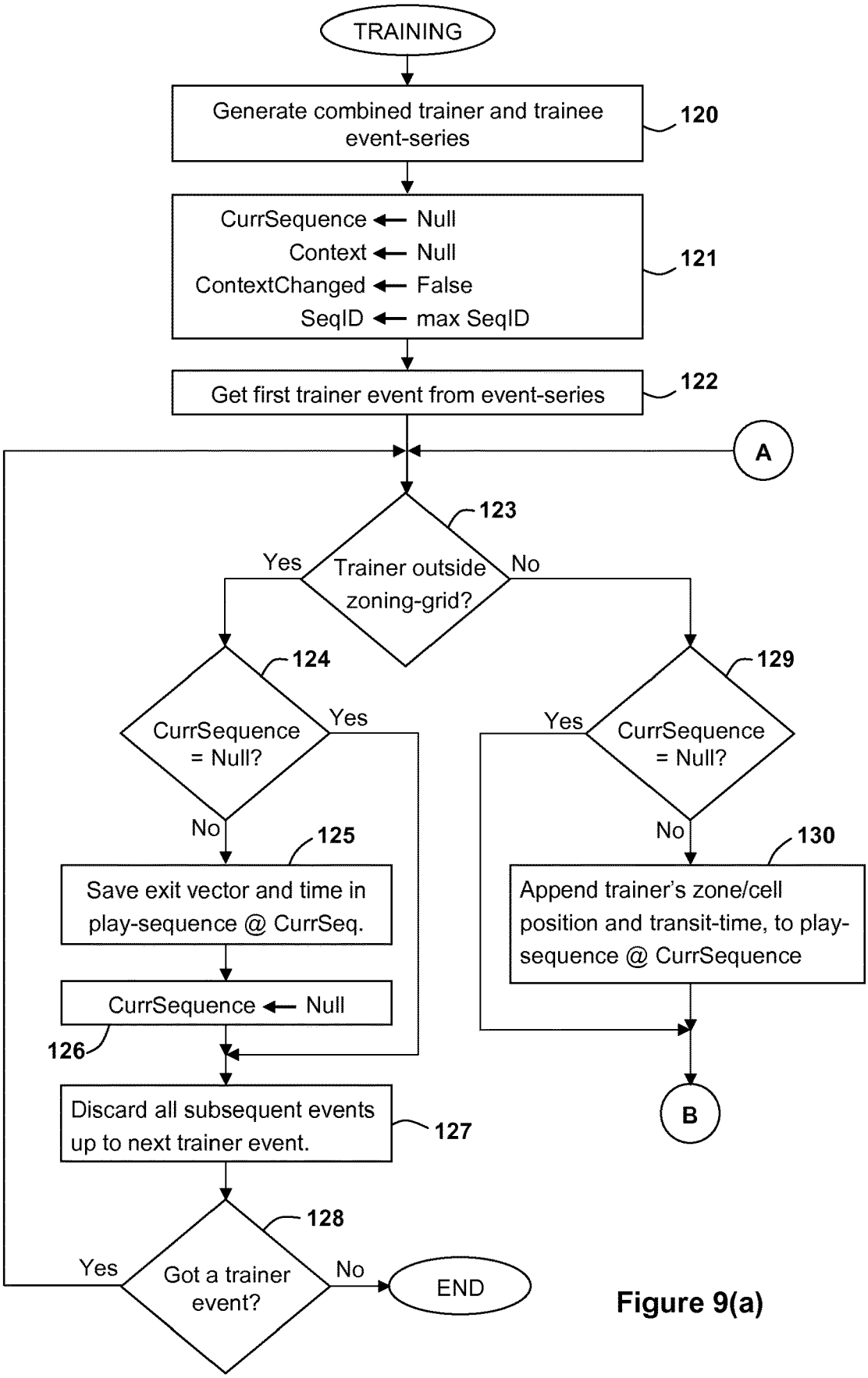
FIGS. 9(*a*), (*b*) and (*c*) are flowcharts illustrating the operation of the Training phase program for the Champions application. The flowcharts are connected by the lettered connectors shown in circles on the flowcharts.
Figure 9B:
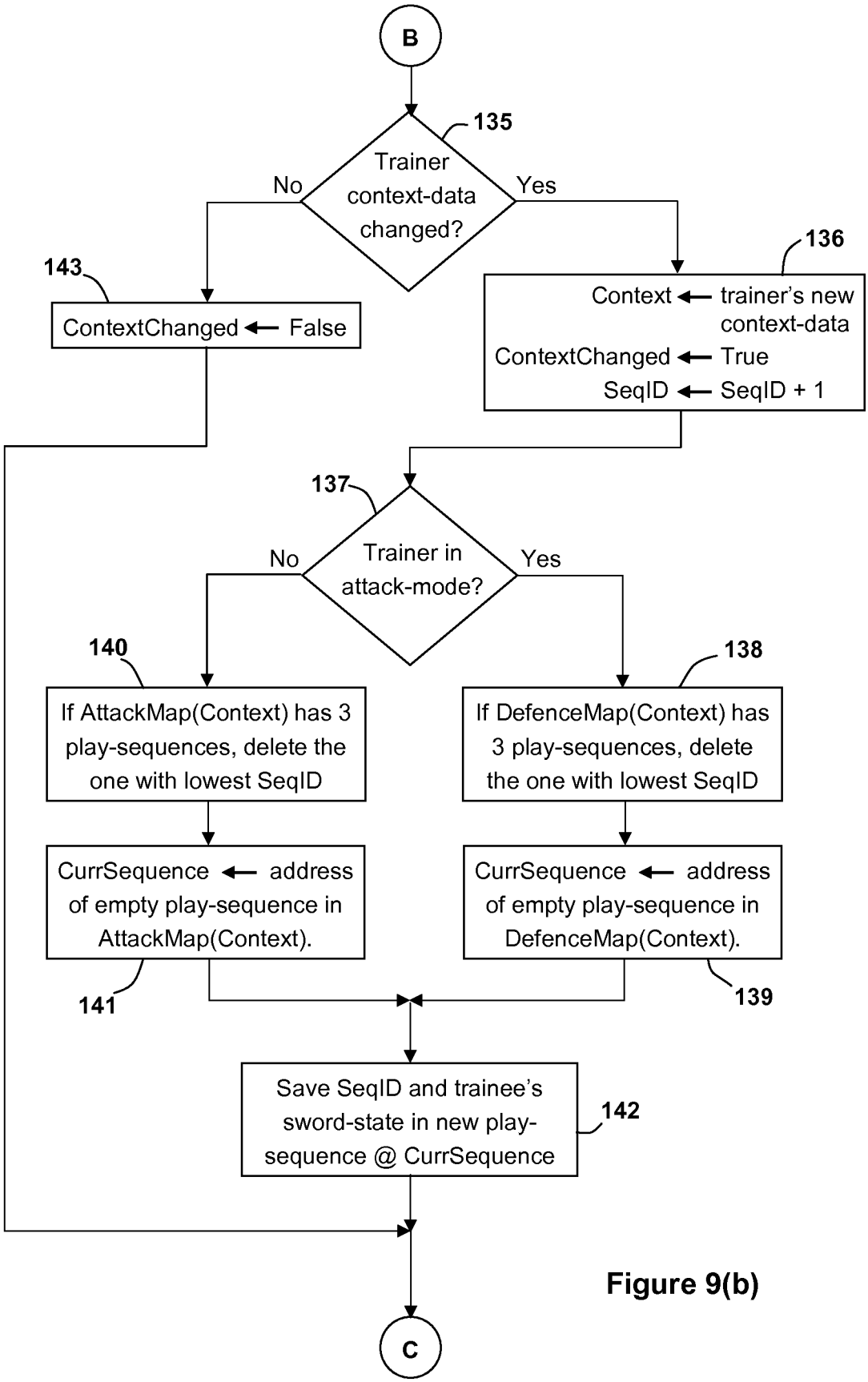
Figure 9C:
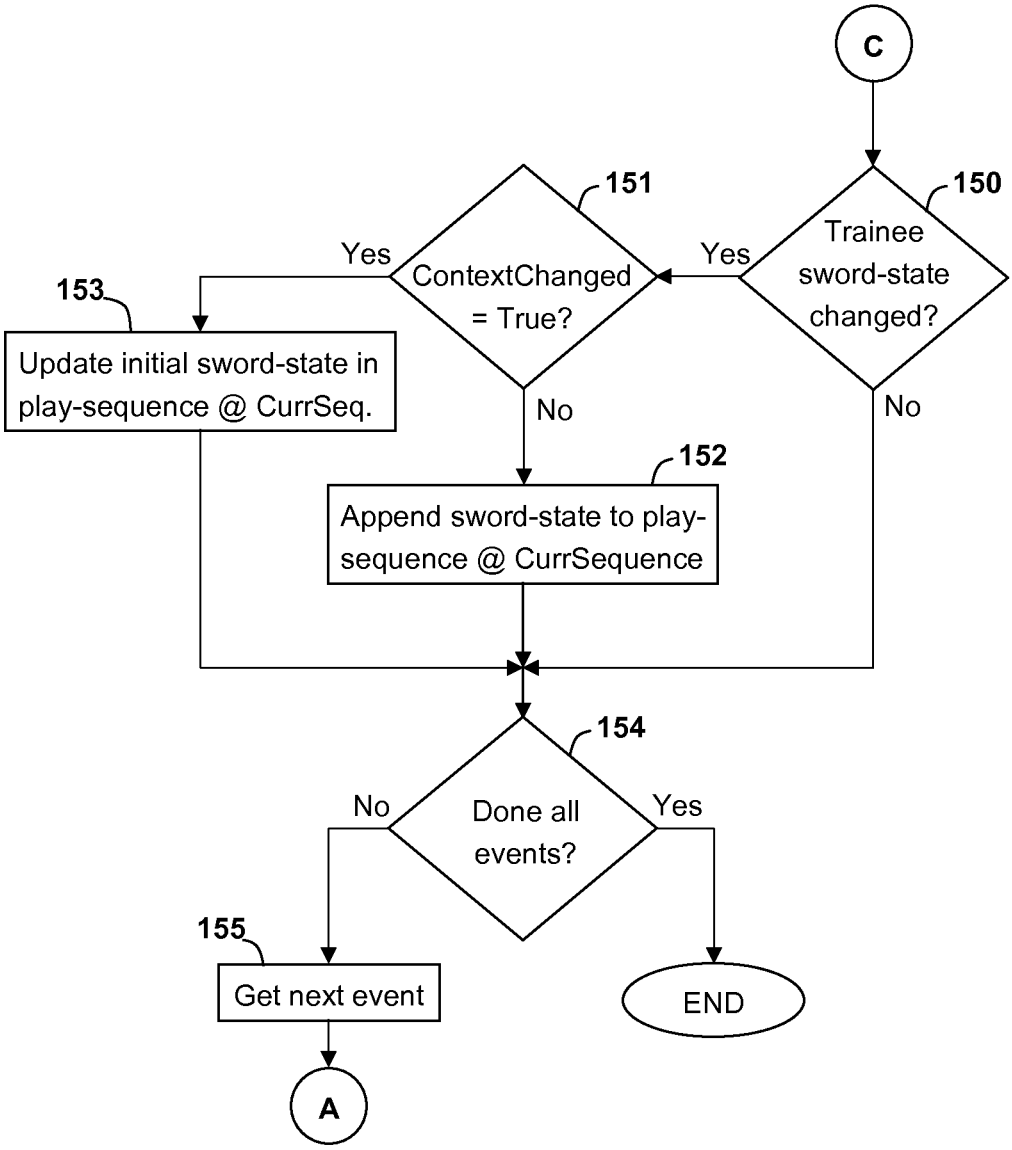
Figure 10A:
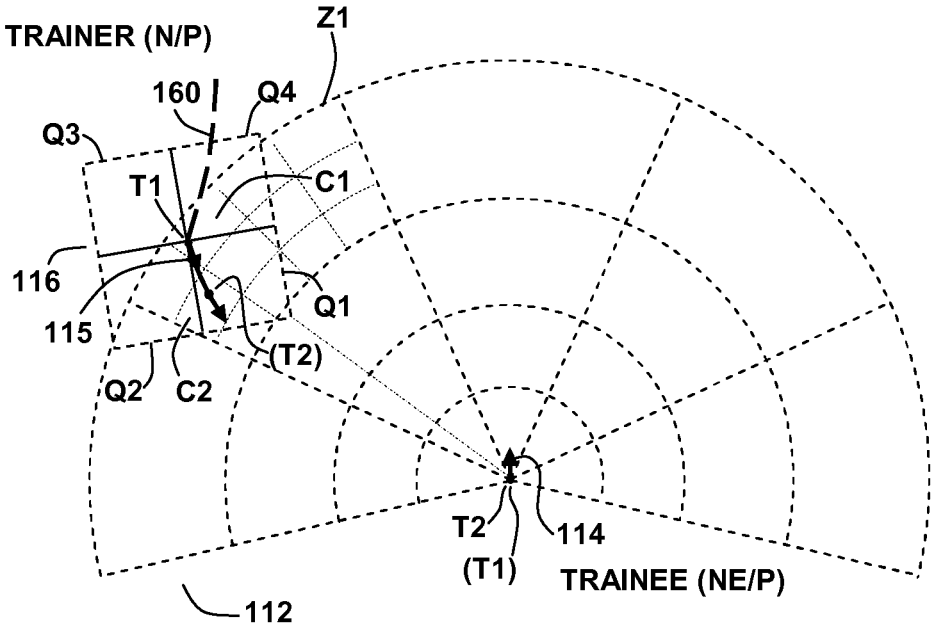
FIGS. 10(*a*), (*b*), (c) and (d) provide an example of the trainee's 110 and trainer's 111 evolving paths and actions as might be captured during some part of the Champions application's Training phase and then converted into an event-series.
Figure 10B:
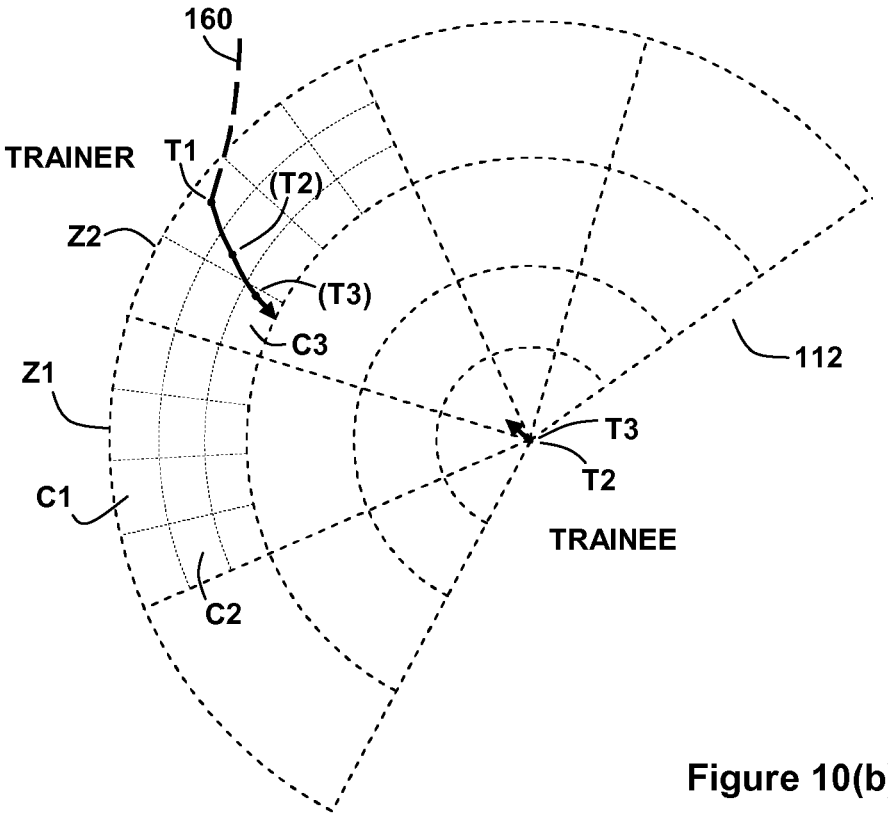
Figure 10C:
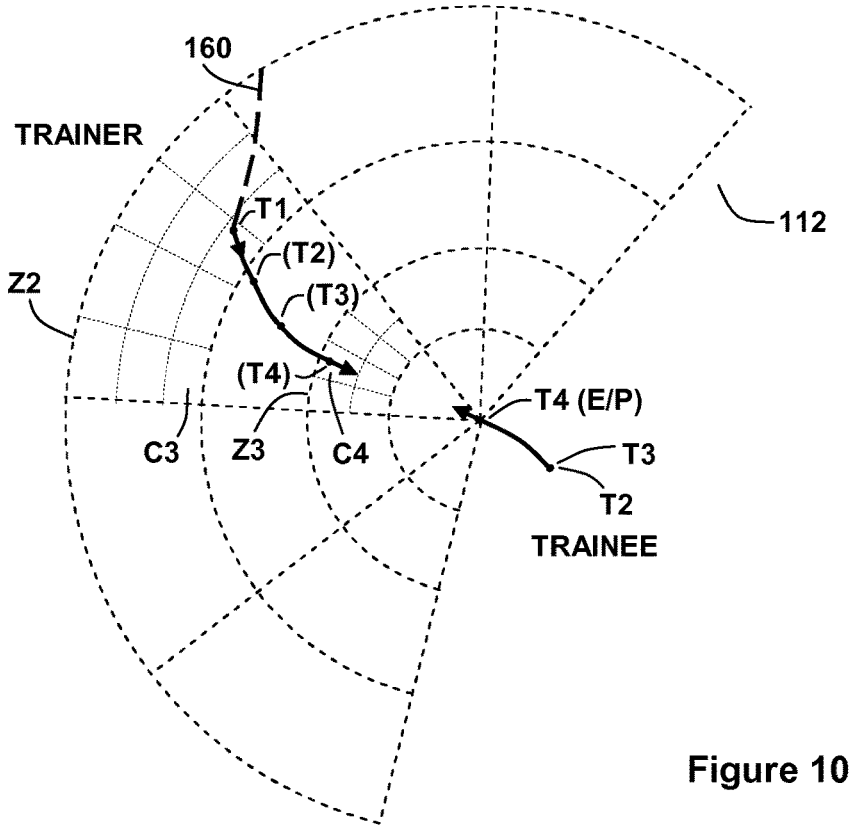
Figure 10D:
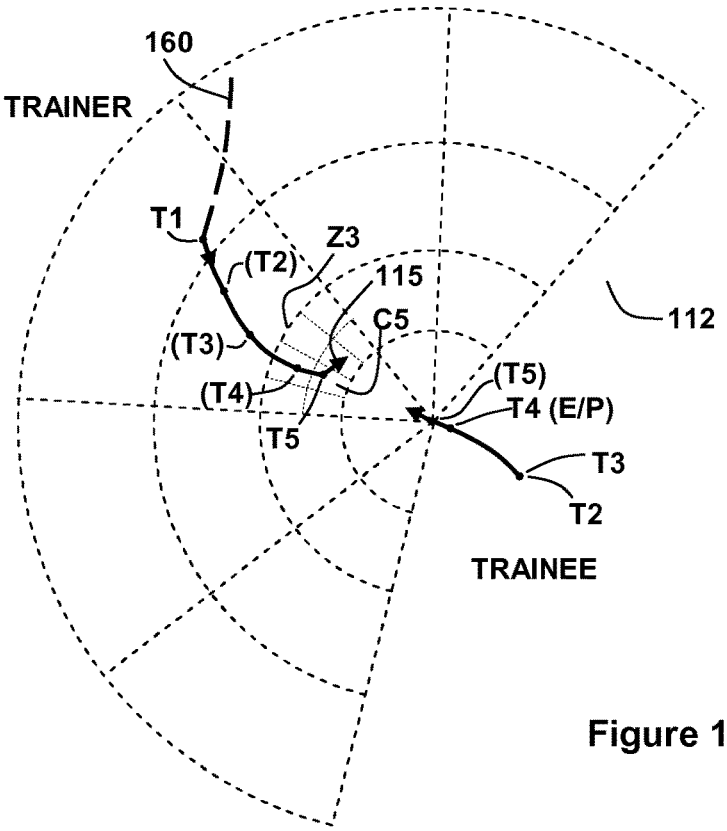

Referring now to FIG. 9(*a*), the flow-chart shows how the activity-recordings of the trainer 111 and trainee 110 are analysed, during or after the Training phase, to produce the play-sequences and composite index for the trainee's 110 attack- and defence-maps.

Note that in the flow-charts, statements of the form: name←expression, indicates the variable or constant name is loaded with the value of the expression that follows the arrow.

Also, a variable or constant name followed by brackets indicates the variable or constant is an array (i.e. a list) of variable or constant values. A particular value in the array is specified by an index number (or variable) included between the brackets—the first item in the array has an index number of 0, the second an index number of 1, and so on. Thus an expression of the form ArrayName(IndexVar) refers to the element in the ArrayName array whose index is given by the value in the variable IndexVar.

The first step 120 deconstructs the trainee 110 and trainer's 111 activity-recordings into a combined list of events (an "event-series") for both toys. The event-series contains the disposition of the trainee 110 or trainer 111 at the time of each event in the series. Events are points in either toy's activity-recording at which there was some perceived change in the actions of the trainee 110 or trainer 111. A list of the trainer's 111 events is generated as a by-product of the Sparring program and includes: changes in the trainer's 111 sword-state, changes in the trainer's 111 rough speed (stopped, slow, medium, fast), and significant changes in the trainer's 111 path direction, or in its orientation relative to the trainee 110.

The trainer-events are combined in chronological order with the trainee-events. These latter are derived by breaking the trainee's 110 path into segments of approximately similar, or similarly changing curvature, which represent approximately constant toy speeds. The approximations are chosen to yield sufficiently granular detail on path changes, while avoiding an excess of segments. The junctions between the segments represent those points where the path-curvature, orientation or speed of the trainee 110 changed significantly. The trainee-events consist of these junctions and the points where the trainee's 110 sword-state changes.

Step 121 initialises variables for the loop that follows. CurrSequence is a pointer to the data-store containing the play-sequence that is currently being created. Context is a composite data-store used to hold the index formed from the trainer's 111 context-data at a particular time. Both are initialised to a Null value. ContextChanged is a Boolean flag indicating if Context has been changed; it is initialised with a False value.

SeqID is a numeric ID that is incremented and stored with each new play-sequence that is created. It is initialised to the current maximum SeqID in the maps and will be incremented with the first event. Because SeqID is continually incremented as new play-sequences are added to the map, it may be necessary to occasionally rebase SeqID (while maintaining its sequence order) in order to avoid overflow in the SeqID variable.

Step 122 gets the first trainer-event in the combined event-series (any preceding trainee-events are discarded, as they cannot be a response to an action of the trainer 111). The next step is the first step in a loop that examines each trainer-event and trainee-event in the combined event series, starting with the first trainer-event. By the time the loop completes, all the events will have been analysed and the attack- and defence-maps will have been partially or wholly populated with play-sequences for a variety of opponent (trainer 111) contexts.

By way of explanation, FIG. 10(*a*)-(*d*) illustrates the evolution of a portion of the trainee's 110 and trainer's 111 activity-recordings, captured during some part of the Training phase, when the trainer 111 is in attack-mode. The thick dashed line 160 indicates the previous path of the trainer 111 up to a point in time $t_1$ indicated by the dot T1 on the path illustrated by the thick unbroken line. At T1 the trainer 111 deviated significantly from its previous course, as indicated by the trainer's 111 direction arrow 115. So at $t_1$ the disposition of the trainer 111 at this point was captured in the event-series, as a trainer-event. Note that paths and positions are drawn referenced to the rotational centre of each toy.

The trainee 110, which is stationary at time $t_1$, is in the position indicated by the dot labelled (T1). It is facing in the direction of the arrow 114 and its sword 100 is in the NE/P position.

All events on the previous path 160 of the trainer 111, up to T1, that were outside the trainee's 110 zone-grid 112 will have been detected by step 123 testing positive and will have been discarded by step 127. CurrSequence will also have been set to Null by step 126. The discussion thus begins with the loop at step 123 and the first event is the trainer-event at T1.

At this point the context-data for the trainer 111 (stored in the event-series with the trainer-event) will be: its sword 100 is in the N/P position; it is oriented (as indicated by the arrow 115) facing into the Q1 quadrant relative to the trainee 110, as indicated by the superimposed orientation-grid 116 (for clarity, though this orientation-grid 116 is conceptually used at each trainer 111 position, it will not be shown for future event points in this and the following diagrams); and it is in zone Z1 in cell C1 in the trainee's 110 zone-grid 112 (for clarity, the cell-grids are only shown where required for the purpose of the description. All zones have a cell-grid, even if it is not explicitly shown). The trainer 111 is no longer outside the zone-grid 112 so test 123 fails and step 129 then tests CurrSequence. As it is currently Null, execution continues, via connector B, with step 135 in FIG. 9(*b*). This checks if the trainer's 111 context has changed with the current event. At least the zone Z1 has changed, as the trainer 111 was previously outside the zone-grid 112, so the changes are saved in Context, ContextChanged is set True, and SeqID is incremented in step 136.

Step 137 then tests what mode the trainer 111 is in. If the trainer 111 is in attack-mode, step 138 checks if there is any room for a new play-sequence in the trainee's 110 defence-map lookup-table entry that is indexed by the composite index in Context. If the map-entry already contains three play-sequences (the maximum for this embodiment) then the play-sequence with the lowest (oldest) SeqID is deleted. The CurrSequence pointer is then set (step 139) with the address of the data-store in the defence-map-entry, to use for the new play-sequence. If, in step 137, the trainer 111 is found to be in defence-mode then steps 140 and 141 do the same thing but for the trainee's 110 attack-map.

Step 142 initialises the new play-sequence, pointed to by CurrSequence, by saving in its first two elements the new SeqID and the trainee's 110 current sword-state (NE/P). The new play-sequence is now set up, ready for further sword-actions or movement-actions to be appended to it. Note that expressions of form @ pointername, as used herein, refer to the data-store whose address is stored in pointername.

Execution continues, via connector C, with step 150 (FIG. 9(*c*)), which tests if the trainee's 110 sword-state changed in the current event. It didn't so step 154 tests if all events in the event-series have been processed. They haven't, so the next event is obtained from the event-series in step 155 and control passes back to the head of the loop (step 123, FIG. 9(*a*)) via connector A.

The next (now current) event is a trainee-event that happened at time $t_2$, when the user began rotating the toy. The trainee 110, which until now has remained stationery, is at the point labelled T2 (FIG. 10(*a*)), which is the same point it was in at time $t_1$. At time $t_2$, the trainer 111 will have reached the point in its path indicated by the dot labelled (T2).

The trainer 111 is inside the trainee's 110 zone-grid 112, so control passes to step 129, which tests CurrSequence and finds it is not Null, as it is now pointing at the new play-sequence set up in the previous iteration of the loop (for the trainer 111 context at T1). So step 130 appends a movement-action to the new play-sequence pointed to by CurrSequence. This movement-action is defined by: the trainer's 111 new zone/cell position Z1/C2, at time $t_2$, along with the transit-time ($=t_2-t_1$) for the trainer 111 to move from its Z1/C1 position at T1 to its Z1/C2 position at (T2). Note that if the starting and ending zone/cell are the same, but $t_1<>t_2$, then a zero-length movement-action is still saved in order to preserve the transit-time for the trainer 111 to 'move' along that vector.

Control then passes via connector B to step 135 (FIG. 9(*b*)), which notes that the trainer 111 is in the same zone, Z1 (cell position is not used for context-data), and has the same orientation, Q1, relative to the trainee 110, as it had at time $t_1$, and its sword 100 position is unchanged, so its context-data is unchanged. As a result, the test in step 135 passes control to step 143, which sets ContextChanged=False and control passes to step 150 (FIG. 9(*c*)) via connector C.

The current trainee-event was not a sword-movement and there are more events to process, so the tests at steps 150 and 154 both fail. Step 155 gets the next event, and the loop iterates once more to step 123 in FIG. 9(*a*). The current event being processed is now the trainee-event at time $t_3$ when the user stopped rotating the trainee 110 and started moving it forward. This point is marked by the dot labelled T3 on the trainee's 110 path in FIG. 10(*b*), and the trainer's 111 position at this time is indicated by the dot labelled (T3) on the trainer's 111 path.

Step 123 fails because the trainer 111 is still in the zone-grid 112. Step 129 then detects CurrSequence is pointing at the play-sequence associated with the trainer's 111 context-data at time $t_1$ (i.e. CurrSequence is not Null). So step 130 appends to that play-sequence a new movement-action comprising: the new zone/cell position Z2/C3 of the trainer 111 at time $t_3$, along with the transit-time ($=t_3-t_2$) to get to the new position from its previous position Z1/C2.

Because the trainee 110 has been rotated, its zone-grid 112 has shifted around, causing the trainer 111 to 'move' from zone Z1 to zone Z2. This changes the trainer's 111 context-data, which is detected in step 135 (FIG. 9(*b*)), causing step 136 to update Context, set ContextChanged=True and increment SeqID.

Steps 137-139 inclusive detect that the trainer 111 is in attack-mode and set CurrSequence to point to a store for the new play-sequence within the entry in the trainee's 110 defence-map lookup-table, which is indexed by the new composite index in Context, as previously described. The new play-sequence is then initialised in step 142 with the new SeqID and the trainee's 110 sword-state NE/P.

Step 150, FIG. 9(*c*) then fails (no sword-state change) and, as there are more events (step 154), the next event at time $t_4$ is obtained in step 155 and the loop iterates again back to step 123 (FIG. 9(*a*)) via connector A. The new event at time $t_4$ is another trainee-event caused by the user moving the trainee's 110 sword-arm to the E sword-orientation, as indicated by the (E/P) sword-state designator following the T4 label in the diagram in FIG. 10(*c*). By this time the trainee 110 and trainer 111 have moved to the positions labelled T4 and (T4), respectively.

Step 123 fails again (trainer 111 is in the zone-grid 112), step 129 detects CurrSequence is set up and step 130 appends a new movement-action to the new play-sequence (associated with the trainer's 111 context at time $t_3$) pointed to by CurrSequence. This movement-action contains the trainer's 111 new zone/cell position (Z3/C4) and transit-time ($=t_4-t_3$).

The steps in FIG. 9(*b*) then note that the trainer's 111 zone (and thus its context-data) has changed to Z3, and so create a new play-sequence for the new context in the trainee's 110 defence-map, as previously described.

Control then passes to step 150 (FIG. 9(*c*)), which determines that the current event was caused by a sword-movement. As ContextChanged is True (step 151), a new play-sequence must have been just created. If the new sword-position (in the form of a sword-action) was now appended, this play-sequence would cause the toy to first switch to its initialisation sword-state NE/P and then immediately switch to its new sword-state E/P. To avoid such excessive sword-movements the algorithm uses step 153 to replace the initialisation sword-state value NE/P, with the new sword-state value E/P. If the play-sequence had not been newly created then a new sword-action, containing the new sword-state, would simply have been appended to the play-sequence in step 152.

As there are more events to process, the loop then iterates again to process the trainer-event at time $t_5$, caused by the trainer 111 significantly altering its direction at the point on the trainer 111 path labelled T5 (FIG. 10(*d*)). As a result, its relative-orientation to the trainee 110 is now towards quadrant Q4 (orientation-grid 116 not shown), as indicated by the arrow 115. The trainee 110 has at this time moved to the point on its path labelled (T5).

The trainer 111 remains in the zone-grid 112 (step 123, FIG. 9(*a*)) and CurrSequence is set up (step 129), so step 130 appends a movement-action, to the current play-sequence, containing the new zone/cell position of the trainer 111 (Z3/C5), along with the transit-time ($=t_5-t_4$). Though the trainer's 111 zone-position and sword-state have not changed the relative orientation has, so a new play-sequence is created in the trainee's 110 defence-map at the entry indexed by the new context-data at time $t_5$.

The trainee's 110 sword-state has not changed so the loop iterates and continues with each new event in the path, in a manner that should now be clear. At some point the trainer 111 may pass out of the trainee's 110 zone-grid 112. This will be detected by step 123 when the next event is processed. As CurrSequence will be pointing at the play-sequence created at a previous context-changing event, step 124 fails and step 125 appends a special zone/cell position (e.g. −1/−1) to the current play-sequence (indicating the trainer 111 has moved out of the zone-grid 112), together with the transit-time to move out of the zone-grid 112. Step 126 then sets CurrSequence=Null and step 127 scans through subsequent events until it finds the next trainer-event. If there is one, step 128 passes control to step 123 to start processing this event. If there isn't, then step 128 fails and the algorithm ends.

When the training of the first toy is complete, the second toy may be trained simply by pressing its Training button 87.

The toy's roles are reversed and the second toy is trained in the same way as the first. A toy's training may be selectively edited by double-clicking its Training button 87. The trainer 111 will then invite the user to position the trainee 110 relative to the trainer 111 and to set up their relative sword-positions. If the user then presses the Training button 87 again, they will be able to edit the play-sequence in their Defence-Map whose context-data is given by the current arrangement of trainer 111 to the trainee 110. If, instead, the user presses the Combat button 88 at this point, the appropriate play-sequence in the Attack-Map may be edited. Training may be paused at any time by pressing the Pause button 89, or stopped by double-clicking it.

Combat Phase

Once at least two toys are trained (i.e. at least one play-sequence is defined for every zone in the attack- and defence-maps of both toys) they can battle each other in the Combat phase. To allow users to move straight to this stage, the preferred embodiment is supplied with its defence- and attack-maps pre-programmed with basic play-sequence responses to various opponent contexts. If the toy is trained, these pre-programmed play-sequences are then overwritten with the newly learnt play-sequences.

Essentially, the Combat phase involves identifying an opponent to focus on from amongst the other toys, determining the context (relative orientation, position and sword-state) of the opponent, and then using that context as the index to obtain and execute a play-sequence (learned in the Training phase) from its attack- or defence-maps. Combat may be paused at any time by pressing the Pause button 89, or stopped by double-clicking that button.

Figure 11A:
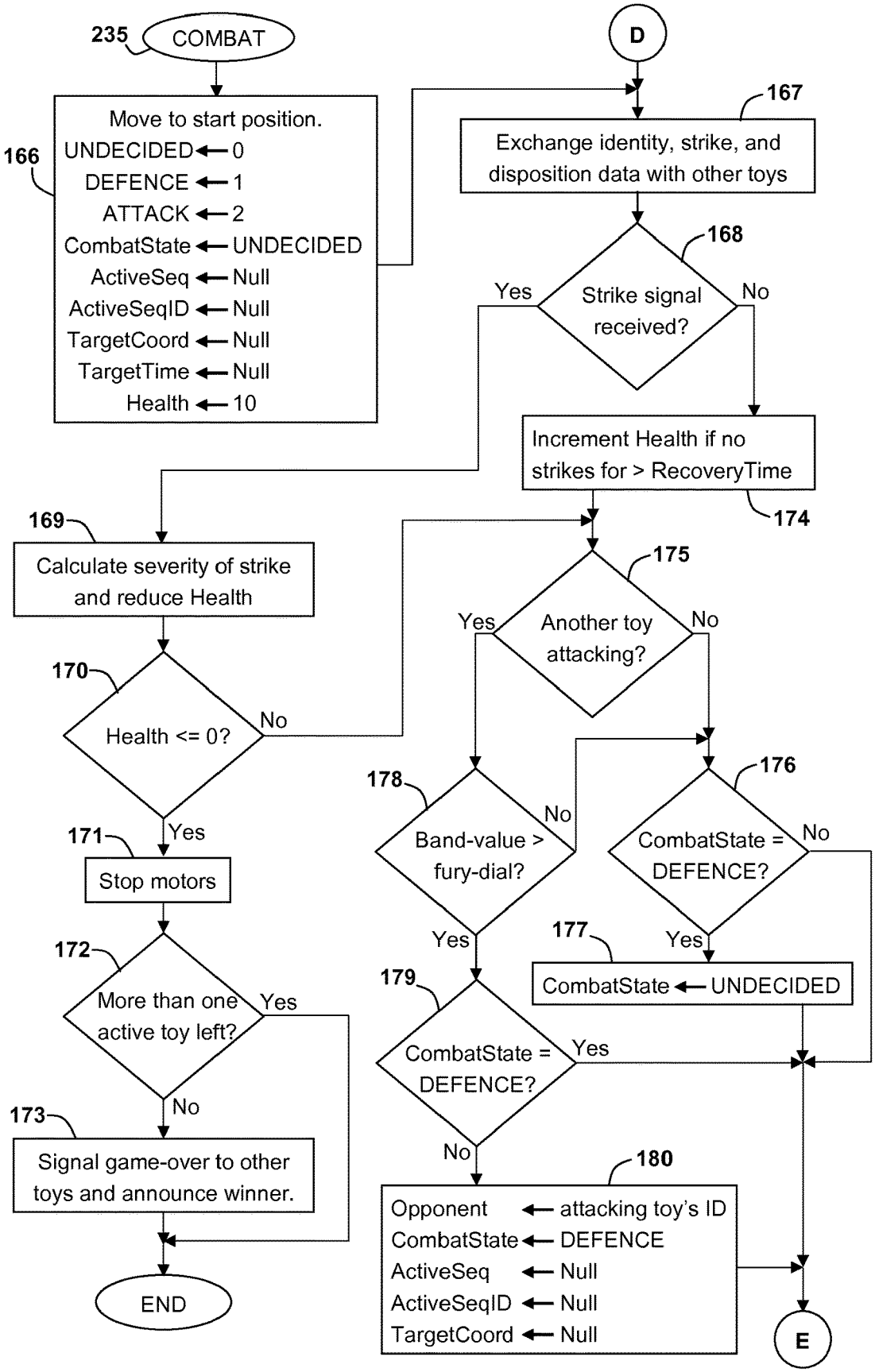
FIGS. 11(*a*), (*b*) and (*c*) are flowcharts illustrating the operation of the Combat phase program for the Champions application. The flowcharts are connected by the lettered connectors shown in circles on the flowcharts.
Figure 11B:
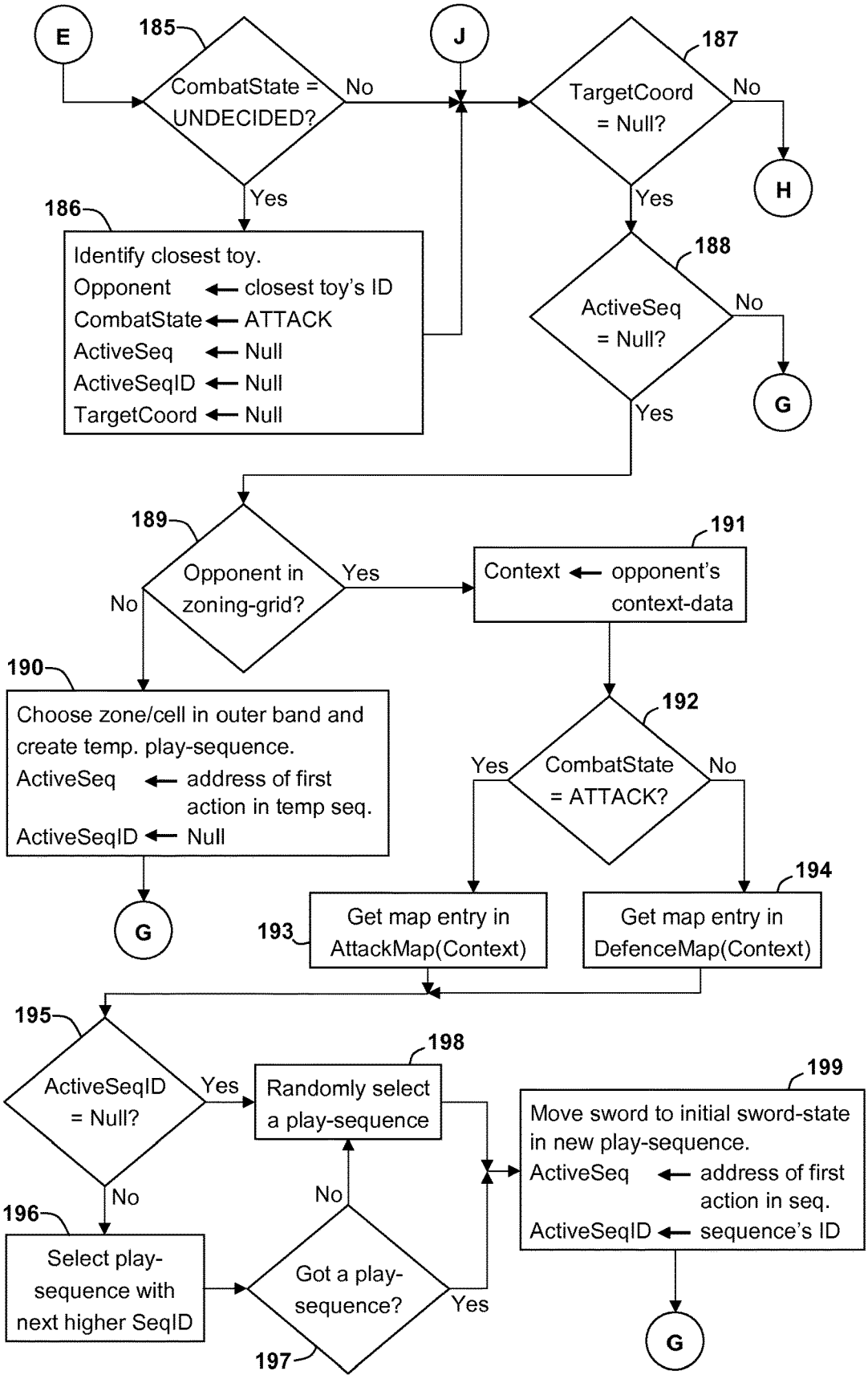
Figure 11C:
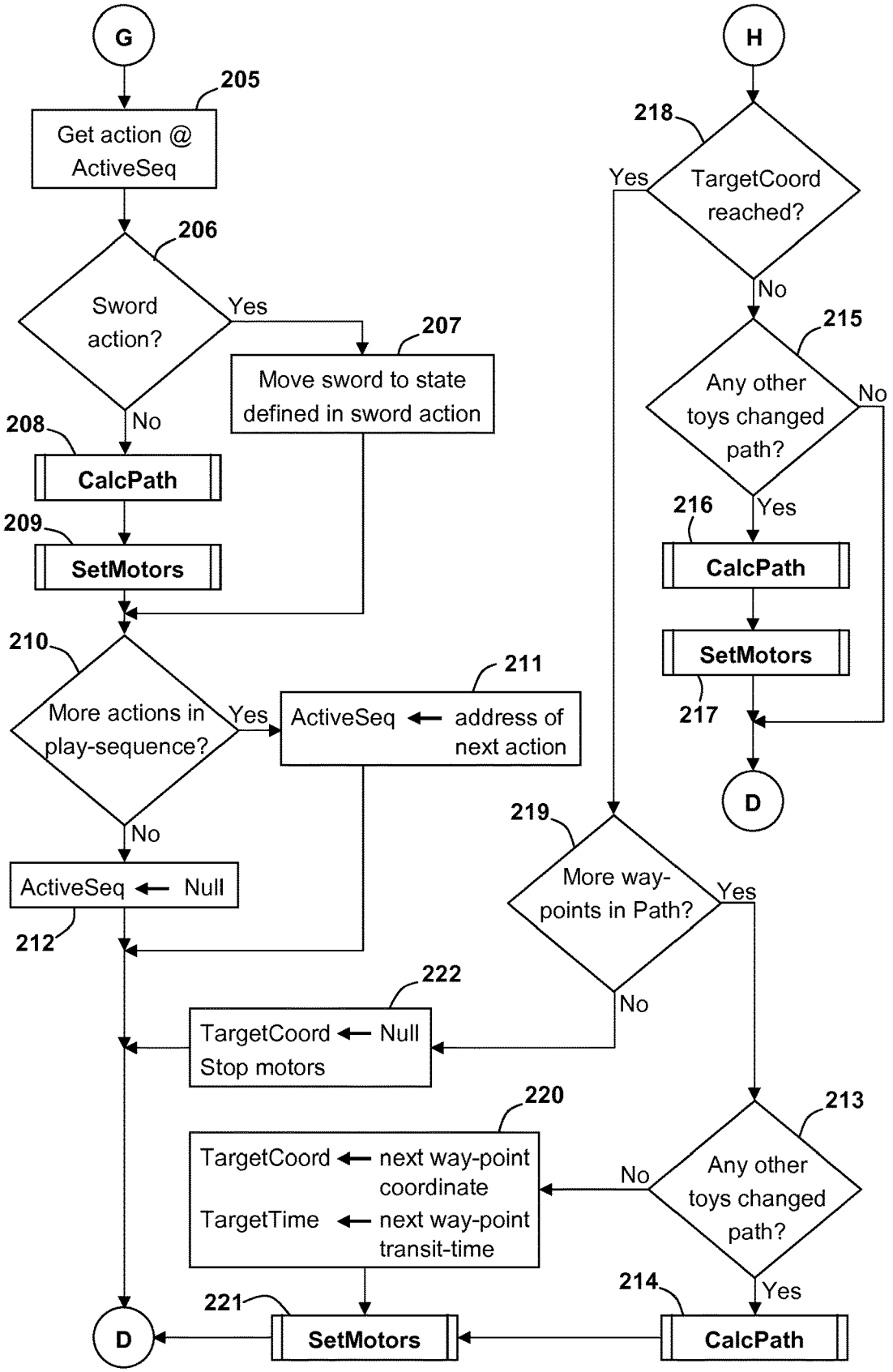

When the Combat button 88 is pressed on one toy, this fact is communicated to the other toys and they all enter Active-Mode and start running their Combat programs, as depicted in the flow chart of FIG. 11(*a*). The first step 166 causes each toy to move to a unique starting position, which are distributed equidistantly, or by some other arrangement, around the surface 1. It then initialises the constants UNDECIDED, ATTACK and DEFENCE, which are used to set the value of the variable CombatState. This and other key variables are also initialised in step 166: CombatState is set to UNDECIDED; ActiveSeq, ActiveSeqID, and the Target . . . variables are set to Null; and Health is set to 10.

CombatState indicates whether the fighter is attacking another toy, defending from an attack by another toy, or is temporarily undecided. ActiveSeq is a pointer to a play-sequence (if any) that the fighter is currently executing and ActiveSeqID is its sequence ID. TargetCoord and TargetTime contain the coordinates and transit-time for the current way-point in the Path data-store. This contains a sequence of such way-points, which define the planned path of the toy.

Health is a variable that is used to represent the current strength and well-being of the toy. It has values between 0 and 10. The Health parameter decrements according to the severity of any successful strikes upon the toy. It will increment (but not beyond 10) if the toy is able to avoid further wounds for a time-period greater than a defined RecoveryTime constant.

When all toys are in their starting places, the operation of each toy's Combat program continues independently. This is now explained with reference to one toy (called the fighter hereafter), starting with step 167, which is the first step in a loop that iterates for the duration of the Combat phase. Step 167 uses the toy's communications-means 14 to exchange identity (ID code), strike and disposition data (e.g. orientation, position, sword-state, Opponent, Health, and CombatState) with all the other toys.

Step 168 then checks if a strike signal has been received from another toy (the striker). If so step 169 assesses the relative orientation and distance of the striker, and the striker's sword-state in relation to the disposition of the fighter's own sword 100 and/or armour 83. If it calculates that the striker has successfully or partially struck the fighter, it reduces the Health parameter by an amount commensurate with the location and nature of the strike, and the Health (strength) of the striker.

Step 170 then tests if the fighter's Health has reached zero. If so it is out of the game and step 171 stops it where it is. An indicator 12 or actuator 10 on the toy may, in some embodiments, be used to indicate the defeated state of the toy.

Step 172 then checks how many toys are left; if only one, step 173 signals game-over to the other toys, the winner is declared and the Combat phase ends, otherwise the Combat program ends for this toy but the game continues for the other toys until there is one champion left. At that point, the previous combat phase may be replayed (by double-clicking the Combat button 88), a new Combat phase may be started or one or more of the toys may be re-trained. Some embodiments may terminate the Combat phase after a predefined time-period and declare a draw amongst the still active toys. The same or other embodiments may cause defeated toys to withdraw to the edges of the position-encoded surface 1, so they do not obstruct the remaining active toys.

If there was no strike, and there have been no strikes for greater than a predetermined time (RecoveryTime), then step 174 increments Health if it is less than 10. Step 175 then checks if there is another toy in an ATTACK CombatState that is focused on the fighter (i.e. the fighter has been selected as the opponent for that toy). If there is, step 178 compares the band-value of the attacking toy to the value of the fury-dial 84. The band-value is calculated from the zone-band (relative to the fighter) that the attacking toy is in. The inner-most zone-band (ZB4 in FIG. 7) has a band-value of 4, ZB3 has a band-value of 3, through to ZB1 with a band-value of 1. If the attacker is outside the fighter's zone-grid 112, the band-value is 0. The fury-dial 84 potentiometer is digitised to a value between 0 (cautious/defensive) and 3 (furious/aggressive).

Thus in step 178 if the band-value is greater than the fury-dial 84 value, then control passes to step 179, which tests if the fighter is already in the DEFENCE CombatState. If it isn't, step 180 sets the Opponent variable to the attacking toy's ID code, thus making that toy the fighter's opponent. The fighter's CombatState is set to DEFENCE, and ActiveSeq, ActiveSeqID and TargetCoord are set to Null (to discontinue any currently executing play-sequence or move).

If the fighter is not being attacked (step 175) or the zone-value of an attacker is not greater than the fighter's fury-dial 84 value (step 178), then step 176 checks if the CombatState is DEFENCE. If it is, it is set to UNDECIDED in step 177.

Whether attacked or not, control passes via connector E to step 185 (FIG. 11(*b*)), which tests if the fighter's CombatState is UNDECIDED. If it is, step 186 assesses which other toy is closest to the fighter (it chooses randomly if there is more than one) and makes that toy its opponent by setting its Opponent variable to that toy's ID, its CombatState to ATTACK, and ActiveSeq, ActiveSeqID and TargetCoord are set to Null. Control then passes to step 187.

In some embodiments a toy may act as though it is only aware of toys to its front and sides. In these embodiments, if the fighter cannot 'see' another toy, the Combat program will cause it to start rotating until it can.

Step 187 then tests if TargetCoord is set up, which would indicate the fighter is currently moving to a new position. If it isn't (i.e. its Null) then step 188 tests if ActiveSeq is Null. If it isn't then the toy is currently executing a play-sequence, so control passes to step 205 (FIG. 11(*c*)) via connector G.

Otherwise, if ActiveSeq is Null then step 189 checks if the opponent is within the fighter's zone-grid 112. If it isn't then step 190 randomly chooses a zone and cell in the outer zone-band ZB1. These are stored as the destination of a single move-action, with an associated transit-time of −1 (indicating maximum speed should be used), in a temporary play-sequence data-store separate from the maps. ActiveSeq is pointed at this movement-action and ActiveSeqID is set to Null. Execution then continues with step 205 (FIG. 11(*c*)) via connector G.

If, however, the opponent is within the fighter's zone-grid 112 then the current context of the opponent (i.e. its relative orientation, zone position, and sword-state) is used to create a context-data index that is stored in the composite variable Context in step 191. A test is made of CombatState in step 192 and the index is used to access an entry in the fighter's defence-map (CombatState=DEFENCE) or its attack-map (CombatState=ATTACK) in steps 194 or 193, respectively. If no play-sequences are defined for this map-entry, then the following elements are disregarded in the context-data index, in the following order, until a map-entry with play-sequences is found: sword-orientation, sword-position, and relative orientation. This will always yield at least one map-entry with a play-sequence because, in the current embodiment, there must be at least one play-sequence per zone for Combat phase to begin.

Once a map-entry with play-sequence(s) is located, step 195 tests if ActiveSeqID is Null. If it is then step 198 randomly selects a play-sequence from among the play-sequences in the map-entry. If it isn't, then the toy must have just completed another play-sequence so step 196 selects the play-sequence, in the map-entry, that has a SeqID greater than, and closest to, ActiveSeqID. This ensures that, if it exists, the play-sequence learnt immediately after the just completed play-sequence is preferentially used. If step 197 detects there are no play-sequences meeting this criteria, then step 198 randomly chooses a play-sequence from among those present in the map-entry. With the play-sequence selected, step 199 moves the fighter's sword 100 to the initial sword-state recorded in the play-sequence (if not already there). It then points ActiveSeq at the first action in the new play-sequence and sets ActiveSeqID to the play-sequence's SeqID.

Step 205 in FIG. 11(*c*) then receives control via connector G. This step gets the action pointed to by ActiveSeq and step 206 tests if it is a sword-action. If it is, step 207 moves the fighter's sword 100 to the position and orientation specified by the sword-action and passes control to step 210 to get the next action in the sequence.

Otherwise it must be a movement-action, so step 208 calls the subroutine CalcPath followed by the subroutine SetMotors (step 209). Once these have completed, step 210 then tests if there are any more actions in the current play-sequence. If there are, step 211 advances the ActiveSeq pointer to the next action, otherwise if the play-sequence is completed then step 212 sets the ActiveSeq pointer to Null. This will cause a new play-sequence to be selected when step 188 next executes. The main loop then restarts at step 167, FIG. 11(*a*), via connector D.

The CalcPath subroutine calculates a path to execute the movement-action pointed to by ActiveSeq. This will bring the opponent into the target zone/cell position in the required transit-time (given the broadcast path and speed of the opponent), while avoiding collisions with all other toys (according to their broadcast path and speed), and while ensuring the fighter stays within the surface 1 boundaries. If the transit-time provided is −1, then the path is executed at maximum speed.

CalcPath calculates the path as a series of way-points (defined by coordinates on the surface 1) that are stored in sequence, with a transit-time for each way-point, in a data-structure called Path. It then sets TargetCoord with the coordinates of the first way-point in the Path sequence and sets TargetTime with the transit-time for that way-point, before returning.

Note that it may not be possible to calculate a path that meets all the constraints. In this case the algorithm will either choose an alternative play-sequence as the ActiveSeq, or it will choose a new opponent (if it is not defending against an attacker). This has not been described or included in the flow-charts, as its implementation should be clear to anyone skilled in the art.

The SetMotors subroutine calculates speeds and initiates the drive signals for the fighter toy's wheel-motors, so that the fighter will move from its current position to the coordinate position specified in TargetCoord. Nominal speeds are calculated to move the fighter to the new position in the transit-time specified in TargetTime. These nominal speeds are then multiplied by a factor which is equal to: (H+K1)/K2, where H=the toy's Health value, and the constants K1 and K2 are chosen so that the toy's speed will noticeably reduce as its Health is depleted, but not by so much as to make the game tedious. For example, K1=10 and K2=20, will vary the speed between 55% and 100% for Health in the range 1-10.

Returning now to the flow-chart in FIG. 11(*b*), if step 187 finds that TargetCoord is not Null, then the toy must already be engaged in a move action. So control passes via connector H to step 218 in FIG. 11(*c*). This checks if the target coordinate in TargetCoord has been reached. If it hasn't, step 215 checks if any of the other toys (including the opponent) have changed path or speed since the last time CalcPath was called. If any have then there may be the risk of a collision, or the opponent's course may have changed. Either way it is necessary to update the Path, so step 216 calls CalcPath to do this, using the fighter's latest position as the new starting point. As stated above, this will also reset the TargetCoord and TargetTime variables. Step 217 then calls SetMotors with the new TargetCoord, before restarting the main loop at step 167, FIG. 11(*a*), via connector D.

If step 218 found that the target coordinate had been reached, then step 219 checks if there are any more way-points in the Path data-store and, if there are, step 213 checks if any of the other toys have changed path or speed (as above). If any have then the Path way-points are no longer valid, so step 214 calls CalcPath to calculate a new set of Path way-points and sets up TargetCoord and TargetTime. Otherwise, if no other toys have changed course, then step 220 sets TargetCoord and TargetTime to the next way-point's coordinates and transit-time. In either event, step 221 then calls SetMotors to set up the motors for the new target coordinate. The main loop then restarts at step 167 via connector D.

If step 219 found there were no more way-points then Path is completed and step 222 stops the motors and sets TargetCoord to Null. The main loop then restarts at step 167 via connector D.

Sparring Program

Figure 12:
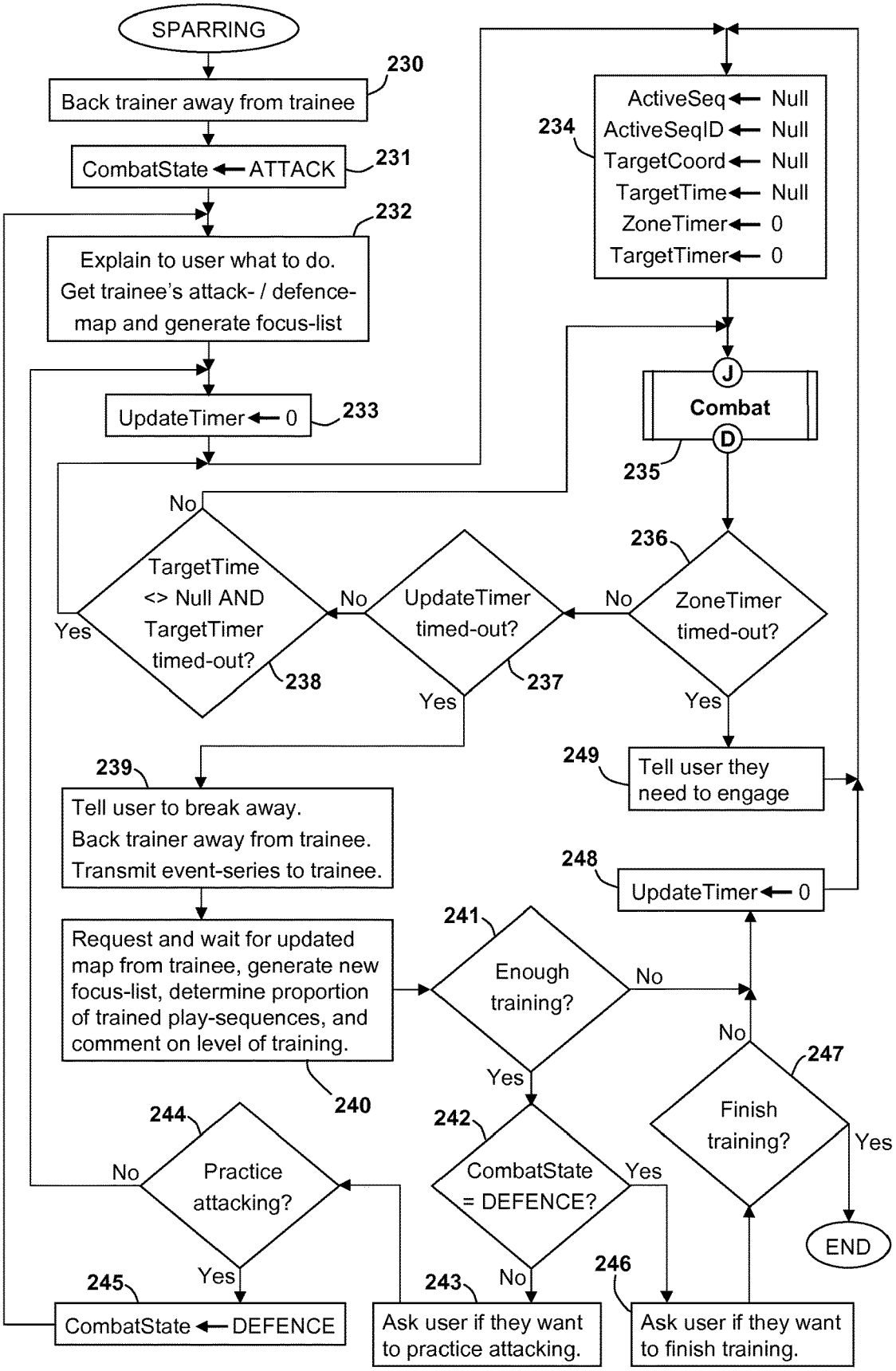
FIG. 12 is flowchart providing an overview of the operation of the Sparring program used by the trainer 111 during the Champions application's Training phase

It will be recalled that the Sparring program is run by, and governs the actions of, the trainer 111 during the Training phase. It should now be clear that the Sparring program can be readily implemented using a modified Combat program to run pre-programmed Sparring attack- and defence-maps. The only differences are: the trainer 111 does not know, beforehand, what path the trainee 110 will take; and the Combat program must be partially modified to run under the supervision of the Sparring program, as is now explained in general terms with reference to the flow-chart in FIG. 12.

Once the trainer 111 has received notification from the trainee 110 that its Training button 87 has been pressed, it starts its Sparring program. In step 230 the trainer 111 is backed away from the trainee 110 (i.e. outside its zone-grid 112). In step 231 the trainer 111 sets its CombatState to ATTACK and step 232 triggers the audio-means 13 to explain that it is about to attack from various quarters and that the trainee 110 (user) should mount a vigorous defence to these attacks.

The trainer 111 then requests and receives from the trainee 110 a copy of its defence-map (trainer CombatState=ATTACK) or its attack-map (trainer CombatState=DEFENCE). Step 232 then generates a focus-list of all map-entries in the map, in ascending order of the number of play-sequences stored under each map-entry.

Thus the map-entries at the top of this focus-list have the least number of play-sequences defined and it will be a focus of the trainer's 111 actions to cause play-sequences to be defined for these entries. Their context-data index provides the zone (in the trainee's 110 zone-grid 112) that the trainer 111 tries to enter, and the orientation and sword-state define the disposition adopted by the trainer 111, as it enters that zone. Later, when the trainee runs its Training program (see below) and the event-series are analysed, the trainee will then generate play-sequences for these under-defined zones and dispositions, as was previously described.

The Combat program variables ActiveSeq, ActiveSeqID, TargetCoord and TargetTime are now all set to Null in step 234 (Health is not used). This also sets a number of timers to zero: ZoneTimer, which monitors how long it takes the trainer 111 to get into the trainee's 110 zone-grid 112; TargetTimer, which monitors how long it takes the trainer 111 to reach its current TargetCoord; and UpdateTimer (set in step 233) which monitors how long the trainee 110 and trainer 111 have been sparring. These timers increment automatically with the system time, immediately from the point they are reset.

In step 235 the Sparring program calls the Combat program, entering it through connector point J, FIG. 11(*b*). The Combat program operates as previously described, except for the following important differences:

Difference One:

As the Sparring program runs it generates an event-series containing a list of the trainer's 111 contexts at various points in its path. As previously described these points occur whenever the trainer's 111 path, orientation or speed changes significantly, or whenever its sword-state changes. It will be clear that this event-series can be created with additional code in step 207 and in the SetMotors subroutine.

Difference Two:

Step 189 is modified so it tests if the trainer 111 is in the trainee's 110 zone-grid 112, not the other way around.

Difference Three:

In step 190 the trainer 111 chooses a map-entry from the top of the focus-list (i.e. with the least number of play-sequences already defined), which is associated (by its context-index) with a zone in the trainee's 110 outer zone-band ZB1. This zone, plus a randomly chosen cell in the zone, are used as the destination for the movement-action stored in the temporary play-sequence in step 190. ActiveSeq and ActiveSeqID are set as before.

Difference Four:

A new step is inserted between steps 189 and 191 that identifies under-defined map-entries in the focus-list, which have a context-data index whose zone part matches the zone the trainer 111 is in (relative to the trainee 110). It selects the map-entry that has the best combination of: the least play-sequences defined, and a context-data index most closely matching the trainer's 111 current context. The trainer 111 then adjusts its context (orientation and sword-state, as it is already in the right zone) to completely match the context defined by the selected focus-list map-entry. Step 191 then gets the trainee's context-data into Context, as before, and steps 192-194 get a new attack- or defence-map entry, as before.

The trainer's 111 new context will be recorded as an event in the event-series. When the trainee's 110 Training program is run, that trainer 111 event will cause the definition of a new play-sequence in the selected map-entry of the trainee 110, as was required.

Difference Five:

Steps 195-198 are replaced by a single step that selects the play-sequence in the trainer's Sparring attack- or defence-maps, which has an initial sword-state that matches the trainer's 111 current sword-state that was set up in the new step in Difference Four above. Note that the Sparring attack- and defence-maps must be set up to ensure a match will always be found. The routine then continues with step 199 onwards, as before.

Difference Six:

Steps 215 and 213, FIG. 11(*c*) will always test positive because the trainer 111 cannot know beforehand what the trainee's 110 path will be, thus it will effectively 'change' every time.

Difference Seven:

In FIG. 11(*c*) just prior to calling CalcPath in step 208, the TargetTimer is zeroed (i.e. it starts timing from the start of each new movement-action). Similarly in step 191 in FIG. 11(*b*), ZoneTimer is reset to zero (so it doesn't time-out as long as the trainer 111 is in the trainee's 110 zone-grid 112).

Difference Eight:

When the Combat program reaches connector D in FIG. 11(*c*), instead of returning to step 167, FIG. 11(*a*) at the head of the combat loop, it returns control to the Sparring program which continues with step 236, which tests the ZoneTimer. If it has timed out the user must be constantly retreating from the attack (or failing to press its attack if the trainer's 111 CombatState=DEFENCE), so control passes to step 249. This uses the audio-means 13 to taunt the user's cowardice and explain that they need to engage in order for their Champion to learn. The system then loops back to step 234, the variables are reset, and a new ActiveSeq is chosen in the Combat routine (step 235).

If the ZoneTimer has not timed out, then step 237 checks if the UpdateTimer has timed-out. If not, and if the current TargetTime is not Null, then step 238 compares the TargetTimer with TargetTime. If it is greater than TargetTime by a significant predetermined amount, the system assumes that its current TargetCoord cannot be reached (due to the movements of the trainee 110) and so passes control to step 234. The process then restarts, as described before.

If the UpdateTimer has timed out, step 239 uses the audio-means 13 to instruct the trainee 110 (i.e the user) to break off the attack or defence and it causes the trainer 111 to back away from the trainee 110. It then transmits the event-series generated by the trainer 111 to the trainee 110 and instructs the trainee 110 to run the Training program (FIGS. 9(*a*), (*b*) and (*c*)). As previously described this combines and analyses the trainer's 111 and trainee's 110 event-series and updates the trainee's 110 defence- or attack-map.

Step 240 then requests and receives (when the trainee 110 has completed the Training program) from the trainee 110 a copy of its updated attack- or defence-map. It uses these to generate a new updated focus-list, as previously described, and then determines the proportion of map-entries with defined play-sequences. The audio-means 13 uses this proportion to comment on the level of training the trainee 110 has received. If the training has reached a predetermined, sufficient level (tested in step 241) the system checks in step 242 if the CombatState is DEFENCE (i.e. the trainee 110 has received both defence and attack training). If so, the trainer 111 asks the user if they want to finish training in step 248. The user may continue training or the Training phase/Sparring program can be stopped by double-clicking the Pause/Stop button 89—this is tested for in step 247.

If the trainee 110 has only had defence training (CombatState=ATTACK in step 242), then step 243 causes the trainer 111 to ask the user if they wish to now practice attacking. If step 244 determines they have indicated their assent by pressing the Combat button 88, the trainer 111 switches its CombatState to DEFENCE (step 245) and control passes to step 232 which causes the audio-means 13 to tell the user that they should attack the trainer 111 from a variety of quarters and then requests and receives from the trainee 110 a copy of its attack-map. The UpdateTimer is then reset to zero in step 233 and the loop begins again at step 234.

Everything proceeds as for defence training except that step 190 in the Combat program no longer generates a play-sequence to bring the trainer 111 into the trainee's 110 zone-grid 112. Instead a temporary play-sequence is initiated that causes the trainer 111 to move back and forth in front of the trainee 110, thereby presenting different aspects for the trainee 110 to attack (i.e. it waits for the user to move the trainee 110 such that it ends up in the trainee's 110 zone-grid 112). If the ZoneTimer then times out, step 249 will then use the audio-means 13 to goad the user into an attack, pointing out their trainee cannot learn until they do.

Otherwise, if the level of training was insufficient, or if the user wishes to continue practicing their attacks or defences, then the UpdateTimer is reset in step 248 and the loop begins again at step 234.

Variants

It will be clear to those skilled in the art that the above algorithms have been kept simple for ease of explanation and can be refined in a number of ways. For example, other data might be used for the context-data (e.g. relative rather than absolute sword-state, opponent's speed, etc.). It could also be advantageous to monitor the combat of toys to ensure they don't become stuck in an action/reaction loop in which no toy gains an advantage. In particular, it may be necessary to introduce a random delay before a toy enters or exits the DEFENCE CombatState (step 180 or step 177 respectively). This will prevent possible situations with two toys, whereby both toys enter the attack state because nobody is attacking them, then both toys enter the defence state because each detects the other is attacking, then re-enters the attack state because neither are attacking, and so on. It will be clear to those skilled in the art how this might be achieved.

Champions may be supplied with speech recording and playback means. In this event the Sparring program would invite the user to record appropriate exclamations (e.g. war-cries) as they train their toy. Alternatively, it may be provided with speech-synthesis and pre-programmed with exclamations to suit a variety of different situations. The exclamations would then be played back (possibly by randomly selecting from a number of such exclamations) when a matching situation arises.

Alternatively, the Champions may themselves be mute and instead a Commentator toy included with the set. The Commentator, which may be a static element, would have speech-synthesis with pre-programmed speech-segments for delivering a commentary on the game. This has the advantage, of course, of lowering the cost of production of the individual Champions.

Alternatively, the Champions may include speech-recognition. In such an instance the selection of a particular attack/defence play-sequence may then be influenced, not only by the disposition of the toys, but also by verbal commands from the user.

In some embodiments the computations required for the Combat phase may occur before or during the Combat phase. If before then the computations would result in a play-sequence being generated for each toy. In the Combat phase each toy then simply replays these play-sequences in synchronisation—the game-play and outcome being predetermined.

Some embodiments may allow the toys to be equipped with different armour 83 and 82 or weapons, thereby altering the calculation of Health damage after a strike. Other embodiments may be equipped with behaviour modifiers other than, or in addition to, a fury-dial 84.

Software may be provided with Champions enabling a user to up-load and down-load their fighter's training (i.e. their attack-maps and defence-maps) to a web-site and swap it with training developed by other users. Championships may be held whereby user's upload their fighter's training for use in a virtual fighter in a computer generated arena, or for use in real toy fighters in some remote arena. These championships would of course be won by the user who has developed the most sophisticated training for their fighters. Alternatively, in an extension of the tele-robotics capability described under Celebrity, users may use their Champions toy to remotely control real or virtual fighters in battles with other fighters controlled by other remote users, or by training programs uploaded by users.

Advantages

The specific implementation of the novel method, described above, has four key advantages. Firstly, if during Combat phase an opponent happens to attack or defend itself in relation to a toy in exactly the same way as the trainer 111 did in relation to that toy, then the toy will enact exactly the same move and sword-action responses that were trained into it when the trainer 111 executed that same attack/defence in the Training phase, which is as it should be.

This is because if the opponent is acting in exactly the same way as the trainer 111 then its context in relation to the toy will change in exactly the same way as the trainer's 111 did. As such, the play-sequences stored against those various contexts, will be selected and re-enacted in the same sequence they were learned. This is assured by the preference given to the selection (in Combat phase) of play-sequences that have a SeqID immediately above the previous play-sequence's SeqID (step 196 FIG. 11(*b*)).

Secondly if, as is more likely, an opponent in the Combat phase deviates from the exact attack or defence implemented by the trainer 111, then the toy will choose an alternative play-sequence response that is appropriate to the new context of the opponent. In other words it will react, seemingly intelligently and with moves discernible from its training, to entirely new sequences of changing opponent contexts even though it was not specifically trained to deal with that series of opponent contexts.

Thirdly, the user can train their toy (in terms of both its movements and reaction speeds) to act intelligently very easily. They simply push it around and move its sword-arm (show it what to do) in response to the trainer's 111 actions. By breaking these responses down, the responses to a large variety of contexts can be quickly obtained without too long a Training phase.

The novel method described of training behaviour into toys, in order that they may react intelligently and autonomously to other toys, may be implemented in a variety of ways and with a variety of refinements. For example, it can be readily extended to training the toys to react intelligently and autonomously to features in the surface 1 and/or to passive accessories on that surface 1.

It should also be clear that this method can extend to a broad range of other games and applications that employ the common principle of training position-aware toys by recording both play-sequences, and context-data about those play-sequences, such that a play-sequence may be autonomously replayed when its context-data bears some relationship to some present or historic context-data sensed in the course of a game.

Some embodiments of such games may also employ self-learning algorithms, which develop a preference for certain play-sequences and a dislike for others based on, for example, the success of those play-sequences when employed in a game.

Social Simulation: Wuggles

Electronic toys that exhibit 'life-like' behaviour are known in the art (e.g. U.S. Pat. Nos. 6,544,098, 6,089,942, 6,641,454). These typically take the form of pets or dolls and may contain a speech-synthesiser, actuated appendages (e.g. mouth, eye-lids, arms), sensors (e.g. tongue/feeding sensor, stroke/pet/shake sensors, light/sound sensors, etc.) and infra-red communications for inter-toy interactions. Some such toys may simply simulate interaction between toys. For example, one toy may say something, send a code to the other toy indicating what it said, and the other toy may then emit a randomly selected response appropriate to the code it received. They then continue in a simulated 'conversation'.

Figure 13:
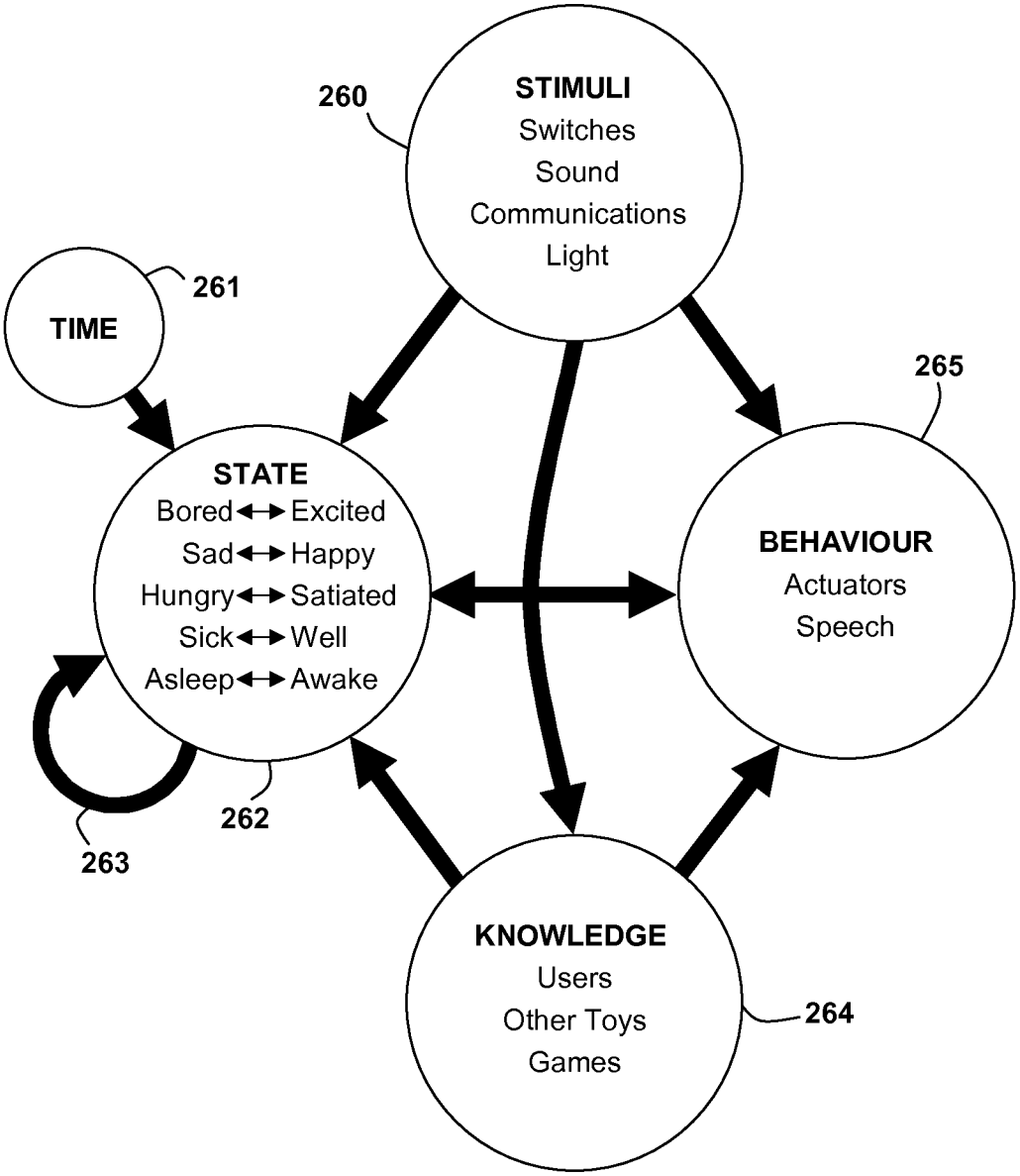
FIG. 13 is a diagram illustrating a typical interaction between emotional-state, stimuli, behaviour and knowledge in the state-of-the-art in Social Simulation style toys.

Other such toys operate with an emotional-state 262, as illustrated in FIG. 13. This may contain parameters indicating, for example, its degree of boredom, happiness, hunger, wellness, and whether it is asleep or awake. Some of these states 262 are driven by the stimuli 260 it receives (e.g. whether its sensor switches tell it is being petted or fed) and by the passage of time 261. For example, the toy's boredom and hunger will increase, respectively, the longer it is left alone and/or not fed. Some states 262 may feed into other states 262, as indicated by the arrow 263. For example, a toy may get sicker the longer it remains hungry.

The behaviour 265 of such toys has been limited to synthesised speech and the actuation of appendages. The toy's behaviour 265 is typically modulated by the stimuli 260 they are receiving at the time, their current emotional-state 262, and their rudimentary knowledge 264 of their user and other toys that are the same as them. This is knowledge 264 captured in the programming of the toy that defines what behaviours 265 are appropriate responses when their user activates certain sensors, or when the toy receives a communication about an activity of another toy.

Figure 14:
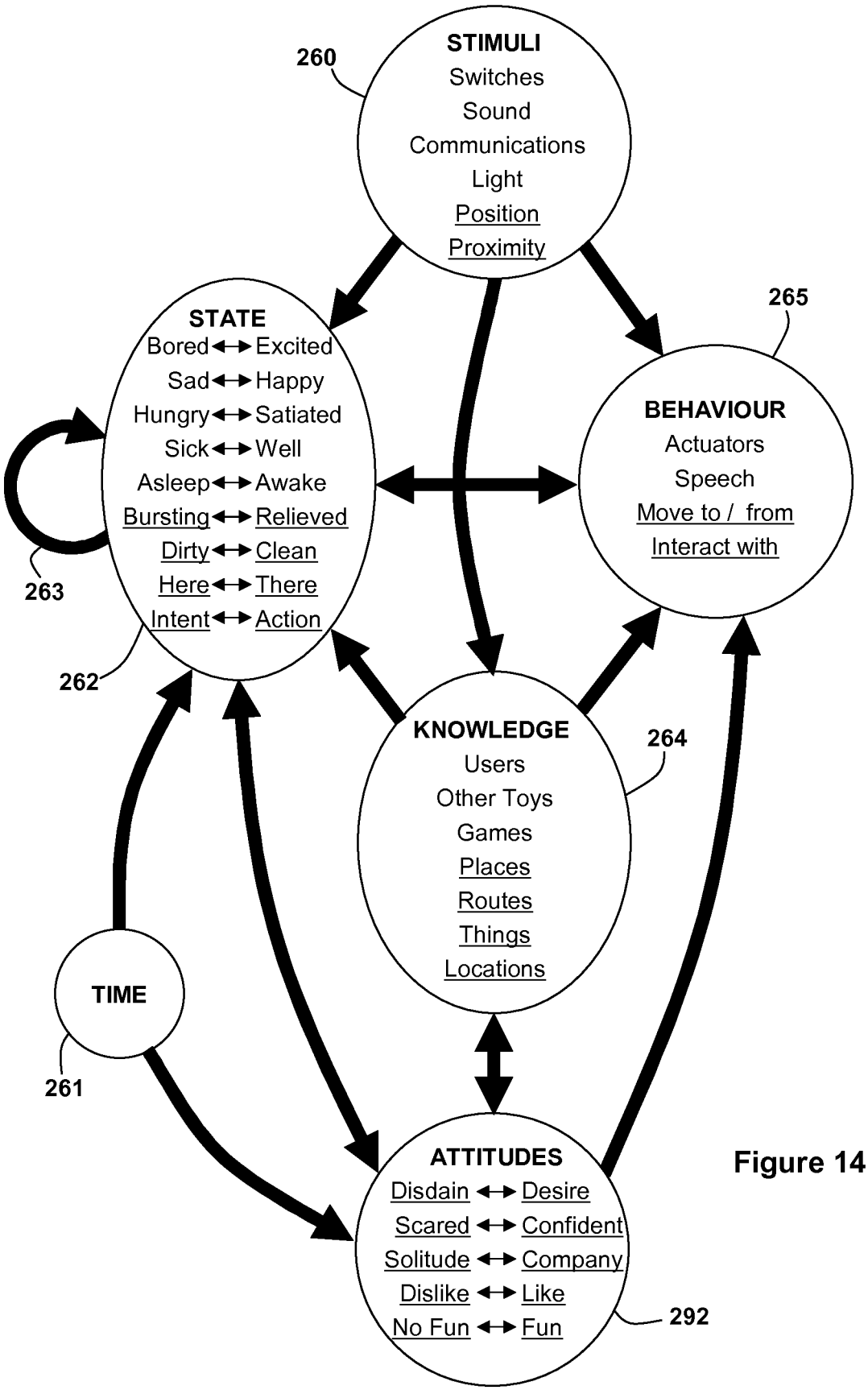
FIG. 14 is a diagram illustrating the greater range of emotional-states, stimuli, behaviour, knowledge and attitudes made possible by applying the teachings of this Toy System to Social Simulation toys.

By applying the novel methods of this Toy System, the capabilities and behavioural variety of these toys can be extended significantly beyond that which is currently described in the art. Not only does the present toy system allow them a sense of their position in space and their proximity to other 'things' and other toys, but it also allows them to know about and interact with and move to and from 'things' and places outside themselves. Thus it makes possible more stimuli 260, states 262, knowledge 264 and behaviour 265, exemplified by the underlined entries in FIG. 14. It also makes it possible for the toy to have attitudes 292 about other 'things', for example a desire to go or be near another thing, or to be scared about or like/dislike certain places or things, or to seek out company or solitude. Now the toys can know (or learn) about places that they can go, routes to those places, things in their environment and the locations of those things or other toys. Similarly, they can now have states 262 describing where they are in relation to things (i.e. the concepts of here or there) and they can have intents in relation to things outside of themselves.

Wuggles are an example embodiment of the Toy System applied to this type of toy. They are adaptive, intelligent, electronic pets. Their body is part of their base 2 and they are arranged similarly to the embodiments previously described (i.e. two-wheels with associated prime-movers (and clutch means if required) provide drive and support augmented by a passive roller-ball; and two sensing-points 4 are mounted fore and aft of the wheels).

They may have no actuators 10 or appendages but have an indicator 12 in the form of a Red-Green-Blue LED (light-emitting-diode) cluster whose lights combine to allow the Wuggle's body to glow in a broad spectrum of colours according to its emotional-state 262. Wuggles have sensors sensitive to stroking and feeding, and voice-recognition and speech-synthesis means containing a small vocabulary enabling them to synthesise and respond to the names of places and things in their environment, and words related to their emotional-states 262, behaviour 265, attitudes 292, and certain additional words such as "Ok", "Yes", "No", "Bad", "Good", "Go", "In", "Out", etc.

Figure 15:
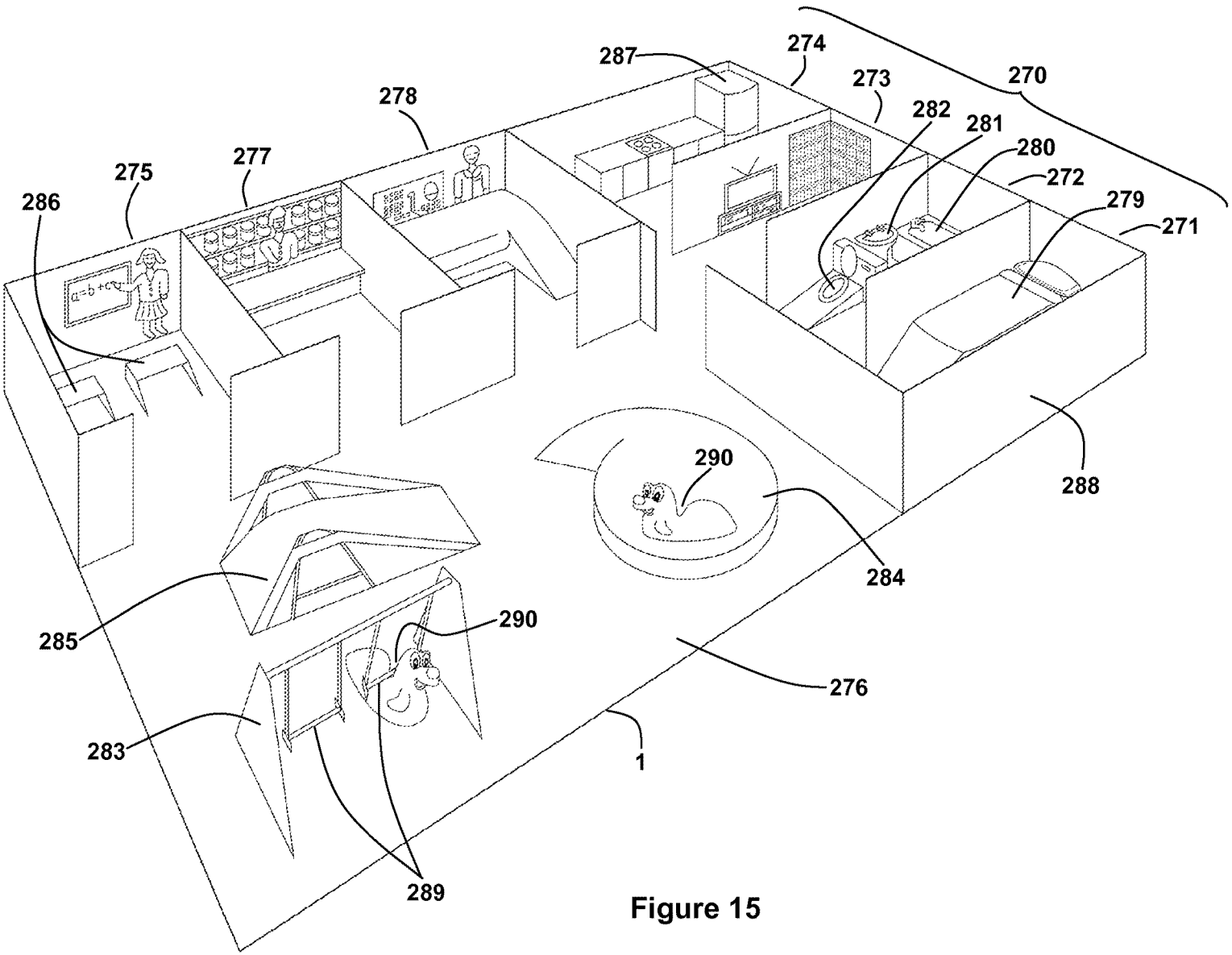
FIG. 15 is an illustration of the Wuggles application for the Toy System. Surface encoding not shown.

Wuggles live in Wuggle World which is illustrated in FIG. 15. This comprises their bedroom 271, bathroom 272, living-room 273 and kitchen 274 of their home 270 plus, external to their home: a school 275, play-park 276, sweet-shop 277 and Doctor's surgery 278. 'Things' may be in some or all of these areas; for example, the bedroom 271 may contain beds 279; the bathroom 272 a bath 280, wash-basin 281 and toilet 282; the play-park 276 may contain swings 283, roundabouts 284 and slides 285, and so forth. Wuggle World is defined by the position encoding surface 1. How this is achieved depends on the visibility of the position encoding but could comprise any or a combination of the following.

The surface 1 may be overprinted with graphics depicting the places and things in Wuggle World. This would be appropriate to encoding that is invisible to the eye and would allow the toy to physically enter each area or piece of furniture.

Alternatively, if the encoding of surface 1 is visible to the eye and must not be masked by further graphic elements, then the places and things may be represented in other ways. For example, some embodiments might implement them as three-dimensional objects or protrusions on the surface with ramps allowing the Wuggles to move onto the objects. In these embodiments the position encoding is continued up the ramp and onto the object. Examples are provided by the beds 279, toilet 282, slide 285 and the roundabout 284.

Some 'things' may be implemented as objects that the Wuggles move adjacent to, in order to 'use' them. For example, Wuggles will interact with the wash-basin 281, desks 286 and refrigerator 287 simply when they move, or are moved, close to them. Other 'things' and places may be defined by vertical partitions, for example the building walls 288.

Other items, such as the swings 283, may physically link with the Wuggle and interact in that way. In the case of the swings 283, for example, the Wuggle can back into a swing so that the bar 289 slides over the Wuggle's back and into the slot 290. The Wuggle can now move back and forth short distances and the swing will move with it, thereby simulating the action of swinging. When the Wuggle leaves the swings 283, the bar will simply slide back out of the Wuggle, as it moves away.

For other 'things', such as the bath 280, the Wuggles may need to be lifted onto them and placed on a surface that is not position-encoded. Instead the surface of the object may be encoded in some other way, in order that the Wuggle can determine what it has been lifted onto. For example, if the position encoding uses coloured lines, as described later, then the surface of the bath may be coloured in a particular colour that can be detected by the sensing-points 4.

Within their behavioural 265 capability, Wuggles have speech- and music-synthesisers and are self-propelled, so they can autonomously move around Wuggle World to places and can interact with things in those places. For example, they may go round and round in the roundabout in the play-park, or they may 'climb' and 'slide' down the slide, or move back and forth on the swings (to be clear, all these actions are simulated by the self-movement of the Wuggle—e.g. on the swings they would move back and forth to simulate swinging).

As part of the stimuli 260 (FIG. 14) they receive, Wuggles may have communications-means 14, to enable Wuggles to determine where other Wuggles are, and what they are doing, etc. thereby enabling inter-Wuggle interaction. Wuggles can autonomously (in Active-Mode) play Catch, Copy Me, Warmer/Colder or Hide-And-Seek with each other. Or one Wuggle can be pushed around by the user (in Passive-Mode), in pursuit of the game with the other Wuggle(s) running autonomously.

Wuggle personalities can be uploaded to a virtual (possibly expanded) Wuggle World hosted on a special web-site. Here they can interact with other Wuggles, uploaded by other users.

Wuggles are governed by their emotional-state 262, attitudes 292, knowledge 264 and stimuli 260 (including position and proximity to other Wuggles or things). Their knowledge 264 can be pre-programmed (e.g. what parts of the surface 1 represent what things or places) or taught by the user. For example, the user may teach them the route to school, or they may encourage behaviour by petting and stroking or with words like "Good", while discouraging bad behaviour (e.g. playing catch in the house) with words like "Bad".

A Wuggle's emotional-state 262 includes degrees of happiness, excitement, hunger, wellness, and tiredness. Their state 262 may also reflect their interactions and intentions in relation to the outside world: for example, they may get hungry, especially after an exhausting visit to the play-park 276, and may develop an intent to go to the kitchen 274 and 'raid' the refrigerator 287. Or they might have got 'dirty' in the play-park 276 and want to have a bath 280 or use the wash-basin 281 to get 'clean'. Or they may get bored and want to watch the TV in the living-room 273. Or their 'bladder' may fill over time until they are 'bursting' to go, at which point they will want to go to the toilet 282. Clearly, the addition of position-sensing capabilities has the potential to create a huge range of interesting behaviours and interactions between the Wuggles and their environment.

Wuggles also have pre-programmed or learnt attitudes 292: for example, they may be scared of some places (e.g. the doctors 278) but like others (e.g. the sweet-shop 277), or they may lack confidence on the swings 283 but once shown how, they become confident.

Wuggles is an ongoing game in which the user's only objectives are to nurture and play with their Wuggles. When they are hungry, they should be taken to the kitchen 274, or the sweet-shop 277, and fed—but be careful they aren't given too many sweets, or they'll feel sick. When they are unwell they should be taken to the Doctor's 278. When sad or scared they should be stroked. When bored they should be played with, to which end they may be taken to the living-room 273, or play-park 276.

Wuggles like consistency and, being a nurturing parent, it is up to you to ensure they attend school 275 every day during term-time and that they have a bath 280 and brush their teeth in the wash-basin 281 before going to bed 279 at a reasonable time every night, otherwise they are likely to be tired and cranky in the morning!

By providing position-awareness and thus enabling knowledge 264 and attitudes 292 about things and places outside the toy, a whole new layer of capability and variety is added to the operation of these toys.

Informational: Wise Old Owl

Wise Old Owl (WOO) (FIG. 16) is an interactive tutor styled as an owl that is aimed at pre- and primary-schoolers. It operates with a surface 1 containing invisible position-encoding and over-printed with visible graphic elements that are appropriate to a particular domain of knowledge or interest: for example, Countries of the World, Fish in the Sea, Numbers, Footballers, and so forth. A number of different surfaces 1 may be purchased for use with WOO. In some embodiments the position encoding may be rendered on a transparent sheet overlaid on a surface 1 containing the visible graphics. Other or the same embodiments may allow the visible graphics to be downloaded from a specialist web-site and printed at home. In further embodiments the surface 1 may not be a single sheet at all but may be a page within a book.

WOO is essentially an information device that provides information-content appropriate to its position in relation to the graphic elements on the surface 1. In other words, the surface 1 can be thought of as a menu that allows the user to select the information-content provided by WOO. To this end the surface 1 may contain primary-graphic elements, which may in turn contain sub-graphic elements (and so on to any level). The primary-graphics would provide access to a sub-domain of information-content within the surface 1 and the sub-graphics would provide access to areas of information-content within the sub-domain, and so forth.

In the same or other embodiments these graphic elements may include words, letters, numbers or other markings and WOO may be operable to provide information-content on what the word, letter, number or marking is (i.e. it may 'read' it aloud) and/or may provide other information-content relevant to it (e.g. its definition, or position in the alphabet or number series, or words that begin with the letter, etc.)

Information-content is provided by WOO through its face 296, which contains a liquid-crystal-display (LCD) screen 297, and through an audio-output-means in its body, which comprises sound synthesis circuitry and an audio-output device, such as a speaker. The head forms part of a combined body and base 2 that may be easily grasped and slid around by the user. WOO preferably has no prime-movers, so it is not self-propelled and preferably has no actuated appendages, couplings 34 or drive-sockets 35, 36. However, it may have rotating-members or skids to facilitate its free movement over the surface 1, as it is pushed by the user.

The LCD screen 297 and the audio-output-means (collectively known herein as the information-means) are under the control of the processing-means 3. They are used to output video, image, speech or sound data (collectively known herein as the information-content) stored in the memory-means 15. When not outputting video or images, the LCD screen 297 may display WOO's eyes, which may be animated.

Only one sensing-point 4 is needed and this is mounted in the pointing-means 298 (styled as the toy's beak) at the front of the toy. This enables WOO to detect what part of the position-encoded surface 1 its pointing-means is on and it uses this data to select and output information-content appropriate to that point on the surface 1. This may be triggered by the user leaving the toy over a particular element for a certain minimum period of time, or by the user pressing a button 299 on the toy.

For any particular surface 1 graphics (or overlay graphics) WOO is programmed with data that firstly, relates a particular position on the surface 1 to the graphic depicted at that position; and, secondly, provides information-content relevant to each graphic. This programming may be effected by reading codes (using the sensing-point 4) printed elsewhere (e.g. on the back of the surface 1), or by plugging in a memory module provided with the surface 1, or by downloading the programming from a web-site created for WOO, or by any other appropriate method known in the art.

WOO can also play games with the user, thereby reinforcing the learning experience. For instance, by challenging them to find (by pushing the toy to it) a particular element or series of elements within a certain time, or a particular element whose name begins with a specified letter, or which is rendered in a particular colour or shape, and so forth.

It should be noted that in each embodiment described there is no requirement for any physical connection between the toy and the surface 1. For example there is no need for a wire between the toy and the surface to conduct electrical signals between the two. It should also be noted that in each embodiment described above the toy is free to travel in any direction across the surface 1, either under its own power or when pushed by a user. The movement of the toy is unrestricted. Although the toy may follow a particular path if so desired, it is not restricted to doing so.

A Position Sensing System

It will be clear from the above that the Toy System described depends on a position-sensing system sufficiently low cost to be usable in a toy. A novel example of such a system is now described. At its heart is a position encoded surface whose codes are readable by sensors mounted in the toy (or any other movable object that may use this system). As well as being lower in cost than any existing prior art it is also robust and able to handle decoding errors caused, for example, by small jumps of the sensor or by dirt on the surface 1.

Position Encoded Surface

Figure 17:
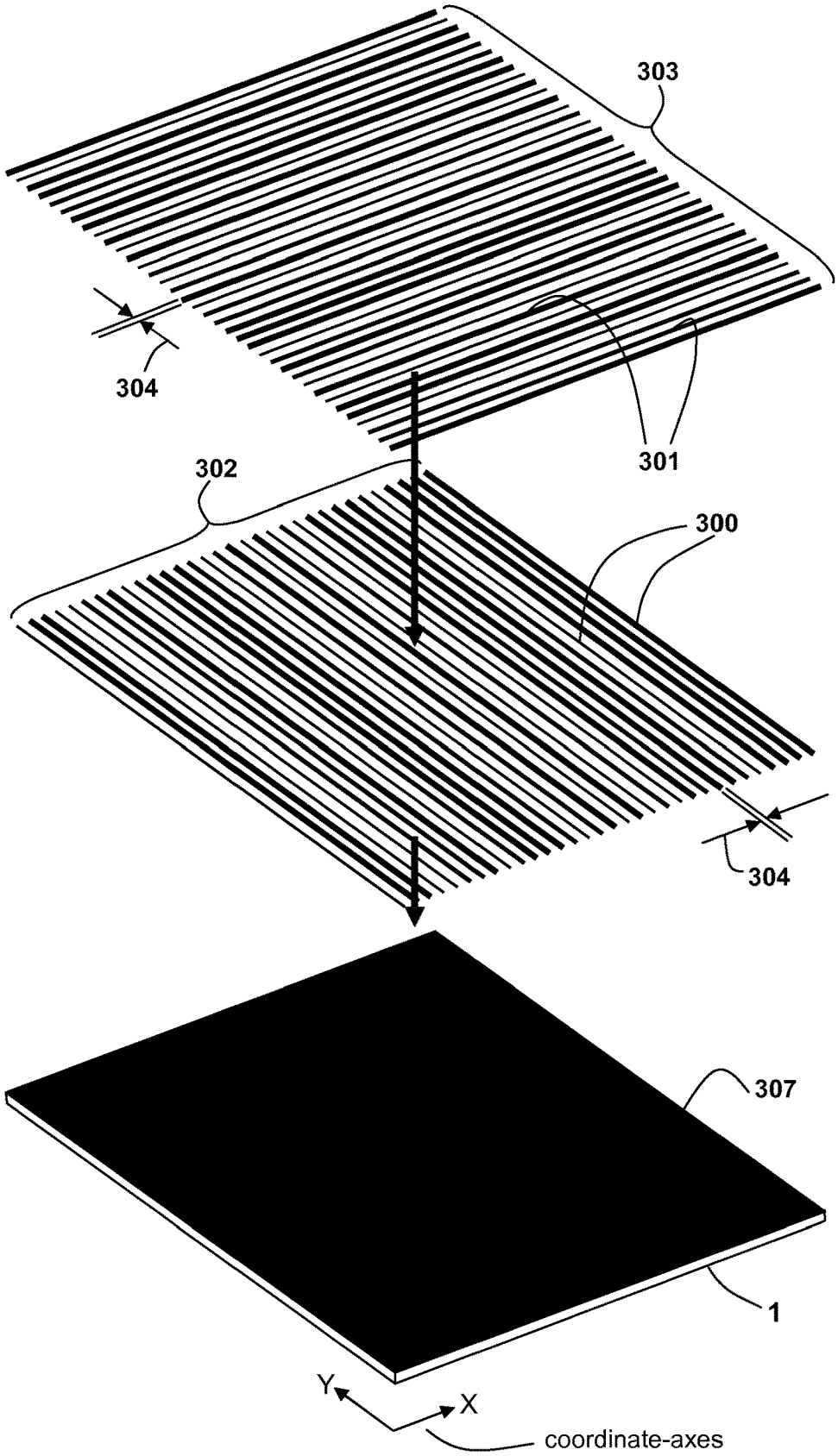
FIG. 17 is a diagram showing how two sets of orthogonal linear-elements can be overlaid to encode two coordinate axes. Note that the sequence encoding shown is illustrative only. It is not intended to represent the encoding of any particular sequence with any particular properties as may be required by the methods disclosed herein.

The surface 1 contains codes implemented as linear elements 300, 301, FIG. 17 extending across the surface 1. A set (sequence) 302 or 303 of such linear elements 300 or 301, separated by spaces and arranged in parallel across the surface 1, encodes a sequence of symbols. Because of this, these linear elements 300 and 301 are referred to as symbol-lines elsewhere in this document.

Clearly one sequence 302 (the x-lines), varying in one direction across the surface 1, only encodes one coordinate axis. For two-dimensional position sensing, a second sequence 303 (the y-lines) encoding a second coordinate axis is overlaid on, and orthogonal to, the first set 302 to form a grid, as shown in FIG. 17. The two sequences 302, 303 must be distinguished, so that the x-lines 300 and the y-lines 301 can be separately decoded in order to separately determine the position of a sensing point 4 on the x-axis and y-axis.

The symbol-lines 300, 301 may be sensed by the sensing-points 4 using effects such as capacitive, inductive, resistive, magnetic, electromagnetic, optical, photo-electric, thermal or electrostatic effects, or effects resulting from the linear elements being encoded as raised or indented areas on the surface 1. The symbol-lines 300, 301 may be formed of material deposited or printed on or in the surface 1, or may be formed of elements such as conductive wires that are attached to or embedded in the surface 1. The symbol value encoded in each symbol-line 300 or 301 may be encoded by varying some parameter of the symbol-line 300 or 301 in a manner that is sensible to the sensing-points 4. This parameter could, for example, be its magnetic flux density, its width, its reflectivity, and so forth. Alternatively, a group of symbol-lines 300, 301 could be used to encode a symbol, rather than using just one symbol-line 300 or 301. Or the symbol value may be encoded by measuring the time to transit a symbol-line 300 or 301 relative to the time to cross some reference symbol-line 300 or 301.

The sequence 302 or 303 of symbols encoded on the surface 1 is a windowing sequence, a.k.a. Pseudo Random Binary Sequence (PRBS), de Bruijn Sequence, or m-sequence. This has the property that every subsequence with a fixed length of W sequential symbols (a window, W>=1), is unique in the overall sequence 302 or 303 and thus has a unique location in that sequence 302 or 303. The symbols correspond to coordinates, so when the sensor passes over and senses a window of symbol-lines 300 or 301 the location of that window in the sequence 302 or 303, and thus the location of the sensor in coordinate space, can be determined.

Windowing sequences that can be oriented may be used for this system. These have the property that for every unique window in the sequence 302 or 303, the reverse of that window does not exist in the sequence 302 or 303. Thus when a window of symbols is sensed by the sensor, it will only match a sub-sequence in the sequence 302 or 303 when the sensor is moving forward relative to the coordinate axis. If the sensor is moving backwards, the sensed window of symbols must be reversed before a match in the overall sequence 302 or 303 can be found. This fact can be used to determine the direction of the sensor relative to the coordinate axis.

If the windowing-sequence 302 or 303 cannot be oriented, then some other method of providing orientation information must be used, as described later.

Without limiting the generality of the above, the preferred embodiments comprise a paper or plastic surface 1 printed with symbol-lines 300, 301 on a black background 307 on a surface 1, as shown in the general arrangement depicted in FIG. 17. The symbol-lines 300, 301 are rendered in a variety of widths 304, which encode the symbol values. Note the sequence of widths 304 shown in FIG. 17 are purely illustrative; they are not intended to represent any particular sequence, as required by the methods of this system. Two sequences 302, 303 (amongst many) that are suitable are provided by way of example in Appendix A—one with a window-length (W) of 6 symbols and an alphabet (K) of 3 symbols, and one with W=4 and K=5.

Figure 19:
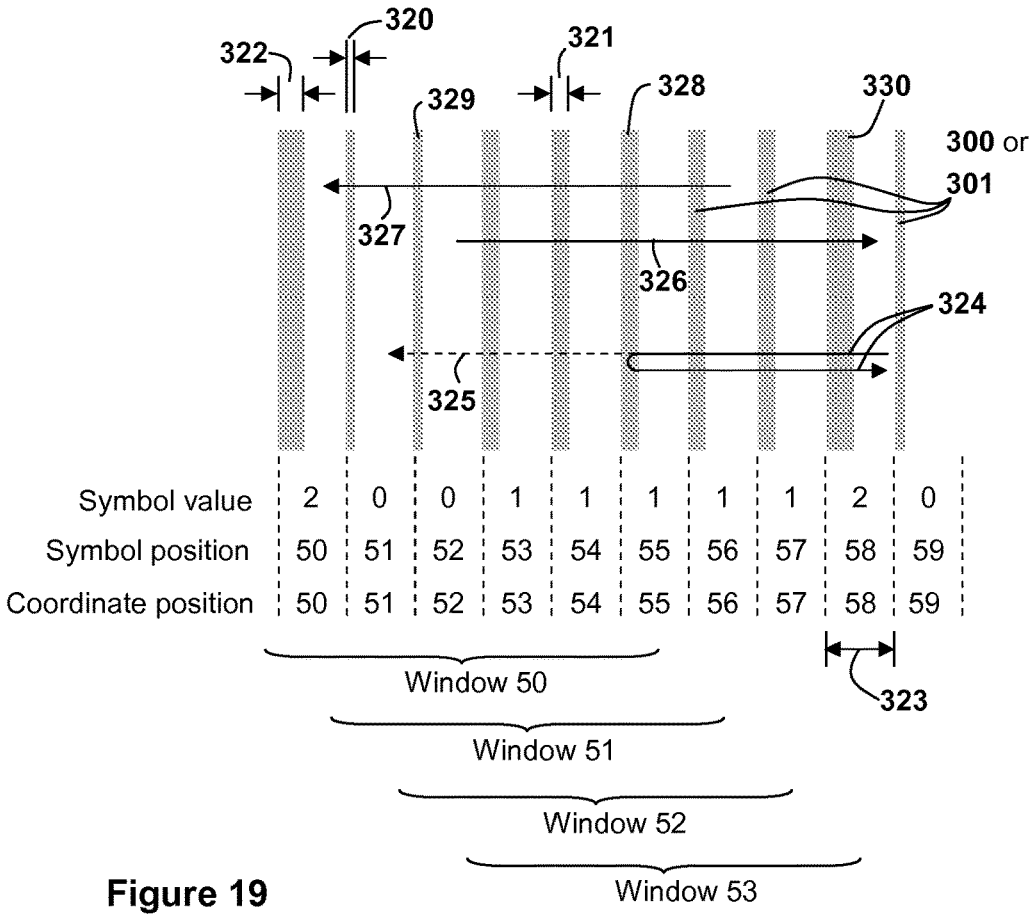
FIG. 19 shows how the symbol-lines 300 or 301 can be width encoded and demonstrates how windows of symbols encode coordinate positions. The background 307 is not shown.

By way of example, FIG. 19 shows an enlarged portion of a sequence 302, 303, which is taken from the first sequence in Appendix A with a window-length of W=6 symbols. This contains three conceptual symbol values ("0", "1", "2"), which are encoded using symbol-lines 300 or 301 of three widths, as indicated in the diagram by the dimensions 320, 321 and 322, respectively. Obviously, if more symbols are required in the alphabet then more widths are used.

The symbol-line 300 or 301 and its adjoining space (the symbol-area), indicated in total by dimension 323, represents the width of a coordinate on the surface 1, along an axis perpendicular to the symbol-line 300 or 301. The symbol-area width and thus the coordinate increment are usually, but not necessarily, fixed. Note the convention of placing the symbol-line 300 or 301 on the left (or top) side of the symbol-area. This arrangement will be assumed throughout all the descriptions that follow. The symbol-line 300 or 301 could equally be placed to the right (or bottom) and the algorithms updated to take account of this, as will be obvious to anyone skilled in the art.

Figure 20:
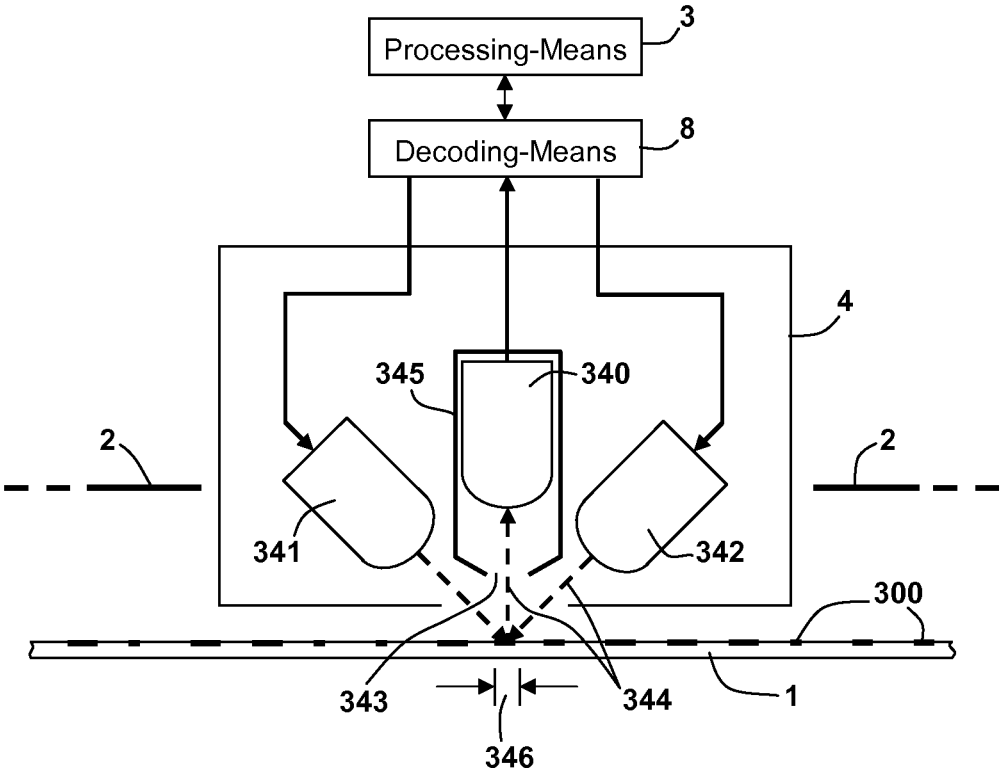
FIG. 20 is a diagram showing the key elements of the sensing-point 4 (not all features are necessarily shown)

Turning now to the diagram in FIG. 20, this shows a cross-sectional close-up of a sensing-point 4 in the base 2 of a movable-object supported by some means (not shown) over the surface 1. The sensing-point 4 comprises an energy-sensor 340 (such as a photo-diode or photo-transistor) and energy-sources 341 and 342 (such as light-emitting-diodes (LEDs)). The movable object may be the toy described elsewhere in this document, or it may be a stylus used for entering coordinate data into a computer, or any other device that requires positioning capability.

The energy-sources 341, 342 illuminate the lines 300 (only x-lines 300 are shown, however the same holds true for y-lines 301), which reflect, absorb or fluoresce (return) radiation back to the sensor 340 via an aperture 343 or lens, along a path illustrated by the dashed-arrows 344. The aperture 343 or lens and a shroud 345 is designed to limit the radiation reaching the energy-sensor 340, so that it only receives radiation returned from a small portion (the sensing-area) of the surface 1.

The diameter 346 of the sensing-area is designed to be slightly less than the thickest symbol-line 300 or 301 (e.g. the "2" symbol 322 in FIG. 19) and larger than the thinner symbol-lines 300 or 301 (e.g. the "0" symbol 320 and the "1" symbol 321). As the energy-sensor 340 passes over a symbol-line 300 or 301 the maximum output of the sensor 340 occurs when the sensing-area is central over the symbol-line 300 or 301. This maximum output is a function of the returned radiation passing through the aperture 343 at that point, which in turn is a function of the symbol-line's 300 or 301 thickness (e.g. 320, 321 or 322, generally designated 304 in FIG. 17) relative to the sensing-area diameter 346, which in turn is a function of the symbol value encoded by the symbol-line 300 or 301.

Thus by detecting the maximum output of the sensor 340 as it passes over a symbol-line 300 or 301, the symbol value encoded by that symbol-line 300 may be deduced. In order to be sure the maximum output has been reached, the system waits until the sensing area has moved off the symbol-line 300 or 301. In order for the sensor 340 to properly detect when it has moved off a symbol-line 300 or 301, the intervening space between lines 300 or 301 should be at least as large (or only slightly less than) the diameter 346 of the sensing-area.

The x-lines 300 and y-lines 301 are distinguished by rendering them in a first and second material. The first material returns radiation as a result of stimulation by a first wavelength (called the material's characteristic wavelength) of radiation from a first energy-source 341 and the second material returns radiation as a result of stimulation by a second characteristic wavelength of radiation from a second energy-source 342. Neither returns significant levels when stimulated by radiation of the other's characteristic-wavelength. Thus by alternately energising the energy-sources 341 and 342 the sensor 340 is able to separately sense the x-lines 300 and y-lines 301.

By way of example, in a preferred embodiment the x- and y-line sets 302, 303 are distinguished by colour; one set 302 being printed in red, the other 303 in blue. Two corresponding red and blue LEDs 341, 342, whose wavelengths match the wavelengths of light reflected by the x-line 300 and y-line 301 colours, are mounted in the base 2 of the movable object.

The background 307 of the surface 1 is black, so that when the red LED 341 is illuminated and the blue LED 342 is off, the red lines 300 reflect the red light while the blue lines 301 and the black background 307 both absorb the red light, making the blue lines 301 'disappear' into the black background 307. Conversely, with the blue LED 342 illuminated and the red LED 341 off, the blue lines 301 reflect the blue light and the red lines 300 disappear.

Of course, if the background 307 of the surface 1 was white, then the effect is reversed and the reflecting lines 300, 301 are the ones that 'disappear'. In such an embodiment the sensor 340 output is a maximum when the sensing-area is over a space. So it is the minimum output from the sensor 340, as it crosses a symbol-line 300 or 301, that is used to decode the value of the symbol encoded by the symbol-line 300 or 301. For the purposes of the following text, unless otherwise stated it should be assumed that the background 307 is black, though for clarity this may not always be shown in diagrams of the symbol-lines 300 or 301.

Where the text talks of the sensor 340 sensing, 'seeing', decoding, crossing, transiting or otherwise moving over or detecting a symbol, it should be understood to mean the sensor 340 moving over a symbol-line 300 or 301 and decoding the symbol value in that symbol-line 300 or 301.

The output of the sensor 340 is fed to the decoding-means 8, as shown in FIG. 20. This is under the control of the processing-means 3, which causes it to alternately illuminate the LEDs 341 and 342 and to digitise the output from the sensor 340, while each LED 341 or 342 is illuminated. As previously described the output from the sensor 340 is used to decode the values of the symbols that the sensor 340 passes over. These symbol values are then used by the processing-means 3 to determine the sensing-point's 4 position, speed and path over the surface 1 and, if two sensing-points 4 are provided, to determine the orientation of the movable object about a vertical axis, in relation to the surface 1.

The decoding-means 8 will typically contain circuitry to alternately switch power to the energy-sources 341, 342 and to sample, amplify and condition the output of the sensor 340 (e.g. using a sample-and-hold amplifier (SHA)). The output of the SHA is then digitised using a crude analogue-to-digital converter able to resolve the symbol value levels (three in this example). The decoding-means 8 may be part of other components, such as the processing-means 3.

Figure 21A:
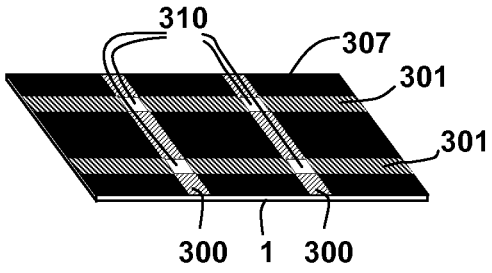
FIGS. 21(*a*) and (*b*) are diagrams showing how squares 310, rendered in a third material, may be used to solve the crossing problem whereby foreground linear-elements 301 or 300 obscure background linear-elements 300 or 301.
Figure 21B:
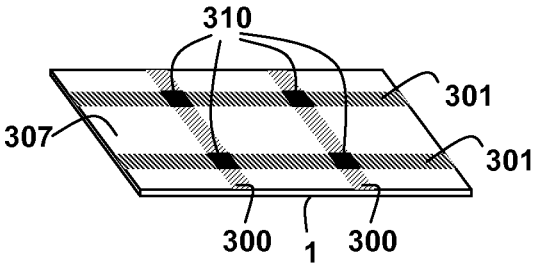

In the same or other embodiments, the symbol encoding may be visible or invisible to the eye. If the symbol coding is visible, then there is a problem in that the foreground lines 301 obscure the orthogonal background lines 300, at the point where the lines 301 and 300 cross. Obviously this does not apply if the foreground coding is transparent to the effects of the background coding, as sensed by the sensing-point 4. The solution is simply to place a square 310 of a third material at the intersection of the lines 300 and 301, as shown in FIGS. 21(*a*) and (*b*). Said third material is chosen such that: a) when stimulated by the characteristic-wavelength of radiation of the first material used for one symbol-line set 302, it returns radiation to approximately the same degree as the first material; and b) when stimulated by the characteristic-wavelength of radiation of the second material (used to render the second symbol-line set 303), it returns radiation to approximately the same degree as the second material. This ensures that when the sensing-area is over the intersection of the lines 300 and 301, the sensor 340 will 'see' both lines 300 and 301, irrespective of which energy-source 341, 342 happens to be energised.

Using the example of coloured lines 300, 301 given earlier, if the background 307 is black (FIG. 21(*a*)) then a suitable colour for the square 310 would be white or light grey. If the background 307 is white (FIG. 21(*b*)) then a suitable colour for the square 310 will be black or dark grey. Alternatively, if the colours for the symbol-line sets 302 and 303 are rendered in less than 50% density, then the square 310 may be created by combining pixels from each symbol-line 300, 301 such that the pixels do not overlap but are interspersed amongst each other.

In some embodiments one broadband energy-source (e.g. white light), containing both materials' characteristic wavelengths, is used instead of two, alternately illuminated energy-sources 341 and 342. Two sensors are provided each preceded by a filter that filters out one or other of the returned wavelengths. In this implementation the filters provide the means of discriminating between the simultaneous x-line 300 and y-line 301 responses.

In some embodiments, the energy-sources 341, 342 illuminating the surface 1 may be advantageously modulated at some frequency. Using a high-pass or notch-filter, the sensing-points 4 would then be able to filter out light at that frequency, thereby excluding ambient light that may otherwise seep into the sensor 340.

In some embodiments, a higher threshold is used when the sensor 340 is moving onto a symbol-line 300 or 301, and a lower threshold when the sensor 340 is moving off. This introduces hysteresis into the digitisation process thereby preventing problems when the sensor 340 is sitting over the edge of a symbol-line 300 or 301, and the sensor's 340 output is on the digitisation threshold between seeing no symbols, and seeing a '1' symbol. In such a position, the decoding-means 8 output may oscillate between the two states, leading the processing-means 3 to incorrectly conclude that multiple symbol-lines 300 or 301 have been crossed. Obviously for it to be able to use the correct threshold, the system must remember if the sensor 340 was previously over a symbol-line 300 or 301 or if it was previously over a space.

It is to be understood that the surface 1 does not have to be flat and the symbol-lines 300, 301 do not have to be straight, or parallel within each pattern 302 or 303, or orthogonal between patterns 302 and 303, or limited only to two patterns 302 and 303. All that is required is that there are at least two patterns 302, 303 of sufficient symbol-lines 300, 301, covering a sufficient part of the surface 1 to meet the positioning needs of the particular application of this Position Sensing System, and sufficiently angled one pattern 302, 303 to another so as to be usable for two dimensional positioning on the surface 1.

Similarly, the patterns 302, 303 of symbol-lines 300, 301 can be representative of relative coordinates or Cartesian coordinates or of Polar coordinates or of any other coordinate or mapping system that is suited to the particular requirements of the application and the shape of the surface 1.

Figure 22A:
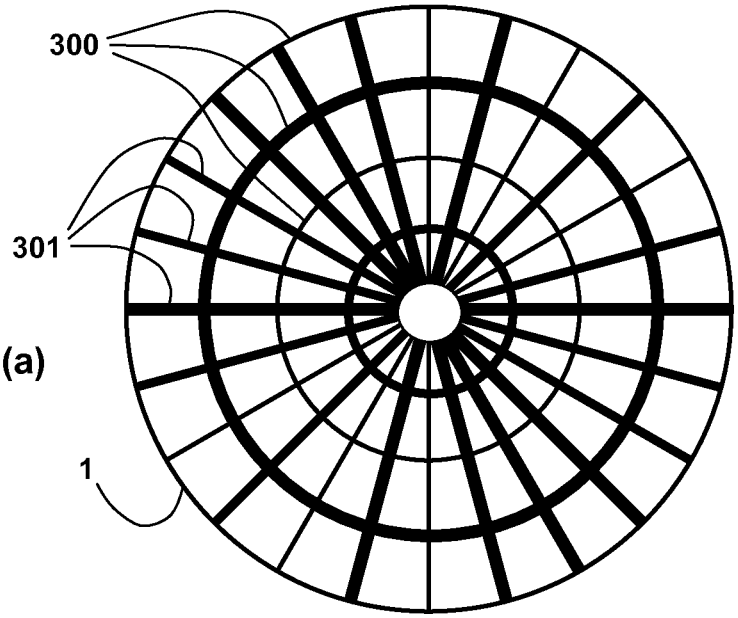
FIGS. 22(*a*), (*b*) and (*c*) illustrate alternative layouts of the symbol-line sets 302 and 303 and alternative shapes for the surface 1. Note that the sequence encoding shown is illustrative only. Crossing squares 310 and background 307 are not shown.
Figure 22B:
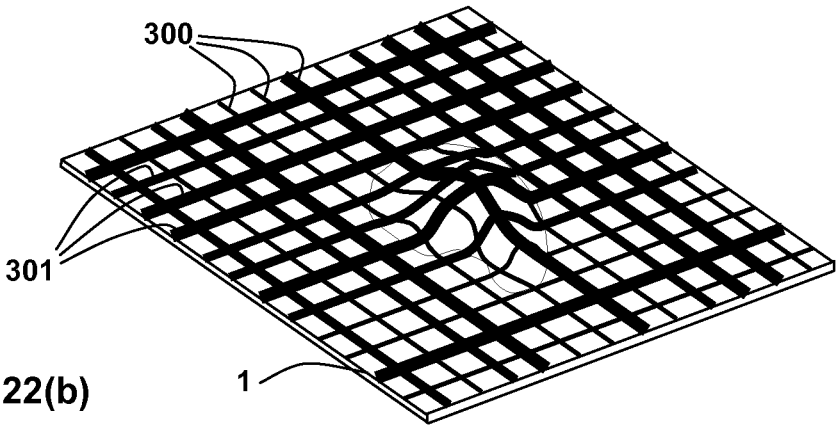
Figure 22C:
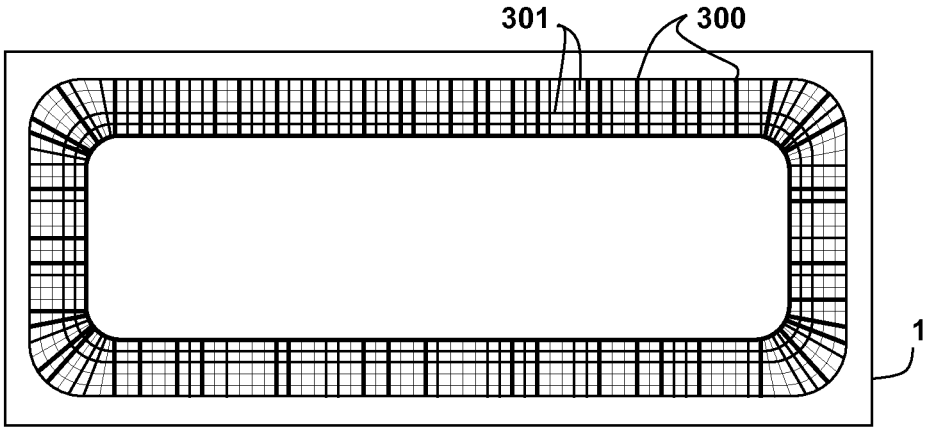

Examples of alternative symbol-line 300, 301 arrangements and surface 1 shapes include, but are not limited to, those shown in FIGS. 22(*a*), (*b*) and (*c*). These show alternative arrangements of two patterns 302, 303 of symbol-lines 300, 301 on flat and shaped surfaces 1. FIGS. 22(*a*) and (*b*) show the encoding applied to the whole surface 1; FIG. 22(*c*) shows it applied to a track on the surface 1. It will be clear to anyone skilled in the art that all the descriptions that follow can be applied to any number of patterns 302, 303 of symbol-lines 300, 301 formed in these or any other ways.

Operation

Note that in all the discussions to follow only the output of one sensor 340 is considered. If there are two sensing-points 4 then the output of each sensor 340 is treated in exactly the same way (though see the discussion on combining sensor 340 paths earlier in this document).

Figure 23:
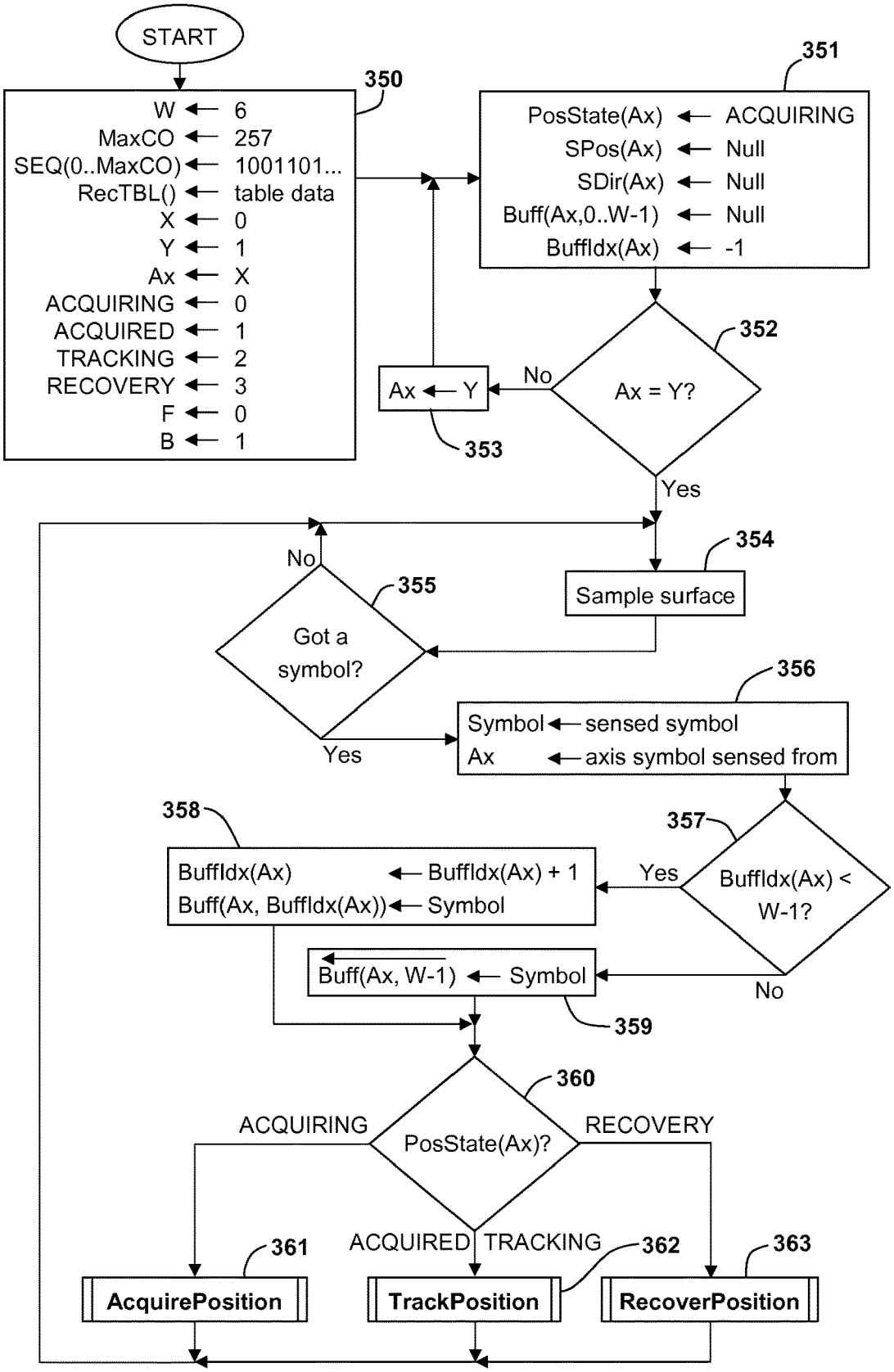
FIG. 23 is a flowchart showing the initialisation and operation of the main program loop within the position-sensing system.

FIG. 23 provides a flow-chart of the initialisation and main program loop for this Position Sensing System. The system begins in step 350 by initialising the constants ACQUIRING, ACQUIRED, TRACKING, RECOVERY, F (meaning Forward) and B (meaning Backward). These are used to aid understanding in the description and flow-charts; their value is not important so long as it is distinct.

Step 350 also defines the constants W, MaxCO and the constant array SEQ( ). W defines the window-length (=6) used in this example and MaxCO defines the maximum coordinate encoded by the system. In this case, coordinates from 0-257 are encoded using the symbol sequence that is stored in the constant array SEQ( ). In this example the same orientable-windowing sequence in SEQ( ) is used to encode the symbol-line sets 302 and 303 for both axes. It uses three symbol values ("0", "1" and "2"), has a window length W=6, and is given in full by the first sequence shown in Appendix A.

As described earlier, in the flow-charts statements of the form: name←expression, indicates the variable or constant name is loaded with the value of the expression that follows the arrow. Also, a variable or constant name followed by brackets indicates the variable or constant is an array (i.e. a list) of variable or constant values, as was defined earlier.

Note that a range of elements in an array is specified by an index range. Thus an expression of the form ArrayName (i1 . . . i2) indicates the range of values in array ArrayName from index i1 to index i2 inclusive.

Some arrays have multiple indexes or dimensions. For example AnotherArray(x, y, z) has three dimensions. These are mapped to a single list by converting the three indexes to a single index using the formula: single-index=x*Ny*Nz+y*Nz+z, where Nz and Ny are the maximum number of possible z and y values, respectively. An example of such an array is the constant array RecTBL( ), which has four indices. These indices and the data used to initialise RecTBL( ) in step 350 will be described later.

Symbols sensed from the x-lines sequence 302 and from the y-lines sequence 303 are processed in exactly the same way by the same routines. To facilitate this, a number of arrays have a 2 element index whose value is provided by the variable Ax (meaning axis). Ax is set using the constants X and Y, which are also defined in step 350. Ax is used to effectively split the array in two, with half the array being used to store data pertaining to the decoding of positions from the x-axis, and half to store data for the y-axis. Thus by simply changing the value of Ax, the system can use the same routines to decode positions for each axis.

Ax is set to X in step 350 and this value is used to initialise the X part of the two part arrays PosState( ), SPos( ), SDir( ), Buff( ) and BuffIdx( ) in step 351. Steps 352, 353 and 351 then cause the Y part of the same variables to also be initialised.

PosState( ) is used to control the operation of the system and may have one of the four constant values: ACQUIRING, ACQUIRED, TRACKING or RECOVERY. As the first task is to acquire a position, it is set to ACQUIRING for both axes in step 351. SPos( ) and SDir( ) hold the sensor-position and direction for each axis. As these are as yet unknown they are set to Null in step 351.

Buff( ) contains two arrays used as buffers—which buffer is selected is indicated by the value of its Ax index, as previously explained. One buffer holds the last W or less symbols sensed from the x-lines sequence 302 and the other holds the last W or less symbols sensed from the y-lines sequence 303. BuffIdx( ) contains an index for the last sensed symbol saved in each axes' buffer in Buff( ). As no symbols are stored in either buffer, BuffIdx( ) is set to −1 for both axes in step 351.

Once both the x- and y-part of these arrays are initialised step 354 causes the decoding-means 8 and sensing-points 4 to separately sense the x-lines 300 and y-lines 301 on the surface 1. As described earlier, the system waits until the sensing-area has moved off a symbol-line 300 or 301, before attempting to decode it. Step 355 tests if this has happened. If it hasn't control passes back to step 354 and the system continually and separately senses x-lines 300 and y-lines 301 until a symbol-line 300 or 301 is crossed and a symbol value determined. At this point step 355 will test positive and step 356 will save the value of the sensed symbol in the variable Symbol. It also saves the coordinate axis of the symbol-line set 302 or 303 that the symbol was sensed from, in the variable Ax.

Step 357 then checks if BuffIdx( ) for the symbol's axis (in Ax) is less than W−1, indicating the buffer in Buff( ) for that axis is not yet full. If that is the case, step 358 increments BuffIdx( ) and uses it to store the symbol value in Symbol in the next available element in the Buff( ) buffer for that axis. Thus the first symbol sensed will be stored in Buff(Ax, 0), the second symbol in Buff(Ax, 1) and so on.

However, if BuffIdx( ) is already pointing at the last ($W-1^{th}$) element in Buff( ) for that axis, then the buffer is full and control passes to step 359. As indicated by the arrow above the array name Buff( ) this shifts the new Symbol value into the Buff( ) for the axis. By shifts it is meant that each element in Buff( ) is copied to the element to its left (i.e. Buff(Ax, 0)=Buff(Ax, 1); Buff(Ax, 1)=Buff(Ax, 2); and so on). This causes the oldest value previously in Buff(Ax, 0) to be discarded and clears space in the last element Buff(Ax, W−1) so that the newly sensed symbol value can be stored in that element. This is known as a FIFO (first-in, first-out) structure and will be familiar to anyone skilled in the art.

Step 360 then tests the value of PosState( ) for the current axis (in Ax) and, according to its value, control is passed to one of three routines: AcquirePosition 361, TrackPosition 362 and RecoverPosition 363. The function of each of these routines is explained in the following sections. To be clear, step 360 passes control to the TrackPosition 362 routine if PosState( ) equals ACQUIRED or TRACKING.

Note that the flow-charts shown have been simplified to make their essential functions clear. Anyone skilled in the art will see enhancements may be made. For example, when the system is first started the sensor 340 may be already over a symbol-line 300 or 301. It's possible that it will then be moved off that symbol-line 300 or 301 without ever 'seeing' enough of the symbol-line 300 or 301 to properly decode its symbol value. The initialisation step 351 may test for this and set a flag if the condition exists. This flag can then be used by the system to disregard the first symbol-line 300 or 301 'crossed', as it will be uncertain of its value.

Acquisition

Figure 24:
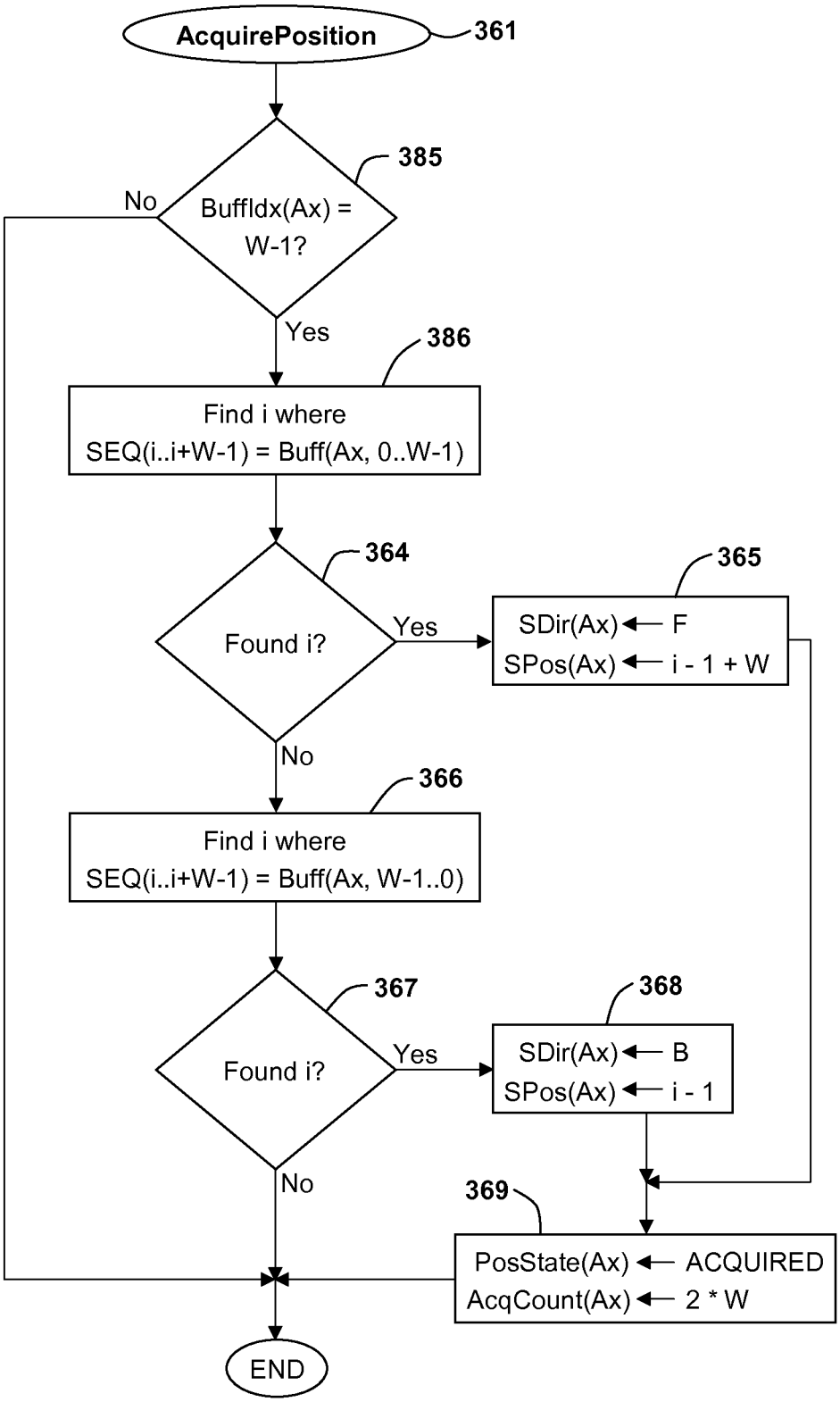
FIG. 24 is a flowchart showing the operation of the AcquirePosition 361 sub-routine.

PosState( ) is initialised to ACQUIRING for each axis in step 351. Thus step 360 passes control to the AcquirePosition 361 routine shown in FIG. 24. Step 385 checks if Buff( ) is full for the axis being processed (i.e. BuffIdx( )=W−1). If not the routine returns and control passes straight back to step 354 where the cycle restarts.

If a window (W) of symbols have been sensed from this axis, then Buff( ) will be full and control will pass to step 386. This searches the symbol sequence in SEQ( ) for a sub-sequence that matches the sub-sequence in Buff( ) for the axis.

Note that the sequence in SEQ( ) matches the symbol-line sequence 302 or 303 when read in a left-to-right direction (x-axis) or a bottom-to-top direction (y-axis). The surface 1 coordinates increase in these directions, so the origin (0, 0) is in the bottom left-hand corner of the surface 1. Thus if in step 386 a matching sub-sequence is found, then it must have been read into Buff( ) in the same order as it appeared in SEQ( ) so the sensor 340 must have been moving forward over the sequence 303 or 303 (i.e. from left-to-right or bottom-to-top). So if step 364 detects a match was found then step 365 sets SDir( ) for the current axis to the value of the constant F to indicate the sensing-point 4 is moving forward in relation to the axis.

However, if no match is found then step 366 causes SEQ( ) to again be searched but for a sub-sequence that matches the reverse of the sub-sequence in Buff( ) for the current axis. If a match is now found step 367 passes control to step 368, which sets SDir( ) to B to indicate the sensor 340 is moving backward relative to the axis.

By convention in the preferred embodiment the position of the window in the sequence 302 or 303 provides the coordinate of the left-most (or top-most) symbol in the window, as illustrated in FIG. 19. The first window-length (W=6 in this example) of symbols shown represent window number 50, which decodes to provide coordinate 50 for the left-most symbol in the window. Similarly window number 51 decodes to provide coordinate 51 for the symbol at the left of window 51, and so forth.

Note also that, if there are L symbol-lines 300 or 301 across the surface 1, then the last W symbols encode coordinate position L-W. As such, the last W−1 coordinate positions do not have a corresponding encoding window.

This does not matter as the tracking routine simply increments or decrements the sensor-position SPos( ) for an axis as it moves forwards or backwards, respectively, across symbol-lines 300 or 301 on that axis.

The index of the matching sub-sequence in SEQ( ) can thus be used to determine the sensor-position. For example, if the sensing-point 4 moves backward over the surface 1 along the path indicated by the arrow 327 (FIG. 19) it will cross the W symbols in Window 51 and will be in coordinate position 50. So its position can be derived from the window number (=51) of those W symbols less one (=50).

However, if it has moved forwards over the surface 1 along arrow 326 then it will have sensed W symbols from Window 53 and be in coordinate position 58. So its position can be derived from the window number (=53) of those W symbols plus the window-length W (6 in this example) less 1 (53+6−1=58). These equalities are used to set the sensor-position SPos( ) in steps 365 or 368, according to whether the sensor 340 is moving forwards or backwards.

Now the sensor-position and direction have been found, the system can switch PosState( ) for this axis to TRACKING, provided it is confident the first W symbols were sequentially sensed with the sensor 340 travelling in the same direction (i.e. they are a true window of symbols).

In embodiments such as the preferred one, where the movable-object is hand-held, this cannot be guaranteed; the user may reverse the direction of movement of the sensor 340 any number of times. Additionally, if the sensor 340 is lifted slightly, or if there is dirt on the surface 1, then symbol-lines 300 or 301 may be incorrectly read (herein these are called bit-jumps and bit-errors, respectively). As such the first W symbols sensed could, for example, be from W/2 symbol-lines 300 or 301 that, because of a reversal, were sensed twice. The random window formed by these reversals and sensing-errors may well match a sub-sequence in SEQ( ) but the position decoded from the index of that sub-sequence would, of course, be wrong.

Obviously the longer the sub-sequence that must be matched (in other words the more symbol-lines 300 or 301 the sensor 340 must cross in the same direction), the less likely it is that the sub-sequence will be matched as the result of random reversals, bit-jumps or bit-errors. For example, in a sequence 302 or 303 of length L symbols, there are L−N+1 sub-sequences of length N. If N>=the window-length W then those N length sub-sequences will all be unique, because they will each start with a unique window of W symbols. As such the probability of randomly generating one of those valid (i.e. that exists in the sequence 302 or 303) N length sub-sequences is (L−N+1)/(K^N), where ^ means 'to the power of' and K is the number of symbols in the alphabet used (so K^N is the total number of possible N length sub-sequences). Thus the probability of randomly generating a valid N length sub-sequence decreases with increasing N, according to a power law.

In actual fact lower value symbols are more likely than higher value ones because they can be caused by reversals on higher value symbols. Thus sequences generated by random reversals would only match those parts of the overall sequence 302 or 303 that happened to have the same skewed distribution of lower value symbols. So the probability of a valid N length sequence is actually less than given above.

The example illustrated in the flow-charts requires 3*W=18 contiguous symbols to be crossed in the same direction, before the acquired position is accepted. Using the above treatment, this gives the probability of getting a false position from random reversals of at most, roughly, 1 in 1.7 million (W=6, N=18, K=3, L=240). In another embodiment, K=5 symbols are used in the sequence 302 or 303 alphabet (see the second sequence shown in Appendix A). In this embodiment, only 12 symbols need be crossed to give a comparable probability of getting a false position of roughly 1 in 1.1 million (N=12, K=5, L=240); or 13 symbols could be specified to give a probability of 1 in roughly 5.4 million.

So, in the current example, once a matching sub-sequence has been found for the first W symbols sensed, step 369 sets PosState( ) for the current axis to ACQUIRED and sets up a counter variable AcqCount( ) for the axis with the value 2*W. This will be decremented for each of the next 12 symbols and if they match the next 12 symbols expected for the sensing-point's 4 assumed direction, then the position will be confirmed and the system will switch to TRACKING.

The routine then ends and control passes back to step 354 where the main loop restarts. Once the next symbol is sensed from this axis, step 360 will see that PosState( ) is set to ACQUIRED and control passes to the TrackPosition 362 routine, described next.

Tracking

Figure 25:
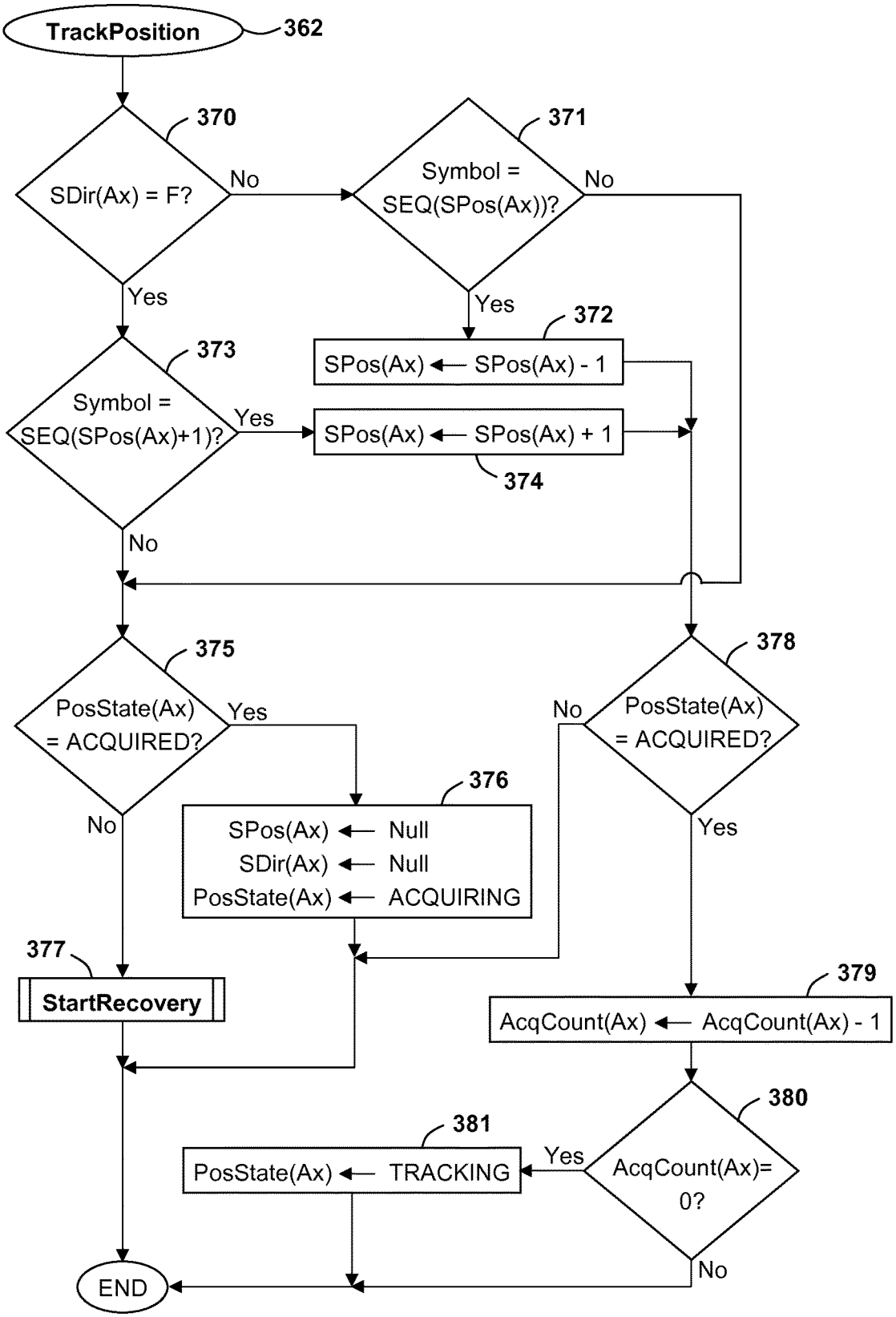
FIG. 25 is a flowchart showing the operation of the TrackPosition 362 sub-routine.

When the TrackPosition 362 routine is called, step 370 (FIG. 25) tests the direction of the sensor 340 in SDir( ) for this axis. If it is F (forward), then the symbol-line 300 or 301 just sensed should be the symbol-line 300 or 301 to the right of the old sensor-position in SPos( ) which is the symbol-line 300 or 301 in the next coordinate position (see FIG. 19). As such step 373 tests if the sensed symbol (in Symbol) is equal to the symbol in the next coordinate position in SEQ( ) (i.e. in SEQ(SPos(Ax)+1)). If it is then step 374 increments the sensor-position in SPos( ) for the axis.

If however step 370 detected that the sensor-direction in SDir( ) was B (backward) then the symbol just sensed should be the symbol-line 300 or 301 to the left of the old sensor-position, which is actually the symbol-line 300 or 301 in that coordinate position (see FIG. 19). Thus step 371 tests if the sensed symbol in Symbol is equal to the symbol at SEQ(SPos(Ax)). If it is step 372 decrements the current sensor-position in SPos( ) for the axis.

Assuming the symbols match and SPos( ) is successfully updated, step 378 then tests if the system is still confirming the acquisition of a position (i.e. PosState( )=ACQUIRED for the axis). If not (i.e. PosState( )=TRACKING) then the TrackPosition 362 routine returns and the main loop restarts at step 354. If it is then the AcqCount( ) counter variable (set up in the AcquirePosition 361 routine for this axis) is decremented in step 379 and step 380 tests if it has reached zero. If it has then the acquired position is confirmed and step 381 sets PosState( ) for this axis to TRACKING. In either event the routine now exits and the main loop restarts at step 354.

Once the system has switched to TRACKING the TrackPosition 362 routine can be used to update the path of the sensor 340 (if the path is being captured) by saving the new sensor-position every time it is updated in steps 372 or 374. Though not shown in the flow-chart it will be clear to anyone skilled in the art that by storing these various positions along with the time those positions were reached, the system is able to record the path, acceleration and speed of the sensing-point 4 over the surface 1. Similarly, by comparing the positions reported by two separate, spaced apart sensing-points 4 on the movable device, the system is able to determine the orientation of the movable device about an axis perpendicular to the surface 1

If in steps 371 or 373 the sensed symbol did not match the expected symbol then tracking has failed and step 375 tests if PosState( ) equals ACQUIRED. If so the previously acquired position and direction are rejected in step 376 and the system reverts to Acquisition mode by setting PosState( ) equal to ACQUIRING. The TrackPosition 362 routine then returns and the next time a symbol is sensed from this axis the acquisition process restarts, as has already been described.

If the sensed symbol did not match but the system was tracking (i.e. PosState( )=TRACKING) then step 375 will fail and the StartRecovery 377 routine is called. This switches PosState( ) to RECOVERY and sets up the recovery data-structures, as is now described.

Error Recovery

In the prior-art to-date (as far as the author is aware) there has been no satisfactory solution proposed for handling sensor-reversals, bit-jumps and bit-errors. U.S. Pat. No. 5,442,147 describes a system that forms hypotheses about where all reversals may have occurred (it does not handle bit-jumps and bit-errors). However, this system requires a first reversal to have been dealt with before another reversal can be handled, otherwise its data-storage requirements grow geometrically with each reversal, according to a power law. If multiple reversals do occur then the path is lost and the system restarts position acquisition.

The following method provides a novel, efficient and highly-robust solution to this issue that is capable of tracking the most likely path of the sensor 340 through multiple reversals, bit-errors and/or bit-jumps, with limited memory requirements.

At the heart of the method are two data-structures, one of which is the recovery tree for the axis in recovery. Called the RecTree( ) this array provides a very efficient (in terms of memory usage) means of tracking the most likely paths the sensor 340 may have taken to all the possible positions it can be in. If the path of the sensor 340 is not required (i.e. only position is being tracked) then the RecTree( ) can be dispensed with. However, it will be included in the discussions that follow, as it makes understanding of the method clearer.

The RecTree( ) is structured into layers, with a new layer being created every time a new symbol is sensed from the axis in recovery associated with the RecTree( ). Each layer is divided into elements, which represent each of the coordinate positions the sensor 340 might be in as a result of all the symbols sensed up to that layer. The RecTree( ) thus has three indices, which are written in the form RecTree(a, l, e). a specifies which axis the tree is for and is usually provided by the Ax variable. l specifies which layer in the tree for axis a is being referenced and is usually provided by the Layer( ) array, which holds the last layer number for each axis that is in recovery. e specifies which element, in the layer l, is being referenced.

The other data-structure is the Scores( ) array. This corresponds with, and so has the same number of elements as, the last layer in the RecTree( ) Like that last layer, each element in Scores( ) represents each of the possible positions the sensor 340 might now be in.

Each Scores( ) element contains three variables: CScr, MSCnt and NDir which measure, for the position represented by their element, the likelihood of the sensor 340 being in that position (CScr and MSCnt) and its likely direction (NDir) when it leaves that position, as will be explained. The Scores( ) array is used to determine when the likelihood of one path in the RecTree significantly exceeds all other paths. When this happens the position of the sensor 340 (and its most likely path, if required) is recovered and the system re-enters tracking mode for that axis.

Because the Score( ) array is only associated with the last (most recent) layer in the RecTree( ) it only has two indices that may be written: Scores(a, e). Again, a specifies the axis the scores are for and e specifies the element in the last layer that the score relates to. When a particular variable in the Scores( ) array is referenced it will be written in the form Scores( ).varname. For example, Scores(X, i).CScr references the CScr variable in the $i^{th}$ element of the Scores structure for the x-axis.

StartRecovery

Recovery is started by the TrackPosition 362 routine calling the StartRecovery 377 routine, when the last sensed symbol does not match the expected symbol, as described earlier. The StartRecovery 377 routine (FIG. 26) begins by setting PosState( ) for this axis to RECOVERY in step 390. The previous sensor-direction in SDir( ) is then tested in step 391 and depending on the direction, steps 392 or 393 set up LastGdPos( ).

LastGdPos( ) is the last-good-position that the system can be reasonably sure the sensor 340 was in, on this axis. It can determine this because, in an orientable windowing sequence of window length W, there cannot be more than W−1 consecutive symbols that are symmetrical (because if there were W consecutive symbols that were symmetrical, then the window of W symbols would be equal to the reverse of itself. This is not allowed in an orientable sequence). By symmetrical it is meant sequences such as 123321 if W is even or, if W is odd, 22322.

Consider what happens in an extreme case, when the sensor 340 reverses halfway through W−1 symbols that are symmetrical because they are the same. For example, the arrow 324 in FIG. 19 illustrates the sensor 340 path when it reverses half-way across the sequence " . . . 2111110 . . . " in an orientable windowing sequence with a window-length (W) of 6 symbols.

Though it has reversed on the "1" symbol 328 in coordinate position 55, because a "1" was sensed and expected the system assumes the sensor 340 is continuing in the same right-to-left (backwards relative to the axis) direction along the path indicated by the dashed-arrow 325. As a result it assumes the sensor 340 is now in coordinate position 54, when actually the sensor 340 is now going forward relative to the axis along the return part of path 324 and is in position 55.

The sensor 340 then crosses and senses the "1" symbols in coordinate positions 56 and 57 to arrive in position 57. The tracking system, which was expecting the "1" symbols in coordinate positions 54 and 53, assumes the sensor 340 is continuing along the path 325 and is now in position 52! Because the system senses the symbols it is expecting, the error is not discovered until the "2" symbol 330 in position 58 is crossed. As the system expected the "0" symbol 329 in position 52, an error is generated and recovery starts.

Note that the last-good-position in this case is coordinate position 55 before the reversal on the middle symbol 328. The last position that the system thought it was in before the "2" symbol was sensed (i.e. the value of SPos( ) at the time the error is detected) is position 52. Thus to calculate LastGdPos( ) the system adds 3 to SPos( ) in step 392 if the sensor 340 was (assumed to be) going backwards or subtracts 3 in step 393 if it was going forward.

In the general case for any sequence with window-length W, the amount to be subtracted or added is Int(W/2), as shown in the flow-chart (where Int(x) is defined as returning the integer part of x). The number of symbols that have passed since the last-good-position (including the just sensed symbol that caused the error to be detected) is one more than this, i.e. Int(W/2)+1.

Steps 392 and 393 also record, in the NDir variable in the $0^{th}$ element of Scores, the direction the sensor 340 was assumed to be travelling (in SDir( ) when it entered the last-good-position. This $0^{th}$ element of Scores corresponds to the $0^{th}$ element in layer 0 of the RecTree( ).

Figure 27A:
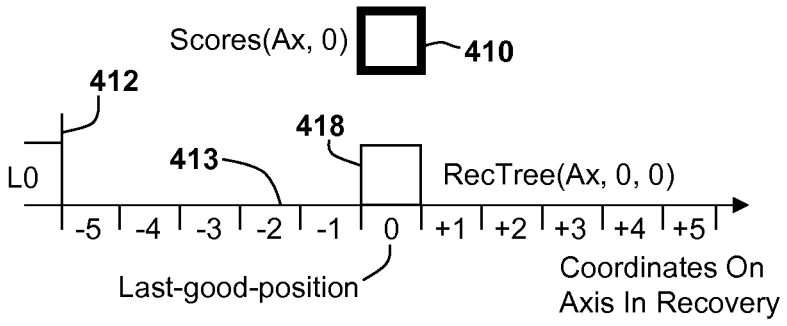
FIGS. 27(*a*), (*b*) and (*c*) are diagrams illustrating the structure and meaning of the Scores( ), RecTree( ) and NewScrs( ) data-structures used by the StartRecovery 377 and RecoverPosition 363 sub-routines within the position-sensing system.
Figure 27B:
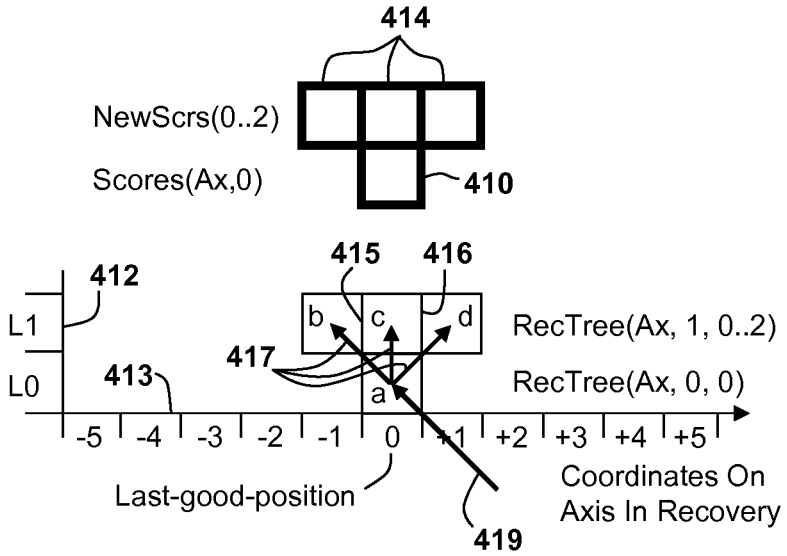
Figure 27C:
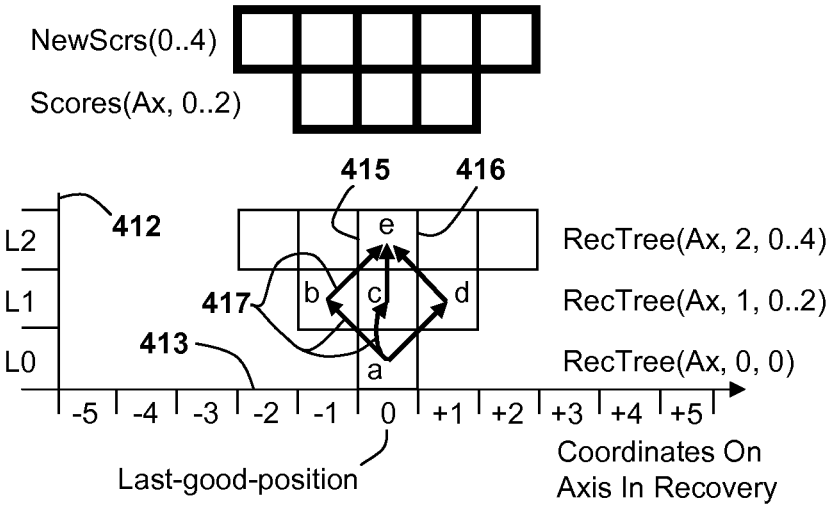

The arrangement is shown in FIG. 27(*a*). The RecTree( ) is illustrated by the square 418—at the moment it consists of one layer (labelled L0 on the vertical dimension 412) containing one element. Corresponding to that element is an element in the Scores( ) array, as illustrated by the thickly outlined box 410. The horizontal dimension 413 represents the positions on the axis in recovery relative to the last-good-position, now stored in LastGdPos( ). The alignment of the initial Scores( ) and RecTree( ) elements with the labels on dimension 413 indicates the position those elements represent, which is the last-good-position.

Figure 28:
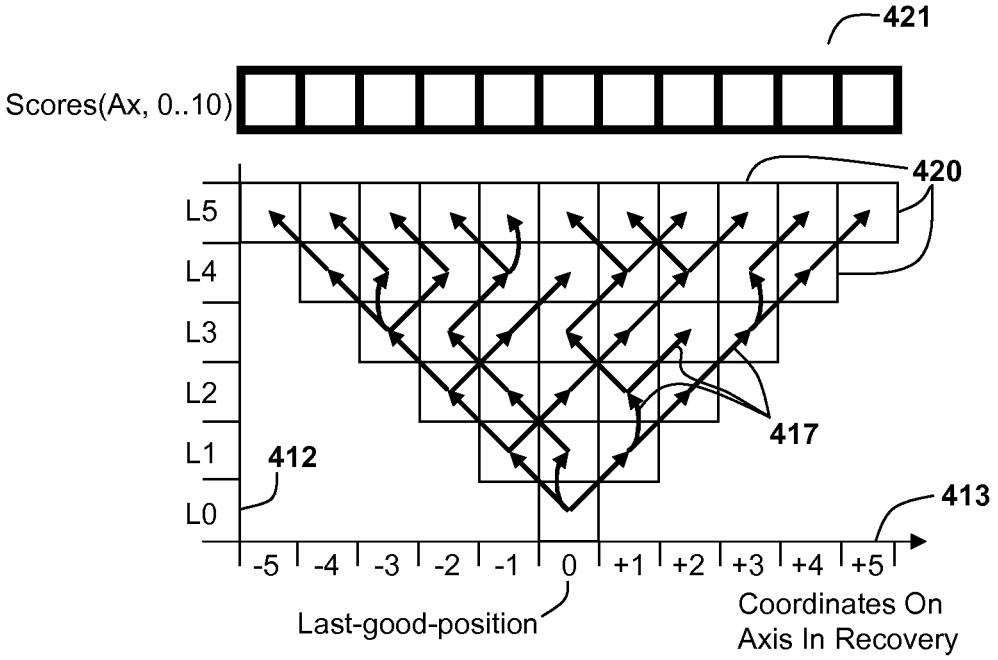
FIG. 28 is a diagram illustrating the structure and meaning of the Scores( ) and RecTree( ) data-structures after five new layers have been created using the five symbols sensed since the last-good-position.

Turning now to FIG. 28, this shows the RecTree( ) after five new layers have been created, as a result of five symbols sensed since the last-good-position. These layers are represented by the horizontal rows (labelled L0, L1, etc. on dimension 412) of boxes generally designated 420. Again the boxes represent elements in the layer, which in turn correspond to a position on the dimension 413.

Each element in the RecTree( ) contains a move-delta expressed with the values −1, 0 or +1 (representing the coordinate change caused by the move). The move-delta in each element represents the most likely route the sensor 340 took to reach the position represented by that element, from a previous position represented by an element in the previous layer, as indicated by the arrows generally designated 417. For simplicity the text will talk about moves and move-deltas from elements in one layer to elements in the next layer—it should of course be understood that this refers to potential sensor 340 moves between the positions represented by those elements.

Thus each element in the top (newest) layer represents the position at the end of a path that can be traced, using the move-delta values in the RecTree( ), back to the last-good-position. After it is created, each element in the newest layer has a corresponding element in Scores( ) (illustrated by the thickly outlined boxes 421), which measures the likelihood of the path ending in that element.

The first element of the RecTree( ) represents the move-delta into the last-good-position. This is already known, so the first element is never actually used and could be dispensed with. It is included simply because it makes understanding of the method a little clearer.

Returning now to FIG. 26, it can be seen that, after LastGdPos( ) and Scores( ).NDir are set up, step 394 initialises variables for a loop that will generate a new layer in the RecTree( ) for each of the Int(W/2)+1 symbols that have been sensed since the last-good-position. Step 394 first sets a temporary variable Idx to the index in Buff( ) of the first of those symbols (remembering the oldest symbol in Buff( ) is at index 0 and the most recent is at index W−1).

The layer that was just initialised in steps 392 or 393 is layer 0, so Layer( ) is set to 0 for the axis in recovery. This tracks the number of the last layer created for each axis in recovery. As no moves have yet been made the scores CScr and MSCnt in the initial element of Scores( ) are set to 0.

Step 395 then loads the variable Symbol with the symbol in Buff( ) which is the first symbol to be sensed after the last-good-position and the RecoverPosition 363 routine (described next) is called to create the first layer. Steps 397 and 398 increment Idx and test if all the Int(W/2)+1 symbols since last-good-position have been processed. If not, the loop repeats until they are and then the routine ends, returning control to TrackPosition 362 which also ends. The main loop then restarts at step 354.

RecoverPosition

Figure 30A:
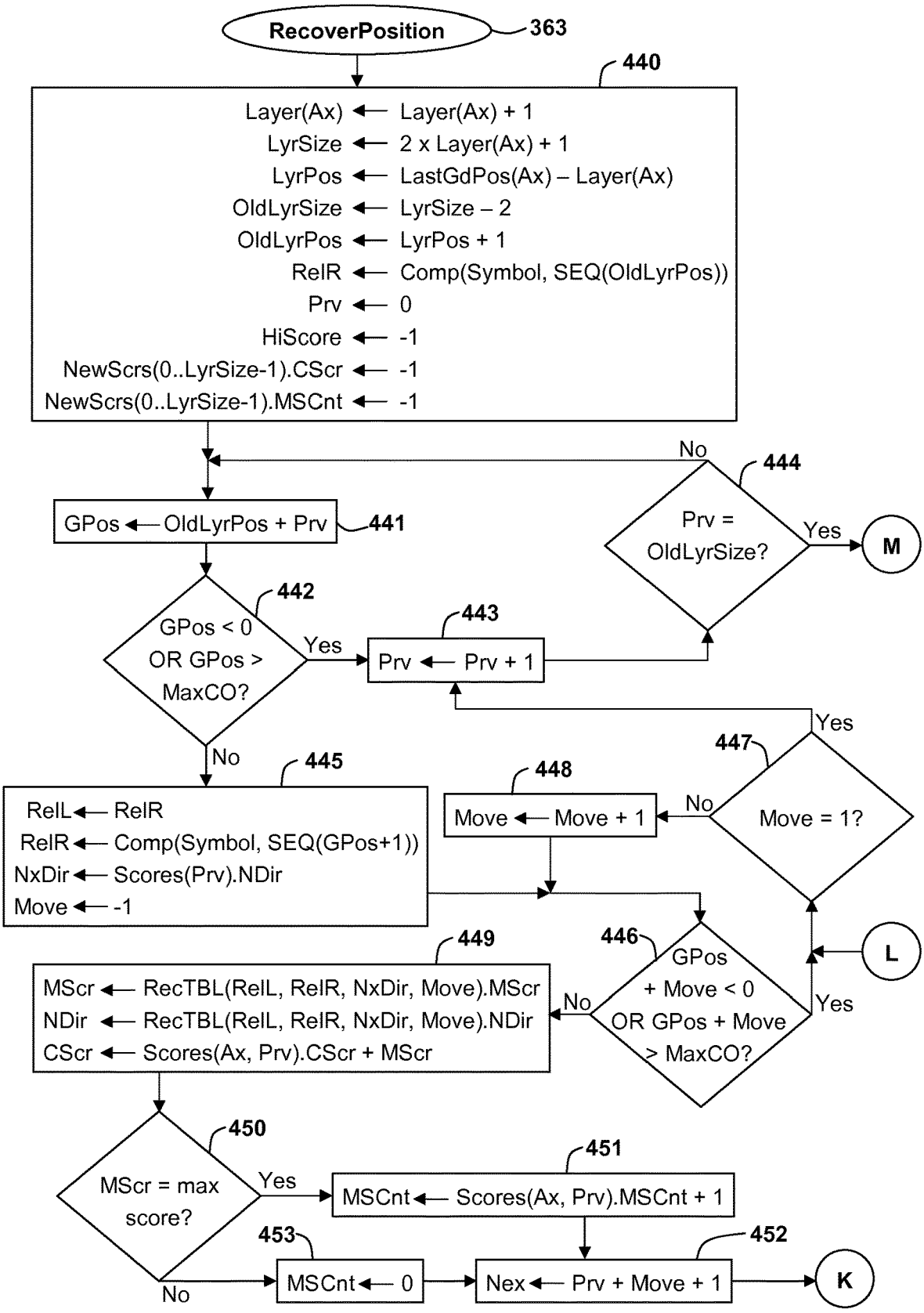
FIGS. 30(*a*), (*b*) and (*c*) are flowcharts illustrating the operation of the RecoverPosition 363 sub-routine for passive-mode positioning. The flowcharts are connected by the lettered connectors shown in circles on the flowcharts.
Figure 30B:
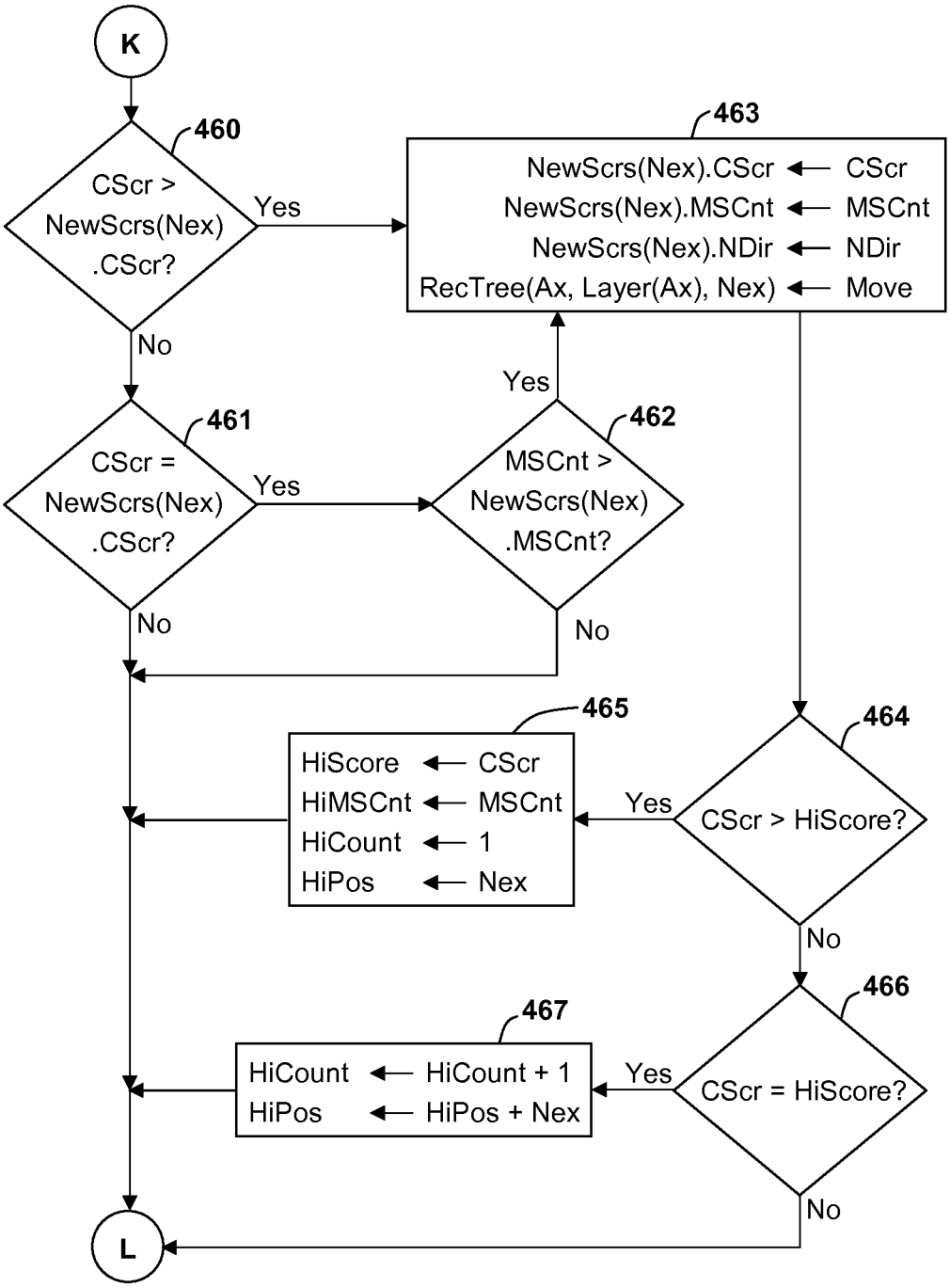
Figure 30C:
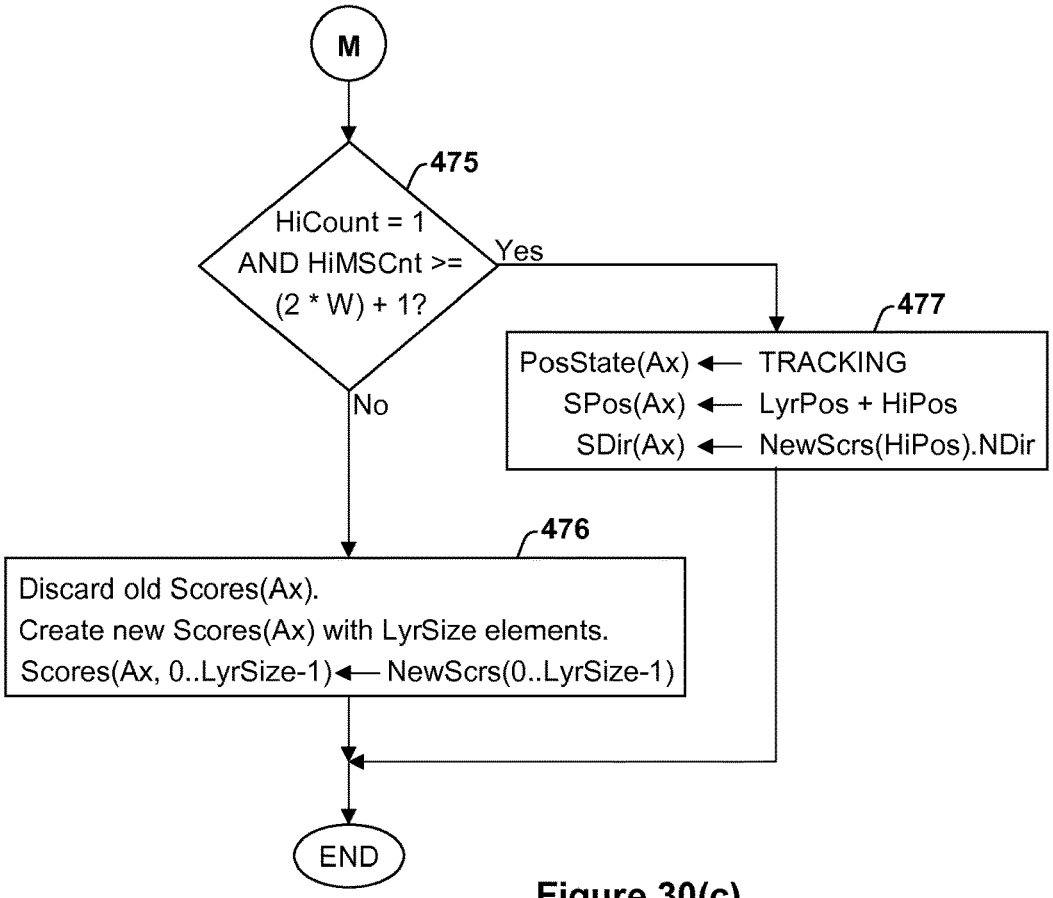

RecoverPosition is illustrated in FIG. 30(*a*). Essentially it creates a layer in the RecTree for the axis in recovery specified in Ax. The number of the last layer created for that axis is in Layer(Ax) and the sensed symbol that will be used to create the new layer is in Symbol. As just described, StartRecovery 377 initialises layer 0 and sets Layer( ) to 0 to reflect this. As RecoverPosition 363 is now about to create layer 1, the first instruction in step 440 increments Layer( ) for the axis in recovery. Step 440 then initialises the rest of the variables for this process. All these following variables are temporary and are discarded after the RecoverPosition 363 routine has completed.

Assuming for now that there are no bit-jumps or bit-errors, each time a symbol-line 300 or 301 is sensed the sensor 340 may have moved one more position, in either direction, further away from the last-good-position. To represent this, each new layer has two more elements than the previous layer. Thus step 440 sets LyrSize to 3, which is the number of elements in the new layer 1 (labelled L1 in FIG. 27(*b*)). LyrPos contains the coordinate position represented by the first ($0^{th}$) element in the new layer, which in this case is the last-good-position minus one. OldLyrSize and OldLyrPos are then set to the equivalent values: 1 and LastGdPos( ) for the previous layer 0.

The function Comp(x, y) is defined as returning 0 if symbol x has a lower value than symbol y, 1 if the values are equal, and 2 if x>y. In step 440 it is used to compare the value of the sensed symbol in Symbol with the value of the symbol in SEQ( ) to the left of the position represented by the first element in the last layer 0, which is the last-good-position. The result of the comparison is placed in the variable ReIR.

The variable Pry is used to index each element in the last layer and is initialised with 0. HiScore is used to track the highest scoring element in the new layer and is initialised to −1.

The NewScrs( ) array is temporary and so does not need to store data for each axis. As such it has no axis index but in every other respect it is structured in the same way as the Scores( ) array. NewScrs( ) is used to hold the scores for each element in the new layer—as such it has two more elements than the Scores( ) array, which holds the scores for the previous layer. The CScr and MSCnt variables in each element of the NewScrs( ) array are also initialised to −1.

Step 441 then calculates and stores in GPos the coordinate position represented by the first element in the old layer to be processed (indexed by Pry). Step 442 then tests if this position is within the range of coordinates encoded on the surface 1. If it isn't, Pry is incremented in step 443 and the next element in the old layer (if step 444 determines there are any) is processed.

Referring now to FIG. 27(*b*), as the first element a in the old layer 0 represents the last-good-position it must be within the surface 1, so step 442 fails. Step 445 then sets up the indices into the RecTBL( ) constant array that is used to score each possible move from the element a being processed in the last layer to each of the three elements b, c and d in the new layer, that could have been reached from the last element a (assuming no bit-jumps or bit-errors). These moves are represented in FIG. 27(*b*) by the arrows generally designated 417. FIG. 27(*b*) also shows the single element 410 in the old Scores( ) array, that relates to the single element in the old layer L0, and the three score elements 414 in NewScrs( ) for the new layer L1.

The moves from a to b and a to d represent, respectively, potential crossings of the symbol-lines 300 or 301 on either side of the coordinate position represented by a (the last-good-position). These symbol-lines 300 or 301 are represented in the diagram by the vertical lines 415 and 416 between elements. The move from a to c represents a potential move caused by a reversal on the line 415 or 416 to the left or right of a. Once we know which, the arrow from a to c will be represented with a bend to the left or right to indicate which line 415 or 416 was crossed, as shown by the similar arrows in FIG. 28 (to avoid confusion with arrows that cross the lines, the bend is not shown actually touching the lines—this should be assumed). Note also that when talking about symbol-lines 300 or 301 to the left or right of a position, this is with reference to the diagram. If the y-axis was in recovery, the symbol-lines 300 or 301 would obviously be above and below the position on the surface 1.

The likelihood of any of these moves happening depends on the relationship between the symbol that was actually sensed (in Symbol) and the symbol-lines 415 and 416 on either side of position a. For the line 415 to the left of a this relationship was determined using the Comp(x,y) function in step 440 and the result loaded into ReIR. This value is now transferred to ReIL (meaning relationship-left) and the relationship of the sensed symbol to the line 416 on the right of a is calculated and placed in ReIR (meaning relationship-right). These two variables are the first two indices required for the RecTBL( ) array.

In most applications it can be assumed that at any point in time the movable object is more likely to continue in the same direction relative to a particular coordinate axis, than it is to reverse direction. As such, it is more likely that a move out of any particular element will be in the same direction as the move into that element. Thus, for example, if the move into a was in the direction indicated by the arrow 419, then a move from a to b is considered more likely than a move from a to d. Similarly a move from a to c that reverses off the line 415 on the left of a is more likely than a move that reverses off the right-hand line 416.

The direction of the move into the previous element was set up in the StartRecovery 377 routine and is stored in the Scores( ).NDir variable for that element. This value is loaded into the NxDir temporary variable, which is the third index used for the RecTBL( ) array.

The fourth and final index is provided by the temporary variable Move, which is loaded with the move-delta (−1, 0 or 1) of the move we want to score. Initially, this will be the move from a to b, so Move is loaded with a move-delta of −1.

All the RecTBL( ) indices are now set up so step 446 tests if the move we're about to score is to a position outside the coordinate range represented on the surface 1. If it is, step 447 checks if there are any more moves to score and, if so, increments Move in step 448. If Move is already equal to 1 then all move-deltas have been processed, so step 447 passes control to step 443 which increments the Pry index, so the next element in the old layer (if step 444 determines there any) can be processed.

Assuming the move is ok, step 449 determines its scores and likely next direction by using the indices just created to access the RecTBL( ) constant array. In the present embodiment, eight potential types of move are considered, as illustrated by the table in FIG. 29(*a*). For each move type, the table illustrates the move in the column entitled "Illustration". The grey bars represent symbol-lines 300 or 301 on either side of a position and the arrows represent sensor 340 movements, in either direction, over those symbol-lines 300 or 301. The relationship of the sensed symbol to the value of the actual symbol-line 300 or 301 that would be transited by the move is given in the column entitled "Symbol Relationship". The score for the move is shown in the column entitled "Move Score". This reflects the probability of the move happening in this particular embodiment.

As can be seen from this table, in the preferred embodiment moves that match the sensed symbol and do not reverse are considered to be the most likely and attract the maximum move score of 7. Moves that match the sensed symbol but reverse over a space score a little less: 6. Reversals into the same position off a symbol-line 300 or 301 whose value is less than or equal to the sensed symbol also score 6 (the sensed value may be less than the actual symbol value if the sensor 340 only 'sees' part of the symbol-line 300 or 301 before it reverses off it). Moves that require a double reversal, within a coordinate position, off a symbol-line 300 or 301 whose value is less than or equal to the sensed symbol, score less still: 3.

A cross on the arrow indicates the symbol value sensed is less than the actual symbol-line 300 or 301 value (i.e. a bit-error, where dirt on the surface 1 may obscure part of the symbol-line 300 or 301; or a bit-jump, where a lifting of the sensor 340 may reduce the power of the returned radiation reaching the sensor 340). These moves score 1 if a reversal is also involved, 2 otherwise. A cross in a circle on the arrow indicates the symbol value sensed was greater than the actual symbol-line 300 or 301 value which, on a surface 1 with a black background 307, should be impossible and so scores 0.

Turning now to the table in FIG. 29(*b*) this shows the data used to load the RecTBL( ) constant array, when the system is initialised in step 350 (FIG. 23). The column 430 shows the direction the sensor 340 was moving in when it entered a position and the columns 428 and 429 list every possible relationship between the sensed symbol S and the symbol-line L and R on the left and right of a position, respectively. Thus it can be seen that the indices ReIL, ReIR and NxDir, set up in step 445 (FIG. 30(*a*)), select a row in the table. The fourth index Move, selects a column 425, 426, or 427. At the junction of row and column, two values are obtained: the move score (MScr) for the move and the direction (NDir) the sensor 340 will be moving in after the move.

The table lists which move, of the eight moves from the table in FIG. 29(*a*), is considered the most likely move (given the constraints of this particular embodiment) to explain each combination of: the indices ReIL, ReIR, NxDir and Move. This move is illustrated under the sub-columns titled "Illustr." in the table. The move score and next direction implied by that move provides the values under the MScr and NDir sub-columns.

Returning now to the flow-chart in FIG. 30(*a*), it can now be seen that step 449 uses the four indices to lookup in RecTBL( ) a move score (MScr) and a next direction for the sensor 340 (NDir). These are stored in the temporary variables of the same name. Step 449 also accumulates the score for the path this move is on, by adding the new move-score to the cumulative-score (CScr) for the path up to the position represented by the previous element a. As that was the first layer, CScr was zero—the value it was initialised to by step 394 in StartRecovery 377. So the new CScr is just the move score for this first move.

Step 450 then checks if the score assigned to this move was the maximum possible (=7), indicating it was a move without a reversal where the sensed symbol matched the actual symbol-line 300 or 301. If it is, the max-score-count (MSCnt) for this path in Scores( ) is incremented in step 451. If it isn't, the max-score-count is zeroed in step 453. Thus it can be seen that MSCnt is a measure of the length of the sub-sequence of symbols in SEQ( ) that matches the end of this path. It will be recalled that AcquirePosition 361 depended on getting a sufficiently long such sub-sequence to confirm its acquired position. The recovery method relies on a similar method to determine which of the paths represented in the RecTree( ) is the correct path, as will be described.

Step 452 then sets up the temporary variable Nex with the index of the element in the new layer that represents the position (b in FIG. 27(*b*)) this move would enter. Control then passes via connector K to step 460 in the flow-chart in FIG. 30(*b*).

Step 460 compares the cumulative-score (CScr) for the new move, with the score of any other moves into b that might already have been scored for this layer. As there are none, NewScrs( ).CScr will still be initialised to −1 from step 440, so step 460 tests true and control passes to step 463. This stores the new move's scores and next sensor-direction in the corresponding NewScrs( ) element for the new position. The move-delta for the move is then stored in element b in the RecTree( ) corresponding to that position (assuming that the RecTree( ) is required for recovering the path).

Step 464 then checks if the new move's cumulative-score is greater than the high-score for this layer, in HiScore. As HiScore was initialised to −1 in step 440, step 464 tests true and step 465 sets HiScore to the new move's cumulative-score, and HiMSCnt to the new move's max-score-count. HiCount is then set to 1 to indicate there is only one path with this high-score and HiPos is set to the index of the element b that the new move ended in.

Control then returns via connector L to step 447 in FIG. 30(*a*). Step 447 checks if all move-deltas have been processed. They haven't so step 448 increments the move-delta variable Move, the process repeats and the move from a to c is scored. It then loops one more time and the move from a to d is scored.

Once all moves are processed, NewScrs( ) will contain the scores for the moves (paths) to each position represented by each element in the new layer L1. Steps 464-467 inclusive will also have ensured that HiScore contains the highest cumulative-score amongst those paths and that HiCount is the count of the number of paths with that highest cumulative-score, HiPos is the sum of the indices for their destination elements in the new layer, and HiMSCnt is the max-score-count for the first of those high-scoring paths.

When control again returns via connector L, step 447 detects all moves have been processed (i.e. Move=1) and passes control to step 443, which increments the index Pry to point to the next element (i.e. position) to process in the old layer. As layer L0 only has one element OldLyrSize is equal to 1. Pry is now equal to this so test 444 fails, indicating all the elements in the old layer have been processed.

Control then passes via connector M to step 475 in FIG. 30(*c*), which checks if there was only high-scoring path and, if so, whether it has a max-score-count equal to 2*W+1 (=13 with W=6)—the reason for this value is explained later. If there is no such "winning path", step 476 discards the old Scores( ) array and creates a new one with the same number of elements as the new layer. The contents of NewScrs( ) is then copied to Scores( ) so this now has the scores for the layer just created. The NewScrs( ) structure can then be discarded.

If step 475 does find a winning path, then step 477 takes the system out of recovery for that axis, by setting PosState( ) to TRACKING, SPos( ) to the coordinate position represented by the end-point of the winning path (in element HiPos of the last layer), and SDir( ) to the direction of the sensor at the end of that path.

In either event, the RecoverPosition 363 routine completes and returns.

Figure 26:
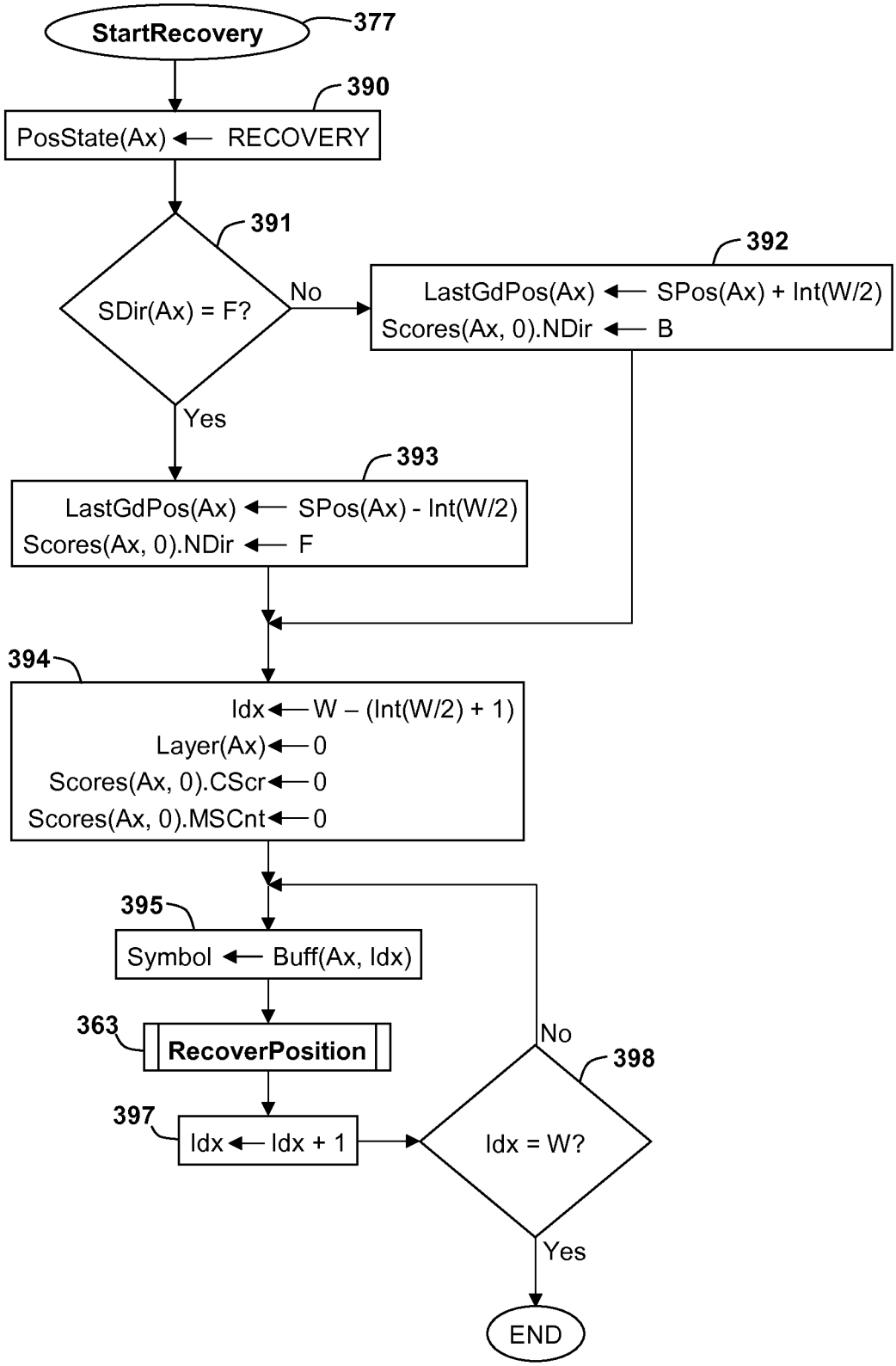
FIG. 26 is a flowchart showing the operation of the StartRecovery 377 sub-routine.

Returning now to the StartRecovery 377 flow-chart in FIG. 26, it can be seen that after RecoverPosition 363 has created layer L1 for the first symbol sensed since the last-good-position, control returns to step 397. This increments the index into Buff( ) so the next symbol can be obtained in step 395. This is executed after step 398 detects there are further symbols to be processed.

RecoverPosition 363 is then called again to create layer L2 using the second symbol sensed after the last-good-position. This is illustrated in FIG. 27(*c*). As before RecoverPosition 363 assesses the scores for each potential move from each of the elements b, c and d from the old layer L1 to the elements in the new layer L2.

If we consider the moves from b, c and d to position e, it will be seen that these moves have to compete for storage in their destination element e, because each element can only store one move into it. The move that is saved is the move with the highest cumulative-score (step 460) or, if two of the moves have the same cumulative-score (step 461) then it is the move with the highest max-score-count that wins (step 462). So the RecTree( ) does not store all possible paths but only the most likely paths to each potential position the sensor 340 could be in. In addition, only 2 bits are required to store the move-delta in each element of the tree, so it can be seen that the RecTree( ) is a memory efficient data structure, especially when considered against the prior-art.

Once the initial layers are set-up by StartRecovery 377 and RecoverPosition 363, control passes back to TrackPosition 362. This ends and control returns to the head of the main loop in step 354, FIG. 23. Every time a symbol is detected from the axis in recovery, the fact that PosState( ) is set to RECOVERY for that axis causes step 360 to call RecoverPosition 363 to create a new layer in the RecTree( ) and Scores( ) structures for the just sensed symbol. Once the correct path is identified recovery ends, and PosState( ) is reset to TRACKING, as described above.

It can be seen from the above that the higher the cumulative-score (CScr) and max-score-count (MSCnt) for an element, the more probable is the path that ends in that element. CScr is the accumulation of move scores (MScr) for each element in the path and thus the higher the scores for each move in a path, the higher is CScr. Clearly whichever path in the RecTree most closely follows the actual sensor 340 path will have the most high-scoring moves, as it will more often correctly predict each symbol seen by the sensor 340. The CScr advantage enjoyed by this correct path, over alternative paths, will typically increase over time as the correct path has more opportunity to accumulate high-score moves and the other paths have, correspondingly, more opportunity to collect low-score moves.

MSCnt is the number of contiguous sensed symbols, leading up to and including the last symbol sensed in a path, that were correctly predicted and which were all crossed in the same direction. As previously explained for the AcquirePosition 361 routine, the larger MSCnt is, the more likely it is that the path has actually crossed that sub-sequence of symbol-lines 300 or 301 on the surface 1 (rather than generating the sub-sequence by random reversals, bit-jumps or bit-errors) and the more likely it is that the position represented by the end of the path is the current position of the sensor 340. However, unlike the AcquirePosition 361 routine the test for a winning path in step 475 requires a single high-scoring path whose last 2*W+1=13 symbols match a 13 symbol sub-sequence in SEQ( ). This is less symbols than are required to confirm the position in the AcquirePosition 361 routine, which we saw needed 3*W=18 symbols to reduce the likelihood of an incorrect position to 1 in 1.7 million. As such, this method provides a significant advantage over prior art that was only able to recover a position by reacquiring it.

Figure 31A:
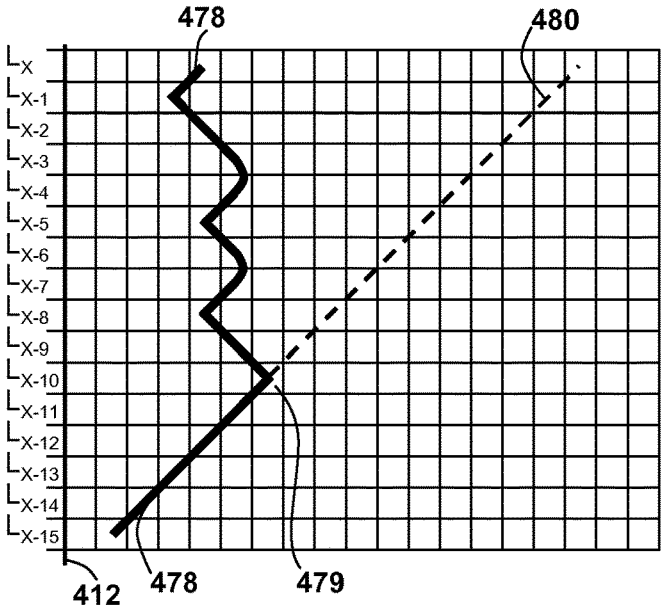
FIGS. 31(*a*) and 31(*b*) illustrate how branches may form at the end of the correct path in the RecTree( ) and FIG. 31(*c*) illustrates how branches from the correct path with less reversals than the actual sensor 340 path may be favoured over the actual path.
Figure 31B:
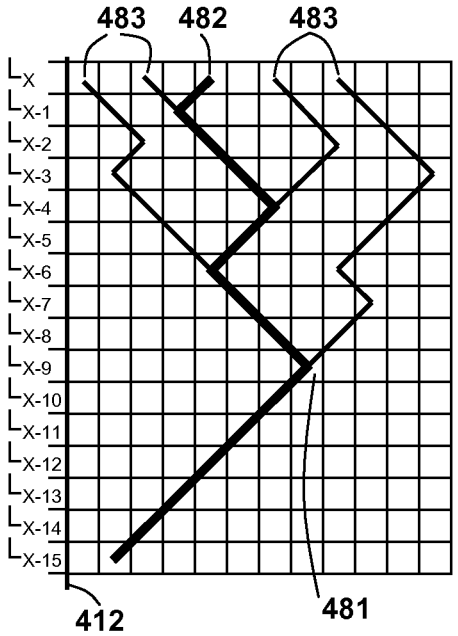
Figure 31C:
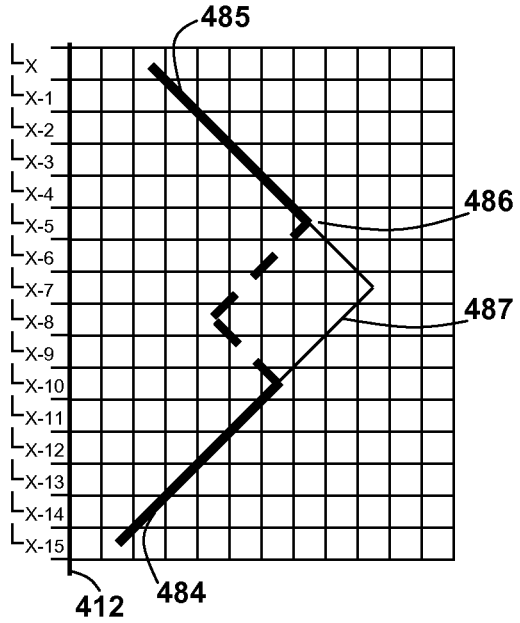

To understand why less symbols are required, assume the sensor 340 has crossed a number of symbol-lines 300 or 301 along a path 478 to arrive in a position 479, as shown in FIG. 31(*a*) where the sensor 340 path 478 (the correct path) is indicated by the thick unbroken line. As before the squares indicate elements in layers in some part of a RecTree( ). The later layers are shown with the newest layer $L_x$ represented by the row of squares at the top.

Assume that at position 479 the correct path 478 has got the highest cumulative-score but has not yet reached a high enough max-score-count to come out of recovery. Also assume that at position 479 the sensor 340 starts randomly reversing along the continuation of the path 478 past position 479. As a result, assume it senses a sequence of symbols that happen to match the specific sequence the sensor 340 would have sensed, if it hadn't reversed but had continued along the path 480 indicated by the thinner dashed line in FIG. 31(*a*) (call It the incorrect path). The probability of matching that incorrect path 480 is 1/(K^N), which for N=13 symbols and K=3 is roughly 1 in 1.6 million. This is comparable with the AcquirePosition 361 routine's probability of 1 in 1.7 million using 18 symbols. AcquirePosition 361 needs more symbols because it must guard against the possibility of matching any N length sub-sequence in the symbol sets 302 or 303, as opposed to matching the specific sequence crossed by the incorrect path 480.

Note there is a flaw in the simplified embodiment described above, as the incorrect path 480 does not, in fact, have to be 13 symbols long. At position 479 the incorrect path 480 would inherit the max-score-count (call it M) of the correct path 478 before it started reversing. So the incorrect path 480 would only need to be 13−M symbols long before it brought the system out of recovery with an incorrect position. Thus if M was 12 at position 479, only one symbol needs to be correctly randomly generated, which has a chance of 1 in 3 (K=3). This would cause the position recovered from the incorrect path 480 to be +/−2 coordinates out. If M was 11, then there is a 1 in 9 chance the position will be +/−4 coordinates out (worst case), and so forth.

A more sophisticated embodiment would, in step 475, require the sole high cumulative-score of the candidate winning-path to be at least 13 points greater than any other cumulative-score in the layer. This works because the incorrect path 480 also inherits the correct path's 478 cumulative-score at position 479. The correct path 478 will score a minimum of 6 points for each move (for a reversal in the current example) and the incorrect path 480 will score 7 points for each randomly generated 'correct' symbol-line 300 or 301 crossing.

So the incorrect path 480 must 'correctly' cross at least 13 symbols in order to accumulate a cumulative-score advantage of 13 points over the correct path 478. As stated the chances of this happening are 1 in 1.6 million. Of course, in practice, the correct path 478 is unlikely to reverse on every symbol and will instead cross a number of symbols that will score the maximum. If, for example, the application is such that the sensor 340 is unlikely to reverse more than once every $3^{rd}$ symbol (not an unreasonable assumption if the symbol-line 300 or 301 spacing is relatively fine compared to the typical movement lengths in the application) then the cumulative-score advantage required from the winning-path need only be 13/3=4. This will then deliver the same 1 in 1.6 million odds against picking the incorrect path 480, when the system comes out of recovery.

Error Recovery Alternatives

It should be clear that different applications with different constraints, and thus different move probabilities, may require different scoring weights than those described. Part of the strength of this method is the ease with which it can be adapted to new applications just by changing the RecTBL( ) data.

Different measures may also be applied. For example, the cumulative-score divided by the maximum potential score for a path (i.e. the maximum score multiplied by the number of layers) measures the proportion of correctly predicted symbols in a path. As was seen earlier the probability of random reversals generating a valid sequence is 1/(K^N). With K=3, the probability of generating a valid, say 5, symbol sequence is 1 in 243. Thus the probability of there being two randomly generated 5 symbol sequences separated by an error is (1 in 243) ^2=1 in 59,000 approximately. Given such a path is highly unlikely an alternative embodiment might bring the system out of recovery with a path in which 5 out of 6 symbols have been correctly predicted, which has a max-score-count of 5 (i.e. less than the 13 symbols previously described), and which has a cumulative-score at least 4 points more than any other (using the reasoning from two paragraphs earlier).

Other embodiments may dispense with the cumulative-score and max-score-count measures altogether. They may instead use Bayesian inference or other statistical methods to compute the probability of each path and to choose winning paths based on those probabilities, at the expense of more complex computations.

If skipping of symbols (i.e. bit-jumps) is expected to be a problem, alternative embodiments may use more than three move-deltas (−1, 0, +1) from each position. For example, if up to two symbols are likely to be skipped, then moves may be considered (and scored appropriately) from each element in a previous layer to five elements in the new layer, said moves being represented by the move deltas −2, −1, 0, +1, +2.

The number of symbols that are backtracked, in order to determine the last-good-position in StartRecovery 377, may advantageously be increased. The formula Int(W/2)+1 given earlier for that number of symbols, assumes that only one error occurs before the error is detected. If more than one error is likely to occur then it may be necessary to backtrack over more symbols (e.g. W symbols) to be assured of a last-good-position. Because the problem of multiple reversals is exacerbated when those reversals occur within a sub-sequence of symmetrical symbol-line 300 or 301 values, an alternative embodiment may dynamically vary the number of symbols backtracked, according to the number of such contiguous symmetrical symbol-line 300 or 301 values in the sensor's 340 locality when the error is first detected.

For similar reasons, the width of the first layer L0 in the RecTree( ), created when recovery first starts, may advantageously be increased. As described above, only one element was created in the first layer, which represents the last-good-position. If there is likely to be some uncertainty in relation to this position (if, for example, the system previously came out of recovery only a few symbols ago), then the first layer may be started with, for example, seven elements representing all positions +/−3 coordinates around the last-good-position. This 'widens the net' thereby increasing the RecTree( )'s chances of 'catching' the actual path.

Furthermore, some embodiments may widen the first layer, while still considering the last-good-position to be the more likely starting position. To reflect this, they may weight the initial cumulative-scores (normally zero) for the elements in the first layer. This weighting may reflect their distance from the last-good-position, such that positions that are further away start with a higher handicap (i.e. a lower cumulative-score).

In order to reduce the storage requirement of the RecTree( ) and Scores( ), and to reduce the number of previous elements that must be considered when creating a new layer, a layer-trimming algorithm can be advantageously implemented. For example, once a layer is created, the system can work in from both edges of the new layer and discard any elements whose cumulative-scores are less than the highest cumulative-score in the layer (in HiScore) minus a trim-margin. The process would continue in from the edges until elements are encountered on each side, whose cumulative-scores are greater than or equal to the threshold. For example, in an application where the correct path is unlikely to reverse more often than every $3^{rd}$ symbol then, using the reasoning applied before, a trim-margin of 4 will trim most paths other than the correct path and good branches from the correct path.

It will be noted that the outermost elements of each layer in the RecTree( ), can only be reached by the outermost elements at each edge of the previous layer. The move-delta stored in this element will therefore always be either +1 or −1, depending on the edge. As such the element can be discarded, saving space and processing time and, if the move-delta is required it can be determined simply by knowing which edge of the RecTree( ) we want the move-delta for.

Some embodiments may dynamically vary the use of, and/or parameters associated with, any or all of the methods described, or other similar methods not described, in a manner appropriate to the state or requirements of the system at any time, in order to enhance its position-sensing capabilities at that time.

Overflow Recovery

Layers keep adding to the RecTree( ) with each new symbol sensed from the axis in recovery. If the sensor 340 keeps reversing or other errors keep occurring, for whatever reason, then no path is likely to get a sufficiently large max-score-count (MSCnt) to allow the system to exit recovery. Thus it is possible the RecTree( ) could become too large for the space available in the memory-means 15. In this instance the most likely path in the tree at that time is recovered as far as possible and a smaller RecTree( ) is rebuilt using the symbols from the end of the path that could not be recovered. The system then continues in recovery.

As the RecTree( ) has overflowed it will contain a large number of layers. So there will have been more opportunities for the path (the correct path) most closely following the actual sensor 340 path to have accumulated more maximum move scores and for the other, incorrect paths to have accumulated more, lower move scores. As such the cumulative-score for the correct path is likely to enjoy a substantial advantage over the cumulative-scores for the incorrect paths.

Assuming there were no bit errors, then the fact that the system is still in recovery must mean that the actual sensor 340 path is reversing. These reversals typically cause the correct path to fragment, generating branches that, because they inherit the advantageous cumulative-score of the correct path, tend to beat other paths that don't branch from the correct path, when they compete for storage space in the RecTree( ). For example, FIG. 31(*b*) shows how this branching might happen. The thick line 482 represents the correct path and the thinner lines 483 represent the branching paths. These branches will inherit the cumulative-score of the correct path at the point they branch. As they may branch without reversing from points where the correct path reverses, they may initially enjoy a 1 point cumulative-score advantage over the correct path.

As we have seen, in the preferred embodiment the probability of randomly generating a valid 5 symbol sequence is 1 in 243; a valid 4 symbol sequence is 1 in 81; and a valid 3 symbol sequence is 1 in 27. So the branches from the correct path will typically traverse at most, and often much less than, 3 or 4 symbols before reversing themselves. Assuming the actual sensor 340 path reverses no more often than the branches (i.e. no more than every 3 or 4 symbols) then its cumulative-score will typically be no less than one, or at most two, points below the branches' cumulative-scores and may well exceed them. As already described, the validity of this assumption can be assured by ensuring the symbol-line 300 or 301 spacing is relatively fine compared to the normal movement lengths that can be expected in the application. Thus it can be seen that the correct path will typically have a cumulative score that is either the best or second best score amongst all the paths in the last layer $L_x$.

Even if the correct path does reverse more than every 3 or 4 symbols, because its cumulative-score diminishes it will tend to lose out when competing for storage in the RecTree( ) against its own branches that happen to reverse less often. As these branches themselves are likely to reverse within 3 or 4 symbols they tend to converge back to the actual sensor 340 position on the correct path. At that point the correct path will pick up the higher cumulative-score of the branch, so the correct path is recovered.

A typical example of this is shown in FIG. 31(*c*). The path of the sensor 340 is illustrated by the thick line 484, followed by the thick dashed line, followed by the thick line 485. At element 486 the path that will survive will be the branch illustrated by the thin line 487, because it has reversed only once and is already heading in the direction of line 485, while the path illustrated by the dashed line will have reversed twice and must reverse again if it is to go in the direction of line 485. However, this branch 487 now 'picks up' the correct path at element 486, so the correct path continues to be preserved (albeit with a diversion from the actual sensor 340 path) and now has the higher cumulative score of the branch 487.

The error caused by the branch diverging from the actual sensor 340 path is typically less than or equal to W−1 coordinate places. This is because branching tends to occur in groups of symbol-lines 300 or 301 whose values are symmetrical (e.g. 012210 or 0120210) and these groups can only be W−1 symbols long in an orientable sequence. For the branch to move further than W−1 symbols from the actual sensor 340 path the symbols must be generated as a result of random reversals. In the current example, with W=6 and K=3, the likelihood of a valid sequence W symbols long, and thus an error of W coordinate places is 1 in 729; an error of W+1 coordinate places is 1 in 2,187 and so forth, each of which are increasingly unlikely.

Of course this is the worst case. If the correct path is reversing less often than every 3 or 4 symbols, or is reversing amongst symbol-lines 300 or 301 with different values that are not symmetrical, the adherence of the correct path to the actual sensor 340 path will be much higher. The same is also true if windowing-sequences 302 or 303 are used that have shorter window-lengths W, such as the second sequence shown in Appendix A. However the extra symbols in the symbol alphabet that this requires demands more sophisticated digitisation circuitry in the decoding-means 8, in order to decode them.

It should now be clear that after many layers in the RecTree( ) the paths that have a cumulative-score that are the best or second-best in the last layer $L_x$ are likely to be the correct path or branches from the correct path. This fact is used by the overflow recovery method, which identifies all such paths and follows them back in the RecTree( ) to the point they converge (element 481 in the example in FIG. 31(*b*)), which will be the point they branched from the correct path.

The path from the last-good-position to this convergence point is then recovered, the last-good-position is changed to be the position represented by the convergence point, and a new smaller RecTree( ) is created using the symbols in Buff( ) that were sensed since the layer containing the convergence point (layer $L_{x-9}$). The recovery process can then continue with a revised value in Layer( ) for the last layer of the new RecTree( ).

Because in the worst case the convergence point may reasonably be up to W−1 coordinates from the actual sensor 340 position, the new RecTree( ) is built with a first layer that covers the +/−W−1 positions around the last-good-position, thereby ensuring the actual path can be captured by the RecTree( ).

To use the overflow routine, RecoverPosition 363 is modified to include a test before the Layer( ) variable is incremented in the initialisation step 440. This test checks if Layer( ) has reached the maximum number of layers supported by the memory-means 15. If it has, an Overflow routine implementing the above method is called. Once it has partially recovered the path and rebuilt a newer, smaller RecTree( ) the RecoverPosition 363 routine can continue.

Autonomous-Mode Position Sensing

The Position Sensing System described thus far is suited to movable objects that are moved in essentially random ways by an external force. In these applications, the position of the movable object at a point in time is not as important as recovering the most likely path of the object over the surface 1. For example, the Passive Mode operation of the Toy System described earlier is one such application. As such this type of positioning is referred to herein as passive-mode positioning.

However, for applications where the position sensing must enable self-propelled movable objects to autonomously follow a path across the surface 1, the requirements on the Position Sensing System are different. Here the past path of the movable object is not important, nor can the system wait until a path is determined. Instead the application needs to know its most likely position at all times, at least within some margin of error. This is typically needed so it can monitor the progress of the movable object towards a target position. The Active Mode operation of the Toy System is an example of an application requiring autonomous-mode positioning.

This Position Sensing System may be modified to meet these new requirements, using the methods now described.

Autonomous-Mode: Position Acquisition

Figure 32:
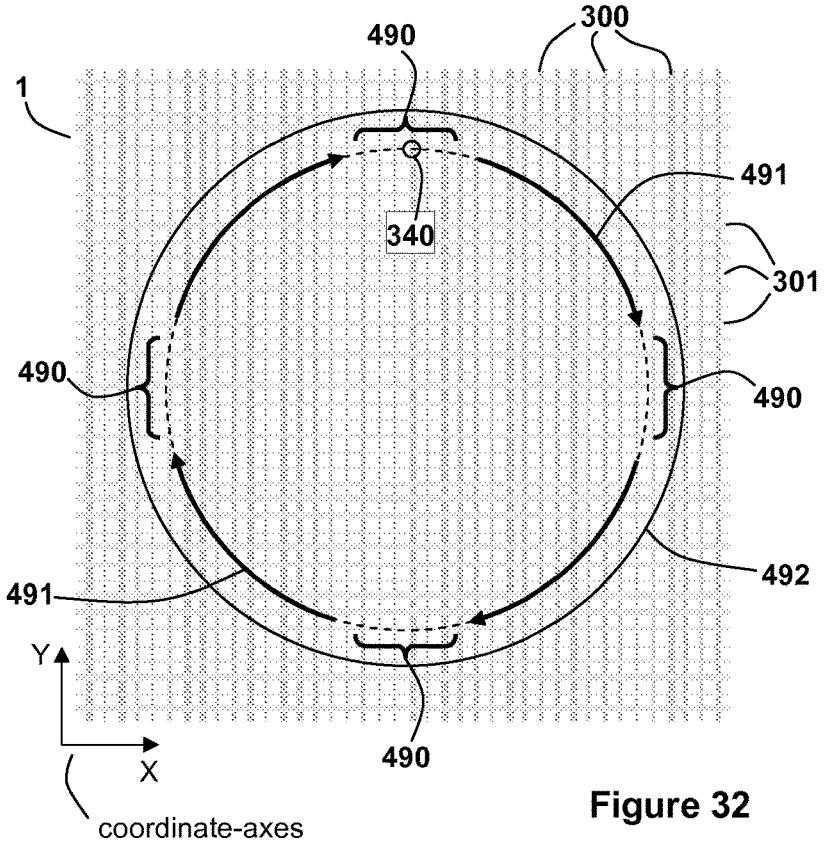
FIG. 32 illustrates how the direction of the sensor 340 changes in relation to the coordinate axes as the movable object is rotated during autonomous-mode rotary-acquisition. Note that the sequence encoding shown is illustrative only. Crossing squares 310 and background 307 are not shown.

If the movable object is self-propelled it can use rotary-acquisition to acquire its initial position on the surface 1. This simply involves causing the motors to rotate the wheels in opposite directions, causing the movable object to rotate about a vertical axis. If a sensor 340 is positioned sufficiently far in front or behind the wheel's axes, it will describe a circular path 491 over the surface 1, as shown in FIG. 32. This circular path 491 will encompass enough symbol-lines 300 or 301 for position determination using the method of sub-sequence matching described earlier. The diagram in FIG. 32 shows a portion of an encoded surface 1 in plan view, looking through the base 492 of the movable object. Note that in this diagram, like all others, the encoding of the surface is not intended to represent any particular sequence, and the crossing squares 310 and background 307 colour are omitted.

Note that the system must wait for the sensor 340 to pass a cusp generally designated 490. These are the points where the sensor 340 is travelling near parallel to a coordinate axis. Between these points, along the arrows generally designated 491, the sensor 340 will be travelling in the same direction across both axes. Because the system knows this, only one window length (W) of symbols is required to determine the position. There is no need to wait for longer sub-sequences because of the possibility of random reversals. However, if bit-jumps (less likely with autonomous motion) or bit-errors are a possibility, then a few extra symbols (e.g. W+2 total) can be matched to confirm the position.

Autonomous-Mode: Position Tracking

With autonomous-mode position sensing the system knows the movable-object's current orientation (about its vertical axis) on the surface and it knows the motor's speeds. With these two pieces of information, the system can calculate the sensor-direction in relation to each axis using the formula given below. This extra information allows the system to maintain a reasonably accurate sensor-position at all times, using the methods that are now described.

Autonomous-mode position sensing calculates the sensor-direction as the sensor 340 moves onto a symbol-line 300 or 301 (the entry-direction) and moves off a symbol-line 300 or 301 (the exit-direction). This ensures it can detect situations where the sensor 340, in following a curving path, enters and exits a symbol-line 300 or 301 on the same side (i.e. reverses on the symbol-line 300 or 301).

The instantaneous angular direction of the sensor 340 is calculated as: $a=b+ATan((d*(M_R-M_L))/(w*(M_R+M_L)))-Pi$, where all angles are radians in the range 0-2Pi and increase counter-clockwise from the positive y-axis of the surface 1 (i.e. the North). In this formula, a is the instantaneous sensor-direction angle; b is the orientation of the movable object at that instant; d is the perpendicular distance from the wheel-axles to the sensor 340; w is half the wheel-spacing; and $M_R$ and $M_L$ are the right and left motor speeds at that instant. ATan( ) represents the arc-tangent function (i.e. the inverse of the tangent function) and in this case returns a radian result in the range 0-2*Pi depending on the signs of the numerator and denominator in the argument. Note the equation assumes the sensing-point 4 is mounted forward of the movable object's wheel's axis, if it was mounted to the rear the equation is a=b−ATan( . . . )−Pi.

The fact that the movable object's orientation must be known in order to determine the sensor's 340 angular direction implies a requirement for two sensing-points 4 in order to get two independent positions from which to determine orientation. In another embodiment it may be possible to use just one sensing-point 4 and measure the relative rate at which x-lines 300 and y-lines 301 have recently been crossed. From this the sensor-direction may be directly determined, without the need to know the movable object's orientation or motor speeds. For the rest of this discussion, it will be assumed that the above equation is being used and that orientation is known from the positions of two sensing-points 4, mounted fore and aft of the wheel's axis.

By calculating the instantaneous sensor-angle, the system determines if the sensor 340 is moving Forwards, Backwards or Parallel to each axis. The Parallel direction is required because the forwards or backwards direction of the sensor 340 relative to an axis, when the sensor 340 is travelling near parallel to that axis, is uncertain for two reasons.

Figure 33:
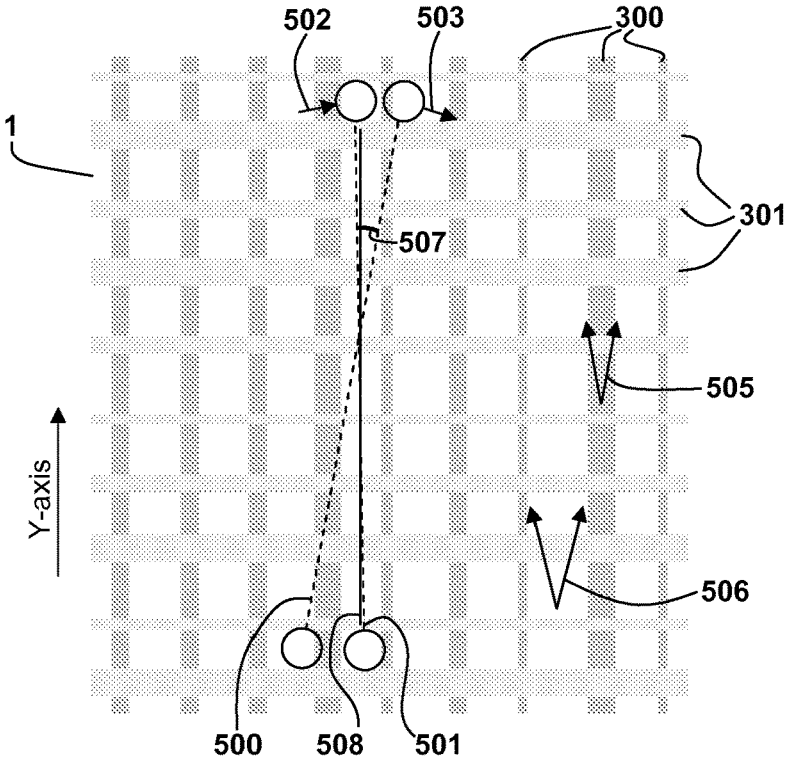
FIG. 33 illustrates the error-margin inherent in the determination of rotational orientation for the movable object. Note that the sequence encoding shown is illustrative only. Crossing squares 310 and background 307 are not shown.

Firstly, the resolution of the position encoding grid means there is an uncertainty in the orientation (b in the equation above) of the movable object. As an example FIG. 33 shows two orientations 500 and 501 that are represented in the diagram by a straight broken line (representing the orientation of the movable object) joining two circles (representing the front and rear sensors 340). FIG. 33 is not to scale and the crossing squares 310 and background 307 have been omitted for clarity.

Assuming the movable object is rotating in a clockwise fashion, it can be seen that orientation 500 represents the point where the sensors 340 have just moved into the position and orientation 501 represents the point where the sensors 340 are just about to leave the position. Thus it can be seen that the nominal orientation calculated for the orientations 500 and 501, which is represented by the line 508, actually has an error-margin (called the parallel-margin herein) equal to the angle 507 between the orientation extremes 500 and 501.

As can also be seen, at one end of this span the sensor-direction indicated by the arrow 502 relative to the y-lines 301 was forward and at the other end it will be backwards, as indicated by the arrow 503. Thus the direction relative to the y-axis (in this example) cannot be known. Instead when the angle of the sensor's 340 path relative to an axis is calculated as being less than the parallel-margin, the sensor-direction is said to be Parallel.

Secondly, as will be explained later, when an axis is in recovery in autonomous-mode the exact sensor-position on that axis may not be known—instead a position-error is calculated that represents a span of possible coordinate positions about a nominal position. Because of this the parallel-margin 507 shown in FIG. 33 will be significantly larger.

For both cases, the parallel-margin can be calculated from the position-error and sensor spacing using simple geometry. If a sensor 340 position is known (i.e. it is not in recovery), then the position-error is +/−0.5 to reflect the uncertainty in the sensor-position within a coordinate position, as was illustrated in FIG. 33.

During tracking mode, when the sensor 340 crosses a symbol-line 300 or 301, the system compares the entry-direction and exit-direction from that symbol-line 300 or 301. If they are the same and are Forwards or Backwards then the system uses the SEQ( ) constant array to determine the symbol expected from those directions. If the expected symbol is not the same as the sensed symbol, then recovery is started, otherwise the position is updated and the system continues tracking, as has been previously described.

If the entry- and exit-directions are different, but neither direction is Parallel, then the system assumes the sensor 340 has reversed on the symbol-line 300 or 301 on the side of the previous position implied by the entry-direction (i.e. on the other side of the previous position to the entry-direction). As a result, if the sensed symbol is equal to or less than the actual symbol-line 300 or 301 on that side, the system assumes this has happened and that the sensor 340 is back in its original position. Otherwise recovery is started.

If the entry-direction is Parallel then the sensor 340 may cross the symbol-lines 300 or 301 on either side of the previous position, as indicated by the arrows 506. With a Parallel exit-direction, the sensor 340 may leave the symbol-line 300 or 301 it is on, on either side, as indicated by the arrows 505. As such the new position cannot be determined, so if either the entry-direction or exit-direction is Parallel then recovery is started, as is now described.

Of course if the entry-direction is Parallel then more sophisticated embodiments may, prior to starting recovery, compare the sensed symbol with the symbol-lines 300 or 301 on either side of the previous position to see if the direction of the sensor 340 can be determined in this way. For exit-directions that are Parallel they may look at the future non-parallel direction of the sensor 340 (assuming the motor speeds are unchanged) and use this as a guide to the side of the symbol-line 300 or 301 the sensor 340 may have exited from.

Autonomous-Mode: Position Recovery

Autonomous-mode error recovery works essentially as previously described for passive-mode positioning, with some important differences.

Firstly, as autonomous-mode is not interested in the past path of the sensor 340, the RecTree( ) is not used.

Secondly, when recovery starts the system does not necessarily need to backtrack over a number of symbols to a last-good-position because autonomous-mode position recovery predicts when errors are likely (e.g. because the sensor is moving near parallel to an axis or because of an event, as described later) and starts recovery at that point. So in some embodiments the last-good-position can be taken to be the point immediately before the symbol that caused recovery to start, and the RecTree( ) can be created from there.

In other embodiments there may be a likelihood of bit-jumps, bit-errors or external forces (such as another toy impacting on this one). These cannot be predicted, so the error may have occurred earlier than the point recovery started and the last-good-position may be a number of symbols back. However, as the system has no interest in the past path it can start with a layer 0 that is at least as wide as the last layer would have been, if the system had backtracked and created layers with the symbols since the last-good-position.

For example, if the system normally backtracks four symbols then it will create four layers, after layer 0, for each of those symbols. So the last layer will be layer 4 with a size of 2*4+1=9 elements. In autonomous-mode recovery the system does not backtrack over these symbols, it simply starts with a layer that is at least 9 elements wide. This ensures the 'net' is cast wide enough to ensure that even if the error occurred 4 symbols ago, the path will still lie within the scope of this first layer.

Alternatively, other embodiments may still backtrack a number of symbols before creating the first layer (as in passive-mode positioning), even though the path is not required. This is because backtracking allows the correct path to (typically) gain an initial advantage over the other paths, which often allows the system to recover more quickly from the point at which the error is detected.

Thirdly, both the entry-direction and the exit-direction are used as indices to the RecTBL( ) constant array, along with the ReIL, ReIR and Move indices, as described before. Also, Parallel directions must now be catered for. Revised data for use in RecTBL( ) in autonomous-mode are shown in FIG. 34(*a*). This table provides a score for, and illustrates, the most likely move for each combination of the indices: ReIL, ReIR, EntryDir, ExitDir, and Move. Unlike the table in FIG. 29(*b*) this table does not return a next direction—it is unnecessary given that the entry-direction and exit-direction are now calculated.

The moves listed in the table are drawn from the table shown in FIG. 34(*b*). This has two more moves compared with the table in FIG. 29(*a*). These moves are a Parallel Move (indicating the sensor 340 may have crossed the symbol-line 300 or 301 to either side of the coordinate position), which scores 6, and a Parallel Bit Error (indicating the sensor 340 may have crossed the symbol-line 300 or 301 to either side but the sensed symbol value is greater than either of those symbol-lines' 300 or 301 value), which scores 0.

A move in the expected direction, where the sensed symbol matches the expected symbol-line 300 or 301 value, scores 7, as before. A move in which a reversal was expected, where the sensed symbol is less than or equal to the expected symbol-line 300 or 301 value, also scores 7. All other moves score 1 because, now that the sensor-direction can be calculated (unless the entry-direction or exit-direction is Parallel), there should never be a reversal or moves other than those expected. The exceptions are bit-errors and bit-jumps, which score 0, 1 or 2, as before.

Note that only moves where the entry-direction and exit-direction are Parallel are shown in the table in FIG. 34(*a*). There are no moves for Parallel/Forward, or Backward/Parallel, etc. moves. This is a simplification in the preferred embodiment that saves 36 table entries. Instead if either the entry-direction and/or the exit-direction are Parallel, then the other direction is set Parallel and the Parallel/Parallel scores are used. This is effective in practice, because the Parallel/Parallel entries score highly (6 or 7) for any move that is possible given the relationship between the sensed symbol value and the actual symbol-line 300 or 301 values, irrespective of direction. If the relationship is such that only one symbol-line 300 or 301 could have been crossed (or reversed on) and the crossing of that symbol-line 300 or 301 is implied by the Move index, then the score is 7. If both symbol-lines 300 or 301 could have been crossed (or reversed on) then the score is 6. If the Move index implies one or other of the symbol-lines 300 or 301 must have been crossed (i.e. Move=−1 or +1) and that symbol-line 300 or 301 does not match the sensed symbol, then the score is 1 or 0, as shown.

Of course, more sophisticated embodiments may list all Parallel/Forward/Backward combinations and score them appropriately.

The fourth difference with autonomous-mode position sensing lies in the way the system comes out of recovery. When Parallel/Parallel moves are not being used the system can, by definition, be reasonably sure of the direction the sensor 340 is moving. As such, if it crosses W symbols in the same direction and gets the maximum move score each time without a Parallel/Parallel move, it can be certain of its position. To determine when this has happened the max-score-count is incremented for each maximum move score, as before, but is now reset to zero if the move was not maximum, involved a reversal, or required a Parallel/Parallel score. If the max-score-count reaches W then the system comes out of recovery, irrespective of the cumulative-score.

Fifthly, in order to determine the entry-direction and exit-direction, the orientation of the movable object must be known at all times, even when an axis is in recovery. To do this embodiments may use either, or some combination, of the max-score-count or cumulative-score (or some other measure) as a means to determine a likely position for the sensor 340 while the axis is still in recovery.

Returning now to FIG. 31(*b*), it can be seen that branches from the correct path tend to occur on both sides of the correct path, so the actual sensor 340 position is likely to be within the span of positions represented by the end-points of those branches.

In the preferred embodiment, this fact is used to derive a likely sensor-position and a position-error. The system determines the spread (i.e. the difference in positions between the path with the lowest Scores( ) index and the one with the highest Scores( ) index) of paths with a cumulative-score greater than or equal to the second highest cumulative-score in the current layer. The mid-point of this spread is used as the likely average sensor-position and the position-error is calculated as being +/− half the spread. This can then be used to derive the parallel-margin, as previously described. The average sensor-position, position-error and parallel-margin are recalculated every time a new layer is created by the RecoverPosition 363 routine.

Of course, other embodiments may use other methods. For example, one embodiment may set the sensor-position to be the end-point of the first or second highest-scoring path that ends closest to the centre of the spread. Others may use the max-score-count and cumulative-scores (or some other measure that is devised) to weight the end-positions of each path before taking an average position.

Autonomous-Mode: Events

Because the Parallel/Parallel entries in the RecTBL( ) represent moves of uncertain direction they can be advantageously used to deal with autonomous-mode events, such as:

Start Events in which factors in the motor electronics, gearing, and bearings in the movable object may cause one motor to start fractionally ahead of the other. This could cause an unexpected initial swing of the sensor 340 in a random direction other than the one intended.

Stop Events in which mechanical play in the gearing and bearings in the movable object may combine with its inertia to cause the sensor 340 to momentarily continue in its previous direction when the system thinks it should be stationary.

Turn Events in which a sudden change in relative motor speeds intended to cause a sudden change in the sensor-direction may combine with inertia and mechanical play in the toy to cause the sensor 340 to momentarily continue in its previous direction, when the system thinks it should be going in the new direction.

Knock Events in which the movable object is pushed by an external force when its motors are stopped. This may cause symbols to be sensed when the system was not expecting any.

Because such events may cause symbol-line 300 or 301 crossings in directions not predicted by the motor-speeds, they may cause tracking or recovery errors. To handle this, when an event is detected an event-timer is started. This time-outs after the physical consequences of the event are over and are no longer likely to be responsible for any further sensed symbols. During Start, Turn or Knock events (i.e. while the time is active), if a symbol is detected its axis is put into recovery. Stop Events, as will be seen, do not require the axis to be put into recovery and so will continue in whatever mode the system is in (tracking or recovery).

Start, Stop and Turn events are detected when the motor speeds change; for Turn events, the change has to be greater than a defined threshold. Knock events are detected when a symbol-line 300 or 301 is sensed while the motors are stopped.

If a symbol-line 300 or 301 is entered or exited while the event-timer is active for a Start, Turn or Knock Event, then the appropriate entry/exit sensor-direction is set to Parallel, thereby reflecting the uncertainty in the sensor-direction. This will make the other direction Parallel when a new Scores( ) layer is created, as described previously. This ensures that moves in either direction from a position will score well if they are supported by the value of the sensed symbol versus the actual symbol-line 300 or 301 values on either side of that position.

Alternatively, because a Knock event is essentially the same as movement of the toy by the user, the passive-mode move scoring and lookup table algorithms can be temporarily engaged during the Knock event.

If a symbol-line 300 or 301 is entered or exited while a Stop Event is active, the system uses the motor-speeds just before the event to determine sensor-direction, rather than the current, zero motor-speeds.

Autonomous-Mode: Targeting

Autonomous-mode, of course, is about getting the movable object from A to B autonomously. If it's following a path, it will typically break that path into a number of short move-vectors, ideally longer than W coordinate positions in an axis (to aid positioning) but not that much longer. Given its current orientation and sensor-position, it then works out how much power to apply to the motors to move the sensor 340 to the target position. On the other hand, if the toy is rotating to a new position, it simply sets its motors in opposite directions. Either way, after setting the motors the system monitors the ongoing position of the sensor 340 until it has hit its target. There are a number of ways this can be achieved, examples of which are now given:

Major Axis Targeting

This ignores the sensor-position on any axis whose angle, in relation to the angle of the sensor's 340 path, is within an angular major-axis-margin (20 degrees in the preferred embodiment). This prevents the axis being considered (there can only be one) that is near parallel to the sensor's 340 path. As the position-error is likely to be larger for such an axis, this is clearly beneficial.

Both Axis Targeting

The position delta between the sensor's 340 current position and its target location is monitored. If this delta reaches zero for both axes, or its sign changes for one axis, the target is achieved.

Rotational Targeting

Sometimes in autonomous-mode the movable object may be required to rotate on its vertical axis until it has reached a target orientation. In this event the angular delta between the current toy orientation and the target orientation is monitored. When the delta reaches zero or becomes negative, the target is attained.

Counter Targeting

In some instances the system may need to count symbol-lines 300 or 301 crossed, on one axis and/or the other, in order to determine when it has reached its target position. The implementation of this is clearly trivial.

Move-Off and Lift-Off Sensing

Figure 18:
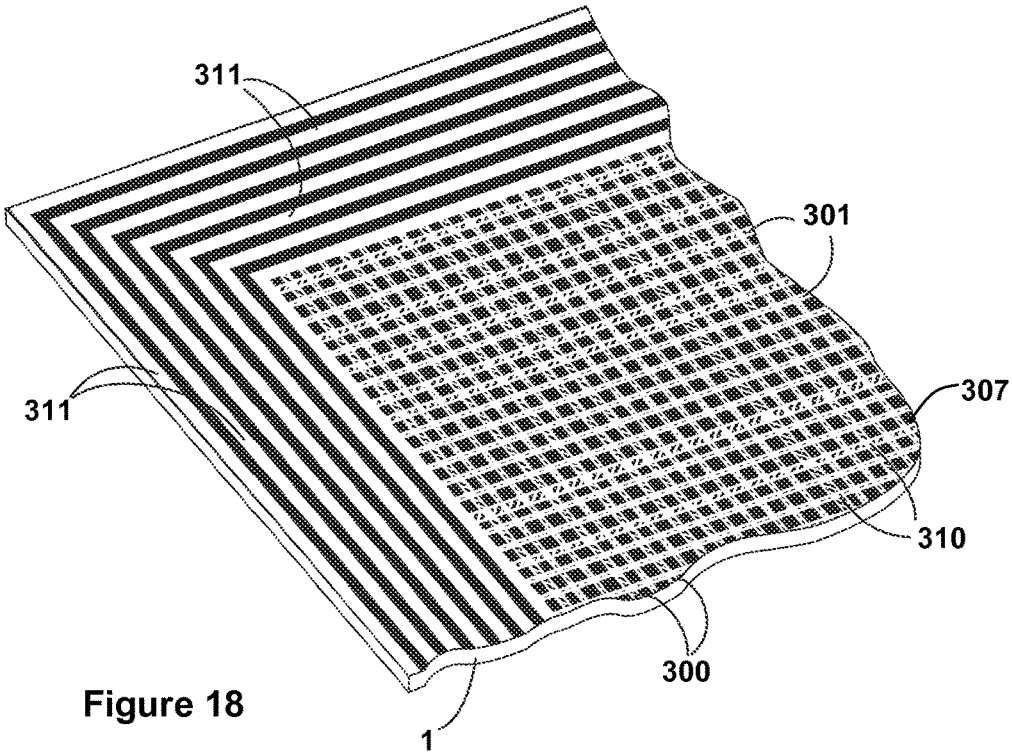
FIG. 18 is an illustration of part of one corner of a position encoded surface 1. Note that the sequence encoding shown is illustrative only.

Some embodiments may include a move-off means to determine when the toy has slid off the surface 1. In the preferred embodiment, said move-off means is achieved with border symbol-lines around the edge of the surface 1, as shown by the elements labelled 311 in FIG. 18. Each symbol-line 311 has the same value (2 in a preferred embodiment) and there are >=W of them (W+2 in the preferred embodiment), each encoded in the colour used to colour the intersection 310 of the x-lines 300 and y-lines 301. It will be recalled this is sensible when either axis' symbol-set 302 or 303 is being sampled.

The system monitors the position of the sensor 340 (either its tracked position, or the position of each element in the new layer, if in recovery) and, if it might have gone beyond the coordinate limits and may now be in the border area, it tries to confirm this by examining the buffers of symbols recently sensed from each axis and stored in Buff( ). If it sees more than W−1 symbols with value 1 (W−1 being the longest repeating subsequence of symbols, as previously explained) in both axes' buffers it can confirm it has entered the border area. This means it will have lost tracking on at least the coordinate axis that extends parallel to the border it is in. At this point, if it is passive-mode position sensing, the system may indicate to the user that they should drag it over sufficient symbol-lines 300 or 301 on the surface 1 for it to reacquire its position. If in autonomous-mode, the system can rotate the movable object towards the position-encoded region on the surface 1, move towards the position encoded-region and reestablish its position using rotary-acquisition.

Some embodiments may also include a lift-off means to determine when the toy has been lifted from the surface 1. This can be provided by a simple switch, or by monitoring the ambient light entering the sensor 340.

Encoding Orientation

It will be appreciated from the previous descriptions that a key issue with this type of positioning system is establishing the direction of motion of the sensor 340 with respect to an axis. If this direction can be determined as part of the symbol decoding process, then the position sensing can be greatly simplified. Following now are three methods for encoding orientation into the symbol-lines 300 or 301 on the surface 1.

In the first method, orientation-lines 511 with different values than the sequence encoding symbol-lines 300 or 301 may be used to encode orientation as shown by the diagram in FIG. 35(*a*). This may be applied to the x-lines 300 and the y-lines 301. In this method pairs of orientation-lines 511, with alternating values of "4" and "3", can be interspersed with symbol-lines 300 or 301 with, for example, the values of "0", "1" or "2" that were used before. The sensor-direction can be determined simply by noting the order in which the orientation-lines 511 are read.

These orientation-lines 511 can also act as position encoding symbols so their presence on the surface 1 does not reduce the positioning resolution of the system. In fact, because the symbol-lines 300 or 301 now only encode one-third the coordinates, less symbol-lines 300 or 301 are needed. This means the alphabet can be smaller or the sequence's window-length can be shorter. The latter is preferable because more lines (both orientation-lines 511 and symbol-lines 300 or 301) now need to be crossed, in order to read a window of symbol-lines 300 or 301, so shortening the window-length alleviates this. Uncertainty in the sensor-position can still exist as a result of reversals, bit-errors, etc. between the orientation-line 511 groups. It will now be clear how the previously described recovery method can be adapted to deal with this uncertainty simply by modifying the RecTBL( ) data and scores. Additionally it will be appreciated that, as soon as an orientation-line 511 group is crossed, the information can be used to rapidly bring the system back out of recovery.

In the second method, no changes are required to the symbol encoding at all. Instead the method relies on the fact that the spaces associated with, for example, "0", "1" and "2" symbols are different widths, as they flex with the different symbol-line 300 or 301 widths 304 to keep the coordinate width constant. The value of a symbol-line 300 or 301 can be sensed, as described earlier. Knowing the value, the symbol-line's 300 or 301 width 304 can be looked up, which can be combined with the time for the sensor 340 to cross the symbol-line 300 or 301 to determine the speed of the sensor 340. Assuming the speed remains constant across the adjoining space (which can be validated by the time it takes to cross the next symbol), the width of the space can be determined by timing the transition of the sensor 340 across the space.

Referring again to FIG. 19 it can be seen that the space associated with a symbol-line 300 or 301 is to the right of (or below) that symbol-line 300 or 301. Assume a symbol is read and the space following that symbol is equal to the width of the space associated with that symbol. Provided the next symbol sensed does not have the same value as the previous symbol then the sensor 340 must be moving from left to right (forwards). Similarly if the space does not match the symbol and the next symbol is different, then the sensor 340 must be moving from right to left. In situations where the current and next symbols are the same, or where the sensor 340 speed varies as it crosses symbol-lines 300 or 301 and their intervening space, orientation cannot be determined. In such situations the RecTree( ) method already described is used as the fallback. Again, as soon as the orientation can be determined the system can then be brought rapidly out of recovery.

The third method renders the orientation-lines 520 in a third material sensible to the sensor 340 when stimulated by a third frequency of radiation, where such third frequency does not cause an appreciable response in the other two materials. For example, if the x-line 300 and y-lines 301 are rendered in blue and red inks, then the orientation-lines 520 may be rendered in a transparent infra-red reflective ink. The system thus requires an extra energy-source (e.g. an infra-red LED) and an extra sensing cycle to decode the output of the sensor 340 when the surface 1 is illuminated by the third energy-source.

The orientation-lines 520 are laid adjacent to the symbol-lines 300 and 301, as shown in the diagram in FIG. 35(*b*). This shows part of the symbol encoding; note that squares 310 as previously described are shown at the crossing points of the symbol-lines 300 or 301 but the black background 307 is omitted. The layout is such that there is a point when the sensor 340 will 'see' both the symbol-line 300 or 301 and the orientation-line 520. The arrows 521 and 522 indicate two sensor 340 paths over a symbol-line 300 in opposite directions and these paths result in sensor 340 outputs indicated by the graphs 525 and 526 respectively. These graphs show the output 527 of the sensor 340 when the surface 1 is illuminated by the symbol-line's 300 or 301 characteristic wavelength, and the sensor 340 output 528 when the surface 1 is illuminated by the orientation-line's 520 characteristic wavelength. As can be clearly seen the relative phases of the outputs 527 and 528 can be used to determine sensor-direction.

Note however that there is an issue when the sensor 340 moves along paths indicated by the arrows generally designated 523. Because the sensor 340 is constantly 'seeing' the orientation-line 520 it cannot be used to determine orientation. Fortunately such paths will be rare (or at least relatively short) in normal applications and can be dealt with by the recovery method described earlier, which does not require orientation information. Obviously, as soon as the orientation information does become available, then the information can be used to bring the system out of recovery much more rapidly than before.

Similarly, paths as illustrated by the arrow 524 can also cause problems because they cause orientation-lines 520 to be 'seen' immediately before and after the symbol-line 300 or 301. Again, in these instances, the recovery method described earlier may be employed.

Of course, if the x-axis and y-axis orientation-lines 520 are rendered in two materials, each with characteristic wavelengths separate from each other and the other sequence symbol-lines 300 or 301, then the problem illustrated by arrows 523 and 524 does not arise.

APPENDIX A

1. Following is an example of a 258 symbol orientable windowing-sequence with window-length=6 symbols and a 3 symbol alphabet of "0", "1" and "2":
   1001101000110200001110101001200010200101200102
   1000200111112000
   2020101120011201012100111201101 11
   1210020210021201020111211000 2 201120201121011
   1220012200201200202200211210202210112120112 2
   0120120211121210120220121202022201221120 2
   2112122202122022222120 12 2212200000
2. Following is an example of a 245 symbol orientable windowing-sequence with window-length=4 symbols and a 5 symbol alphabet of "0", "1", "2", "3" and "4":
   1011120003010200112100310040113011400221013111
   4102102221132003201321032114202030312022302
   1213130224003310332033311430140124013401
   4212 2312241204031402321332140323133402403 34
   1242034034213413240414134222324144 22
   342303432 3334340443242434423344424020

The invention claimed is:

1. A toy system comprising:

a surface;

a plurality of position encoding elements associated with at least part of the surface, the position encoding elements being encoded with position information relating to absolute positions in one or more two-dimensional coordinate-spaces with reference to the at least part of the surface;

a toy, said toy being moveable about the surface, either under its own power or manually by a user, and having at least one sensor that samples successively the position information derived from the presence of the one or more position encoding elements, when it moves about the surface;

a processor, in communication with the toy, the processor being configured to process the position information sampled by the sensor and determine the coordinates of one or more absolute positions of the sensor with respect to the at least part of the surface, wherein, when the sensor is reversed, or when bit-jumps or bit-errors are encountered, the position of the sensor is recovered by assigning scores to potential positions of the sensor based on information derived from previously sampled successive position information, from which scores the coordinates of the most likely absolute position of the sensor are determined and assigned as the actual position with respect to the at least part of the surface; and wherein said toy system has at least one mode of operation in which said processor is configured to capture at least a part of the path of the toy with respect to the coordinates determined for one or more absolute positions of the sensor on the surface, as it is moved, arbitrarily in any direction, about the surface by the user.

2. The toy system as claimed in claim 1, wherein said processor determines any or all of the following:

a) the speed of the toy across the surface;

b) the orientation of the toy with respect to the surface;

c) the path of the toy across the surface; or d) the distance of the toy from, or the direction of the toy towards, another toy or an object on or element in the surface.

3. The toy system as claimed in claim 1 or 2, wherein the toy is not physically connected to the surface, or wherein there is no electrical connection between the toy and the surface.

4. The toy system as claimed in claim 1, wherein the toy is movable in an unrestricted manner in any direction with respect to the surface.

5. The toy system as claimed in claim 1, further comprising an activity-recorder to record at least one activity-recording which records one or more of the path, the speed or the orientation of the toy with respect to the surface.

6. The toy system as claimed in claim 1 which further comprises a communicator to communicate with a second toy in order to allow a user of the toy system to control one or more of the movements, actions or speech of the second toy on the surface of the toy system, or virtually, via the internet, on the surface of a second toy system.

7. The toy system as claimed in claim 1, wherein said surface is divided into areas, each area having an associated information content, and wherein the toy is provided with either or both of audio or visual outputs that output the information content associated with each area when said sensor is moved over the corresponding area.

8. The toy system as claimed in claim 1, wherein said toy comprises at least one wheel, ball or other friction-reducing device for enabling the toy to travel across the surface.

9. The toy system as claimed in claim 1, which is provided with:

a) a passive mode in which the toy is free to be moved around on the surface by a user; and b) an active mode in which the toy moves across the surface under its own power.

10. A toy system comprising:

a surface;

a plurality of position encoding elements associated with at least part of the surface, the position encoding elements encoded with position information relating to absolute positions in one or more two-dimensional coordinate-spaces with reference to the at least part of the surface;

a toy, said toy being moveable about the surface, either under its own power or manually by a user, and having at least one sensor that samples successively the position information derived from the presence of the one or more position encoding elements, when it moves about the surface;

a processor, in communication with the toy, the processor being configured to process the position information sampled by the sensor, wherein the processor determines the coordinates of one or more absolute positions of the sensor with respect to the at least part of the surface, and wherein, when the sensor is reversed, or when bit-jumps or bit-errors are encountered, the position of the sensor is recovered by assigning scores to potential positions of the sensor based on information derived from previously sampled successive position information, from which scores the coordinates of the most likely absolute position of the sensor are determined and assigned as the actual position with respect to the at least part of the surface.

* * * * *